US012788137B2

(12) United States Patent
Stanley

(10) Patent No.: US 12,788,137 B2
(45) Date of Patent: Nov. 10, 2026

(54) MODULAR FURNITURE SYSTEM

(71) Applicant: Cleon Prescott Stanley, Union City, NJ (US)

(72) Inventor: Cleon Prescott Stanley, Union City, NJ (US)

( * ) Notice: Subject to any disclaimer, the term of this patent is extended or adjusted under 35 U.S.C. 154(b) by 253 days.

(21) Appl. No.: 18/557,574

(22) PCT Filed: Jun. 1, 2022

(86) PCT No.: PCT/US2022/031707
§ 371 (c)(1),
(2) Date: Oct. 26, 2023

(87) PCT Pub. No.: WO2022/256365
PCT Pub. Date: Dec. 8, 2022

(65) Prior Publication Data
US 2024/0218894 A1 Jul. 4, 2024

Related U.S. Application Data

(60) Provisional application No. 63/195,356, filed on Jun. 1, 2021.

(51) Int. Cl.
*A47B 1/04* (2006.01)
*A47C 13/00* (2006.01)

(52) U.S. Cl.
CPC ..... *A47B 1/04* (2013.01); *A47C 13/005* (2013.01)

(58) Field of Classification Search
CPC ..... A47B 5/04; A47C 13/005
USPC ..... 297/440.14
See application file for complete search history.

(56) References Cited

U.S. PATENT DOCUMENTS 3,233,942 A * 2/1966 Creutz ..... A47B 85/00 297/118
3,598,444 A * 8/1971 Seiter ..... A47D 1/006 297/451.3
3,632,170 A * 1/1972 Witt ..... A47C 7/18 297/440.22
4,311,337 A * 1/1982 Brunn ..... A47C 1/124 297/440.22
5,518,298 A * 5/1996 LaPointe ..... A47C 13/005 297/440.16
6,041,721 A * 3/2000 Weston ..... E05C 19/14 108/65
6,155,641 A * 12/2000 Frost ..... A47C 3/20 297/440.13
6,367,874 B2 * 4/2002 Casini ..... A47D 9/053 297/130

(Continued)

FOREIGN PATENT DOCUMENTS

DE 202017105239 * 9/2017
EP 0111679 A2 * 6/1984 ..... A47C 4/03

(Continued)

*Primary Examiner* — Jose V Chen
(74) *Attorney, Agent, or Firm* — Grant Attorneys at Law PLLC; Kristin Grant

(57) ABSTRACT

A modular furniture system includes a plurality of frame portions, a plurality of slats, a first removable support; and a first coupling mechanism. The first coupling mechanism is configured to couple a first slat of the plurality of slats to the first frame portion without using any tool, and to release the first slat from the first frame portion without using any tool.

17 Claims, 26 Drawing Sheets

(56) References Cited

U.S. PATENT DOCUMENTS

| | | | | |
|---|---|---|---|---|
| 6,666,518 | B2 * | 12/2003 | Bruschi | A47C 4/03 297/440.14 |
| 6,752,464 | B1 * | 6/2004 | Tseng | A47C 4/02 297/440.16 |
| 6,783,182 | B1 * | 8/2004 | Gallagher | A47C 4/02 297/440.22 |
| 8,033,611 | B2 * | 10/2011 | Chen | A47C 11/00 297/451.12 |
| 8,128,173 | B2 * | 3/2012 | Huang | A47C 4/03 297/440.1 |
| 9,565,946 | B1 * | 2/2017 | Watton | A47C 11/00 |
| 10,188,211 | B1 * | 1/2019 | Whidden | A47C 31/003 |
| 2001/0045768 | A1 * | 11/2001 | LaBlance | A47C 5/12 297/440.14 |
| 2009/0189433 | A1 * | 7/2009 | Wilson | B60N 2/686 297/440.14 |
| 2016/0174715 | A1 * | 6/2016 | Nelson | A47C 17/045 297/440.14 |
| 2017/0234341 | A1 * | 8/2017 | Packman | A47B 87/0292 312/108 |
| 2017/0258224 | A1 * | 9/2017 | Reynolds | A47C 13/005 |
| 2018/0027964 | A1 * | 2/2018 | Serure | A47B 85/06 |
| 2018/0242746 | A1 * | 8/2018 | Lawson | A47C 1/124 |
| 2021/0093087 | A1 * | 4/2021 | Zei | A47C 4/028 |
| 2021/0196049 | A1 * | 7/2021 | McCreary | A47C 17/04 |
| 2022/0065277 | A1 * | 3/2022 | Zhai | A47C 5/043 |

FOREIGN PATENT DOCUMENTS

| | | | | |
|---|---|---|---|---|
| EP | 1632154 | A1 * | 3/2006 | A47C 19/005 |
| GB | 756188 | A * | 8/1956 | A47C 11/00 |

* cited by examiner

MODULAR FURNITURE SYSTEM

CROSS-REFERENCE TO RELATED APPLICATIONS

This application is based on and claims benefit under 35 USC § 119 from Provisional Application No. 63/195,356 filed Jun. 1, 2021. The disclosure of the prior application is hereby incorporated by reference herein in its entirety.

BACKGROUND

Technical Field

Generally, this disclosure is directed to a modular furniture system that is a flexible furniture assembly system.

Related Art

Generally, modular furniture systems allow pre-made parts to be combined in different ways to furnish a room. For example, in related art, a set of parts is provided to a user for assembly into furniture. However, in the related art, the methods to assemble the furniture are complex, and tools are required for assembly (e.g., screwdrivers, hammers, Allen wrenches or hex keys, wrenches, and so on). In particular, the requirement to use tools to assemble furniture makes assembling the furniture difficult and time consuming.

Similarly, in the related art, the complexity and difficulty of disassembling furniture makes such disassembly, as well as modification, of furniture laborious and altogether impractical. Further, even if the assembled furniture can be disassembled in the related art, tools are required to do so. Similarly, even if the configuration of the assembled furniture in the related art can be changed, such changing is difficult and time consuming because of the tool requirement.

Some related art, such as U.S. Design Pat. No. D817,057, U.S. Pat. Nos. 10,182,659, 10,433,648, 10,932,580, and 11,147,385, describes using latches only to connect completed sofa/sectional modules.

Due to these problems, the modular furniture according to the related art cannot be quickly and easily assembled and disassembled for installation, modification, storage or moving to a different location. This results in greater effort and higher costs to move and store furniture being a burden on the user according to the related art.

SUMMARY

The modular furniture system disclosed herein addresses the foregoing problems in the related art. In particular, the present disclosure provides a modular furniture system that is configured to be assembled, disassembled, and modified quickly and easily. This easy assembly, disassembly, and modification of furniture according to the disclosed modular furniture system can be achieved by inclusion of at least one coupling mechanism that requires no tools to couple and release parts of furniture as will be described herein.

BRIEF DESCRIPTION OF THE DRAWINGS

An exemplary embodiment of the present disclosure will be described in detail based on the following figures, wherein.

DETAILED DESCRIPTION OF EMBODIMENTS

Figure 1A:
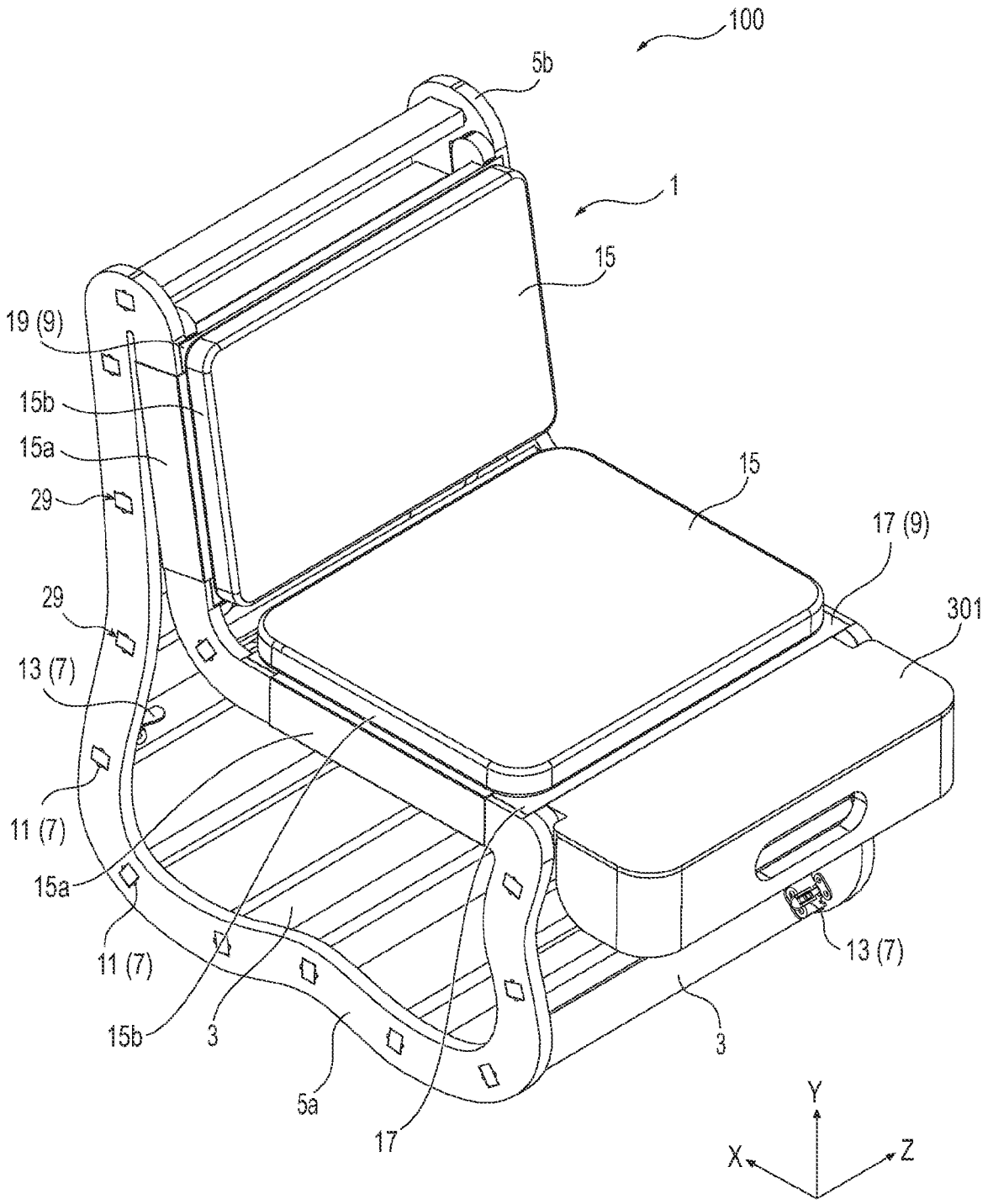
FIG. 1A is a top view of a first exemplary configuration of the modular furniture system.

A modular furniture system 100 according to an exemplary embodiment is a flexible furniture assembly system. Advantageously, configurations of the modular furniture system 100 are physically non-laborious to assemble and disassemble because parts of the modular furniture system 100 are coupled to other parts of the modular furniture via coupling mechanisms that do not require any tools (e.g., screwdrivers, hammers, Allen wrenches or hex keys, wrenches, and so on) to couple the parts and do not require any such tools to release the parts. The parts of the modular furniture system 100 include a plurality of slats 3, at least two frame portions 5, at least one coupling mechanism 7, and at least one removable support 9.

The modular furniture system 100 can be configured, using a combination of the slats 3, the frame portions 5, the at least one coupling mechanism 7, and the at least one removable support 9, as furniture such as a chair, a sofa, a coffee table, or a TV Stand. The slats 3, the at least one coupling mechanism 7, and the at least one removable support 9 are interchangeable between different types of furniture based on the configuration of the modular furniture system 100, thus allowing the furniture made using the modular furniture system 100 to be applied to many different types of furniture as discussed in greater detail below. In addition the slats 3, the frame portions 5, and the at least one removable support 9 are coupled to each other using only the at least one coupling mechanism 7. The at least one coupling mechanism 7 is configured to couple the components and release the components, without the use of any tools. In other words, no tools are necessary for a user to assemble, disassemble, and modify any configuration of parts of the modular furniture system 100.

Furniture assembled according to the modular furniture system 100 is easily assembled and easily disassembled. Because furniture according to the modular furniture system 100 is easy to assemble and disassemble without tools, the furniture assembled according to the modular furniture system 100 is also easily transported and easily modified. For example, users can easily modify living room furniture to dining room furniture without using any tools, and modify vice versa, as needed. Because the parts of the modular furniture system 100 are smaller than the assembled furniture, users can easily store the parts when not in use, thereby allowing the user to have access to many different types of furniture even with limited available space.

Figure 1B:
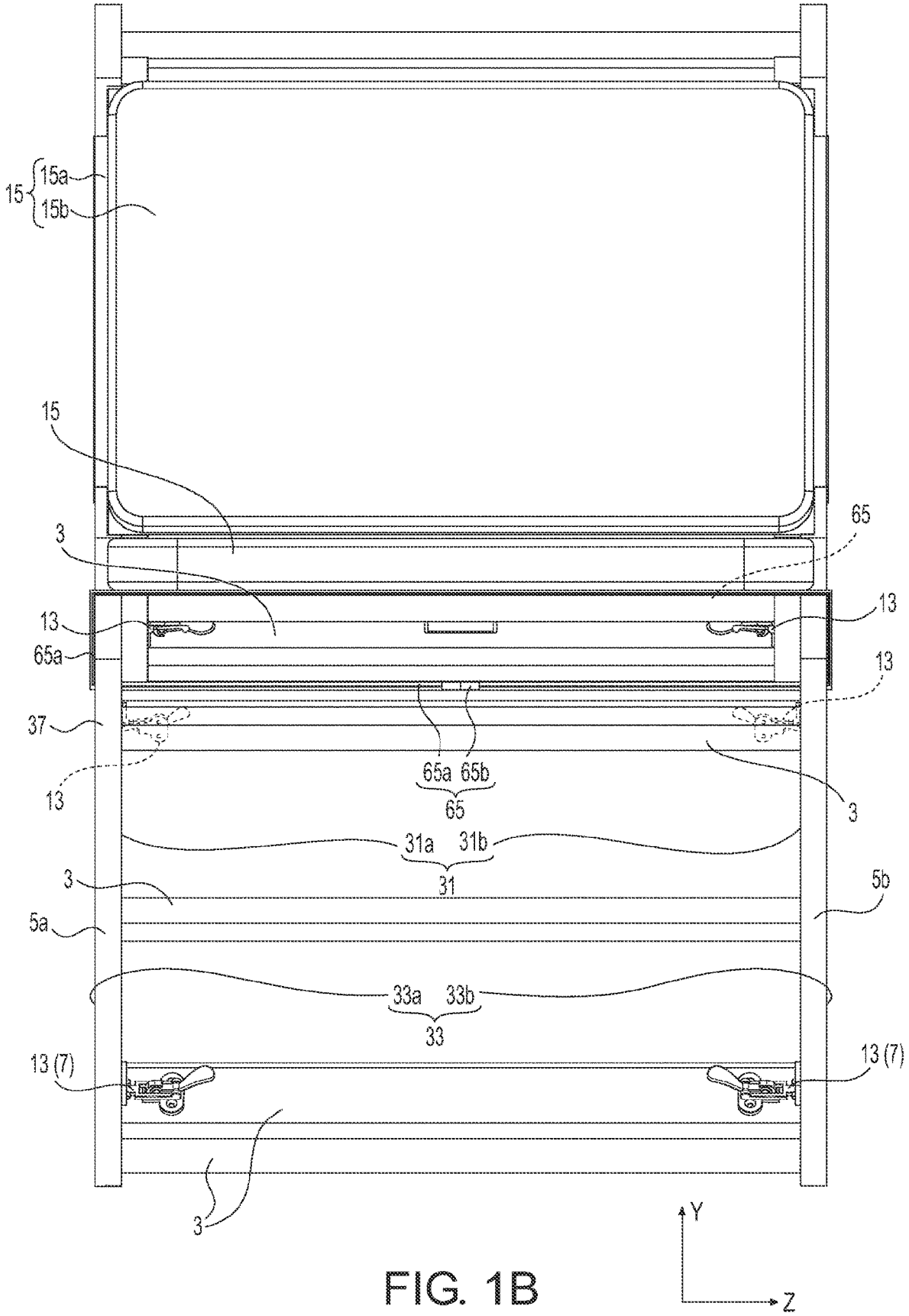
FIG. 1B is another view of the first exemplary configuration.
Figure 1C:
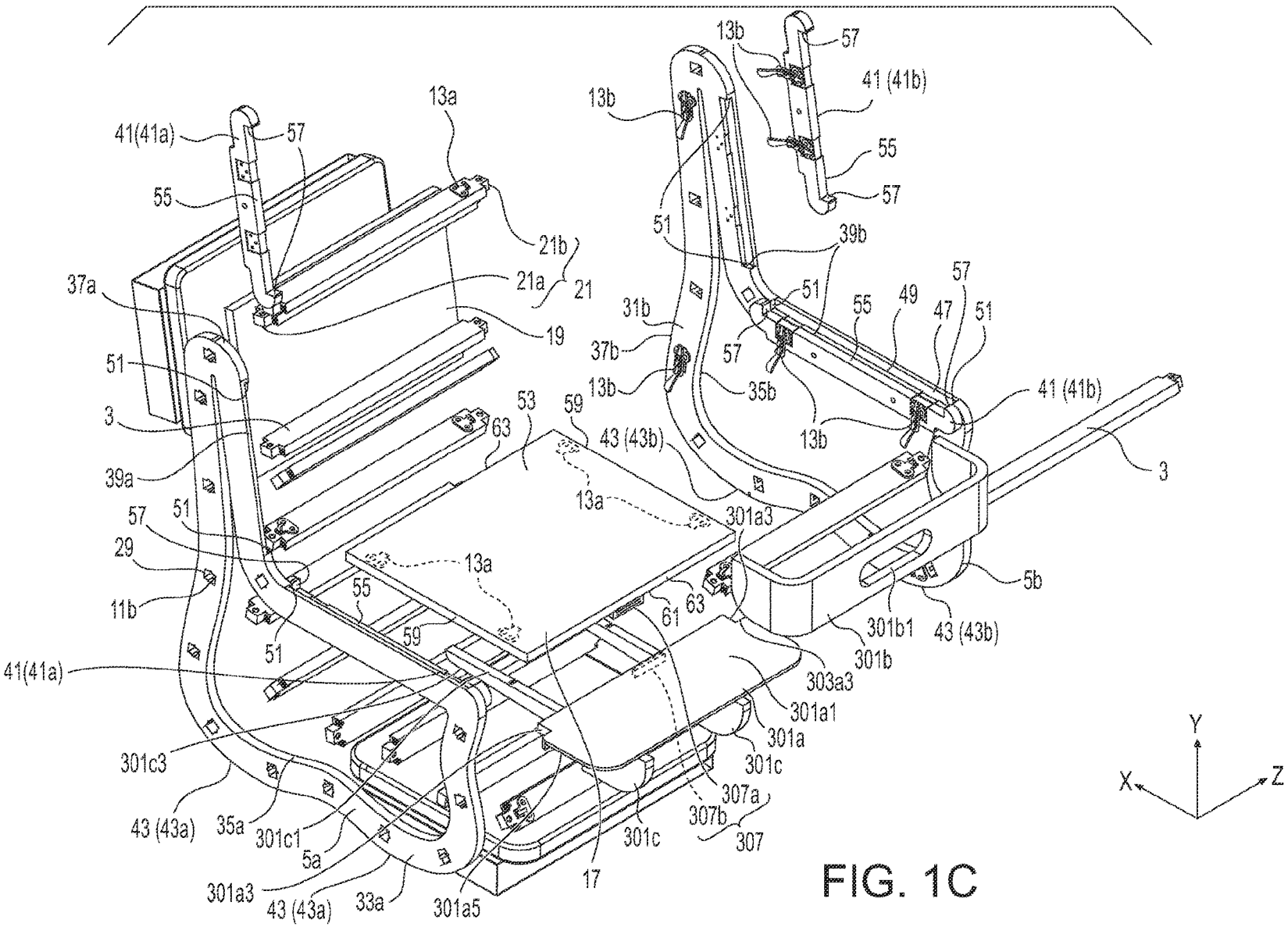
FIG. 1C is an exploded view of the first exemplary configuration.

A first configuration of the modular furniture system 100 will be described with reference to FIGS. 1A-4. A chair 1, as shown in FIGS. 1A-1C, is an example of the first configuration of the modular furniture system 100. The chair 1 includes slats 3, frame portions 5, coupling mechanisms 7, and removable supports 9. The coupling mechanisms 7 include one or more of ball and detent couplings 11, latches 13, and adjustable straps 65 which are described below. The removable supports 9 include a seat rest 17 and a back rest 19, which are described below. In addition, the chair 1 can optionally further include removable covers 15, which are described below.

As shown in FIGS. 1A-1C, the slats 3 of the chair 1 are configured to longitudinally extend from a first frame portion 5*a* to a second frame portion 5*b*. The slats 3 can be made of any combination of a broad array of materials appropriate for furniture including, e.g., plastic, metal, and wood. In the exemplary embodiment, the slats 3 are made of wood. Preferably, the slats 3 are made of Baltic birch. The slats 3 can also be made of other types of wood such as bamboo, oak, walnut, or plywood.

As shown in FIG. 1C-2C, each slat 3 of the chair 1 has distal ends 21, frame contact surfaces 25, and insertion portions 23. The distal ends 21 include a first distal end 21*a* disposed at an end of the slat 3 in the longitudinal direction of the slat 3. The distal ends 21 also include a second distal end 21*b* disposed at an opposite end of the slat 3 in the longitudinal direction from the first distal end 21*a*. In the exemplary embodiment, each distal end 21 is a surface that extends along a plane perpendicular to the longitudinal direction of each respective slat 3.

Figure 2A:
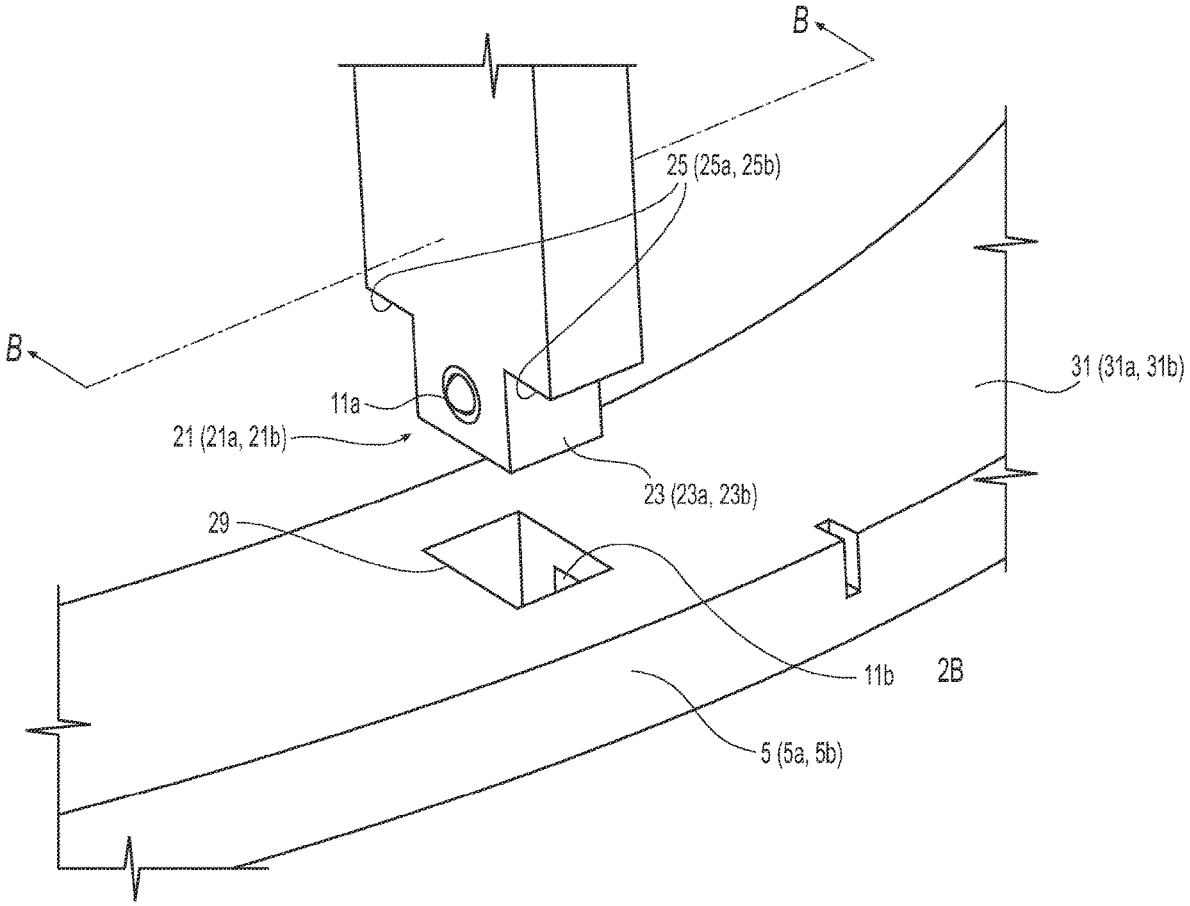
FIG. 2A is a view of a first type of a coupling mechanism.
Figure 2B:
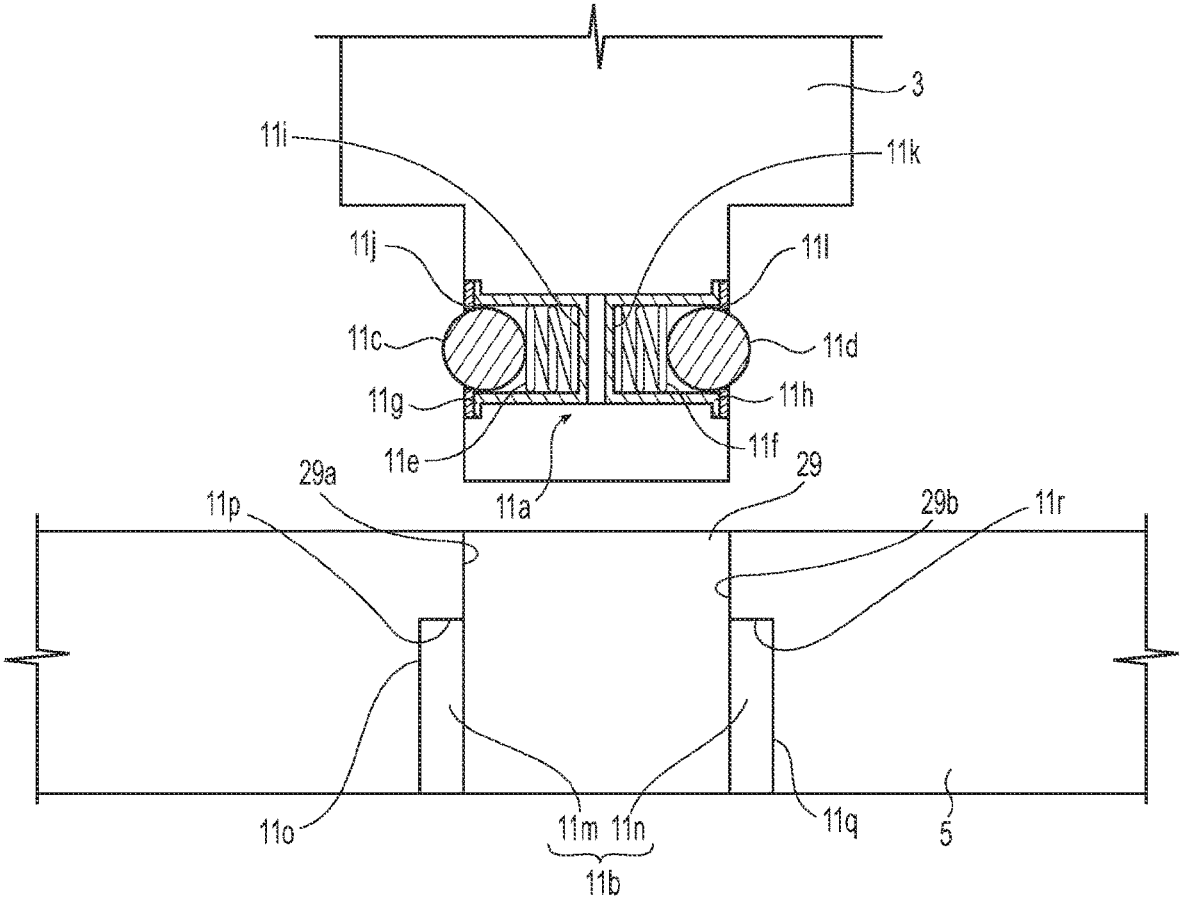
FIG. 2B is a cross-sectional view of a disengaged state of the first type of the coupling mechanism taken along line B-B in FIG. 2A.
Figure 2C:
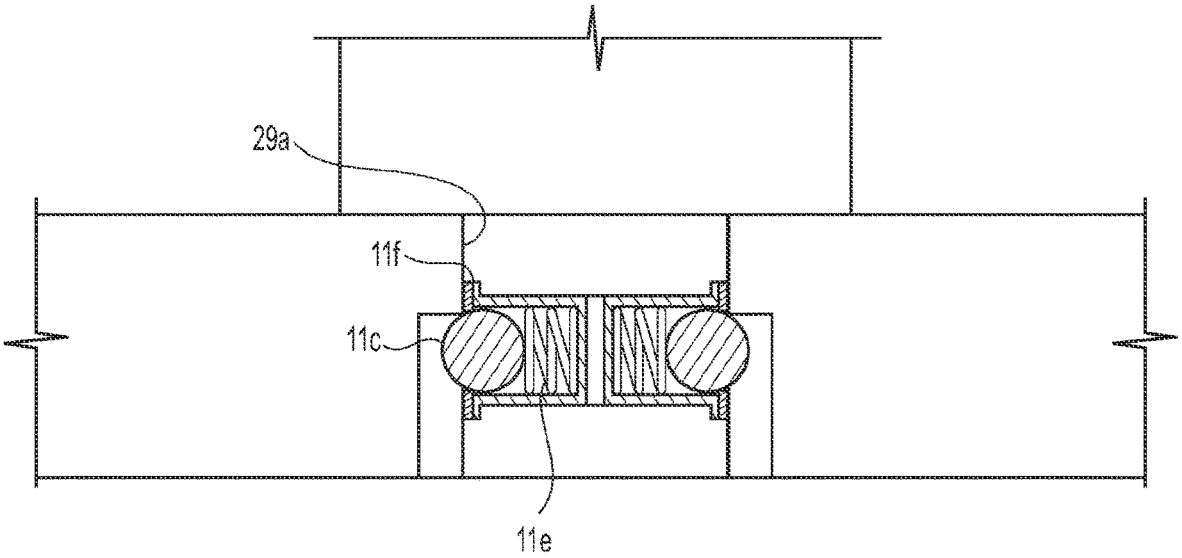
FIG. 2C is a cross-sectional view of an engaged state of the first type of the coupling mechanism taken along line B-B in FIG. 2A after engagement.

As shown in FIGS. 2A-2C, each of the distal ends 21 of the slats 3 is configured to fit through each of a plurality of recesses 29 of the first frame portion 5*a* and the second frame portion 5*b*. Thus, each distal end 21 can have any shape that can fit through the recesses 29 of the first frame portion 5*a* and the second frame portion 5*b*.

As shown in FIGS. 2A-2C, each of the insertion portions 23 of the slats 3 is configured to fit through each of the plurality of recesses 29 of the first frame portion 5*a* and the second frame portion 5*b*. Thus, each of the insertion portions 23 can have any shape that can fit through the recesses 29 of the first frame portion 5*a* and the second frame portion 5*b*. In the exemplary embodiment, the insertion portion 23 has a rectangular cross section, and each recess 29 has a complementary rectangular shape. Both the cross section of the insertion portion 23 and the shape of the recess 29 need not be rectangular, and can be any shape so long as the insertion portion 23 fits securely (i.e., with little to no relative play) into the shape of the recesses 29. Each of the insertion portions 23 extends in the longitudinal direction of the respective slat 3 from a respective frame contact surface 25 to a respective distal end 21. In the exemplary embodiment, each slat 3 includes a first insertion portion 23*a* on a first end of the slat 3 and a second insertion portion 23*b* on a second, opposite end of the slat 3. Each first insertion portion 23*a* is configured to fit through a respective one of the plurality of recesses 29 of the first frame portion 5*a*. Each second insertion portion 23*b* is configured to fit through a respective one of the plurality of recesses 29 of the second frame portion 5*b*.

As shown in FIGS. 2A-2C, each of the slats 3 includes frame contact surfaces 25. The frame contact surfaces 25 of the exemplary embodiment extend along a plane perpendicular to the longitudinal direction of the respective slat 3 (i.e., a plane parallel to the plane along which the distal end 21 extends). The frame contact surfaces 25 of each slat 3 include a first frame contact surface 25*a* and a second frame contact surface 25*b*. In the exemplary embodiment, the first frame contact surface 25*a* extends away from the first insertion portion 23*a* on opposite sides of the first insertion portion 23*a*, and the second frame contact surface 25*b* extends away from the second insertion portion 23*b* on opposite sides of the second insertion portion 23*b*. When the chair 1 is in an assembled state, the first frame contact surface 25*a* of each slat 3 contacts an inner surface 31*a* of the first frame portion 5*a*. Similarly, when the chair 1 is in the assembled state, the second frame contact surface 25*b* of each slat 3 contacts an inner surface 31*b* of the second frame portion 5*b*. The frame contact surfaces 25 limit an insertion depth of each slat 3 into each respective recess 29. In the exemplary embodiment, the insertion depth of each slat 3 into each respective recess 29 is equal to a thickness of each of the frame portions 5 in the longitudinal direction of each slat 3 when the chair 1 is in the assembled state. Alternatively, the insertion depth of each slat 3 into each respective recess 29 can be greater than or less than the thickness of the frame portions 5. In addition, when the chair 1 is in the assembled state, the frame contact surfaces 25 provide support to stabilize the chair 1. Thus, although the frame contact surfaces 25 extend perpendicularly from opposite sides of each respective insertion portion 23 in the exemplary embodiment, the frame contact surfaces 25 can be arranged to extend in any direction from the slat 3 and have any shape so long as the frame contact surfaces 25 limit the insertion depth of each slat 3 into each respective recess 29, and contact respective inner surfaces 31*a* and 31*b*.

The frame portions 5 of the chair 1 can be made of any combination of a broad array of materials appropriate for furniture such as plastic, metal, and wood. In the exemplary embodiment, the frame portions 5 are made of wood. Preferably, the frame portions 5 are made of Baltic birch. The frame portions 5 can also be made of other types of wood such as bamboo, oak, walnut, or plywood.

The frame portions 5 define the overall shape of the chair 1. Returning to FIGS. 1A-1C, each frame portion 5 of the chair 1 includes the recesses 29, the inner surface 31, an outer surface 33, an inner circumferential face 35, an outer circumferential face 37, cutouts 39, flanges 41, and feet 43. For example, the first frame portion 5*a* includes the inner surface 31*a*, an outer surface 33*a*, an inner circumferential face 35*a*, an outer circumferential face 37*a*, a pair of cutouts 39*a*, a pair of flanges 41*a*, and a pair of feet 43*a*. For example, the second frame portion 5*b* includes the inner surface 31*a*, an outer surface 33*b*, an inner circumferential face 35*b*, an outer circumferential face 37*b*, a pair of cutouts 39*b*, a pair of flanges 41*b*, and a pair of feet 43*b*.

The inner surface 31 of each frame portion 5 extends along a plane that is perpendicular to the longitudinal direction of the slats 3 when the chair 1 is in the assembled state as shown in FIG. 1B. The outer surface 33 of each frame portion 5 extends along a plane parallel to the inner surface 31 of each respective frame portion 5. For example, in the exemplary embodiment, the inner surface 31*a* and the outer surface 33*a* of the first frame portion 5*a* extend along parallel planes. Similarly, in the exemplary embodiment, the inner surface 31*b* and the outer surface 33*b* of the second frame portion 5*b* extend along parallel planes. In the exemplary embodiment, each of the inner surfaces 31*a* and 31*b* and each of the outer surfaces 33*a* and 33*b* are flat. Alternatively, each of the inner surfaces 31*a* and 31*b* can be contoured. Furthermore, in the exemplary embodiment, when the chair 1 is in the assembled state, the inner surface 31*a* of the first frame portion 5*a* faces the inner surface 31*b* of the second frame portion 5*b* along the longitudinal direction of the slats 3.

As shown in FIGS. 1A-1C, the inner circumferential face 35 of each frame portion 5 extends from the inner surface 31 to the outer surface 33 of the each respective frame portion 5, and defines a through hole in each respective frame portion 5. The outer circumferential face 37 of each frame portion 5 extends from the inner surface 31 to the outer surface 33 of each respective frame portion 5, and faces away from the through hole defined by the inner circumferential face 35 of each respective frame portion 5. For example, the inner circumferential face 35*a* and the outer circumferential face 37*a* of the first frame portion 5*a* extend from the inner surface 31*a* to the outer surface 33*a* of the first frame portion 5*a*. Similarly, in the exemplary embodiment, the inner circumferential face 35*b* and the outer circumferential face 37*b* of the second frame portion 5*b* extend from the inner surface 31*b* to the outer surface 33*b* of the second frame portion 5*b*. Also, in the exemplary embodiment, the inner circumferential faces 35*a* and 35*b*, and the outer circumferential faces 37*a* and 37*b*, are flat when viewed along the longitudinal direction of the slats 3 when the chair 1 is in the assembled state. Alternatively, the inner circumferential faces 35*a* and 35*b*, and the outer circumferential faces 37*a* and 37*b*, can be contoured when viewed along the longitudinal direction of the slats 3 when the chair 1 is in the assembled state.

As shown in FIG. 1C the cutouts 39*a* and 39*b* are surfaces formed in the outer circumferential faces 37*a* and 37*b* by cutting out portions of respective inner surfaces 31*a* and 31*b* of the first frame portion 5*a* and second frame portion 5*b*. The cutouts 39 are located at positions where the supports 9 (e.g., the seat rest 17 and the back rest 19) will be located when the chair 1 is in the assembled state as shown in FIG. 1A according to the exemplary embodiment. Each cutout 39 includes a lateral support surface 47, a primary support surface 49, and a pair of secondary support surfaces 51. The lateral support surface 47 of each cutout 39 of each frame portion 5 faces in a direction parallel to the direction in which the inner surface 31 of the respective frame portion 5 faces. When the chair 1 is in the assembled state, the lateral support surfaces 47 abut the removable supports 9 and prevent the removable supports 9 from shifting in a direction parallel to the longitudinal direction of the slats 3 (i.e., the direction parallel to the direction in which the inner surface 31 of the respective frame portion 5 faces).

The primary support surface 49 of each cutout 39 of each frame portion 5 faces in a direction perpendicular to the direction in which the lateral support surface 47 of the respective cutout 39 faces. When the chair 1 is in the assembled state, each of the primary support surfaces 49 abuts a corresponding one of the removable supports 9, and supports the corresponding one of the removable supports 9 when a primary force is applied to a support surface 53 of the corresponding one of the removable supports 9. For example, according to the exemplary embodiment shown in FIGS. 1A and 1B, when an object or a user is at rest on the support surface 53 (e.g., applying a primary force) of the seat rest 17 (e.g., a removable support 9) when the chair 1 is in the assembled state, the primary support surfaces 49 of each of the frame portions 5*a* and 5*b* abutting the seat rest 17 support the seat rest 17 to prevent it from falling.

Further, the secondary support surfaces 51 of each cutout 39 face in opposite directions and towards each other. The directions in which the secondary support surfaces 51 of each cutout 39 face are perpendicular to both the direction in which the lateral support surface 47 of the respective cutout 39 faces, and the direction in which the primary support surface 49 of the respective cutout 39 faces. The secondary support surfaces 51 of the cutouts 39 abut respective removable supports 9 when the chair 1 is in the assembled state, and prevent the respective removable supports 9 from shifting. Furthermore, the combination of the lateral support surfaces 47, the primary support surfaces 49, and the secondary support surfaces 51 help guide a user to place the removable supports 9 during assembly, thereby making assembly simpler and faster. Alternatively, the cutouts 39 can be arranged having support surfaces of different shapes and disposed at different relative angles so long as the cutouts 39 can support the removable supports 9 when the chair 1 is in the assembled state, and help guide a user to place the removable supports 9 during assembly of the chair 1.

As shown in FIG. 1C, in the exemplary embodiment, each frame portion 5 of the chair 1 includes two flanges 41. Each of the flanges 41 of each frame portion 5 is fixed to the respective frame portion 5 at a position corresponding to each of the cutouts 39. In the exemplary embodiment, each of the flanges 41 is fixed to a respective frame portion 5 before provision of the respective frame portion 5 to the user (i.e., fixing the flanges 41 is not part of the assembly required by the user). The flanges 41 can be fixed to the inner surfaces 31 of the respective frame portions 5 by fasteners (e.g., screws, nails, clips, staples, etc.) or by adhesives. Alternatively, the flanges 41 can be formed integrally as a part of the respective frame portions 5.

As shown in FIG. 1C, each flange 41 includes a primary support surface 55 and two secondary support surfaces 57. The primary support surface 55 of each flange 41 is coplanar with the primary support surface 49 of a respective cutout 39. When the chair 1 is in the assembled state, each of the primary support surfaces 55 abuts a respective removable support 9, and supports the respective removable support 9 when the primary force is applied to the support surface 53 of the respective removable support 9. Similarly, the secondary support surfaces 57 of each flange 41 are coplanar with respective ones of the secondary support surfaces 51 of the respective cutout 39. The secondary support surfaces 57 of the flanges 41 abut the corresponding ones of the removable supports 9 when the chair 1 is in the assembled state, and prevent the respective removable supports 9 from shifting. Furthermore, the combination of the primary support surfaces 55 and the secondary support surfaces 57 helps guide the user to place the removable supports 9 during assembly of the chair 1, thereby making assembly of the chair 1 simpler and faster. The flanges 41 can alternatively be arranged to have support surfaces that have different shapes and are disposed at different relative angles than the primary support surfaces 55 and the secondary support surfaces 57, so long as the support surfaces of the flanges 41 can support the removable supports 9 when the chair 1 is in the assembled state, and help guide a user to place the removable supports 9 during assembly of the chair 1.

As shown in FIG. 1C, the chair 1 of the exemplary embodiment includes two removable supports 9; the seat rest 17 and back rest 19. The removable supports 9 can be made of any combination of a broad array of materials appropriate for furniture such as plastic, metal, and wood. In the exemplary embodiment, the removable supports 9 are made of wood. Preferably, the removable supports 9 are made of Baltic birch. The removable supports 9 can also be made of other types of wood such as bamboo, oak, walnut, or plywood.

In the exemplary embodiment, each of the removable supports 9 abuts the first frame portion 5*a* and abuts the second frame portion 5*b* when the chair 1 is in the assembled state. Each of the removable supports 9 includes the support surface 53, laterally supported surfaces 59, a primary supported surface 61, and secondary supported surfaces 63. The support surface 53 faces in a direction of an expected load. For example, the support surface 53 of the seat rest 17 is a seating surface that can receive the weight of an object placed on the chair 1 and the weight of a person (user) sitting on the chair 1. In other words, in use, the support surface 53 faces in a direction towards the object placed on the chair 1 or the person sitting on the chair 1.

Each of the removable supports 9 includes a pair of laterally supported surfaces 59. The laterally supported surfaces 59 face in opposite directions, each of the opposite directions being perpendicular to the direction in which the support surface 53 faces. A first one of the pair of laterally supported surfaces 59 of each removable support 9 abuts the lateral support surface 47 of a respective cutout 39*a* of the first frame portion 5*a* when the chair 1 is in the assembled state. A second one of the pair of the laterally supported surfaces 59 of each removable support 9 abuts the lateral support surface 47 of a respective cutout 39*b* of the second frame portion 5*b* when the chair 1 is in the assembled state. For example, a first one of the pair of laterally supported surfaces 59 of the seat rest 17 abuts a lateral support surface 47 of the lower one of the cutouts 39*a* of the first frame portion 5*a* (i.e., the cutout 39*a* engaging the seat rest 17), and a second one of the pair of laterally supported surfaces 59 of the seat rest 17 abuts a lateral support surface 47 of the lower one of the cutouts 39*b* of the second frame portion 5*b* (i.e., the cutout 39*b* engaging the seat rest 17) when the chair 1 is in an assembled state.

The primary supported surface 61 of each removable support 9 is disposed on an opposite side of the removable support 9 from the support surface 53 of the respective removable support 9. The primary supported surface 61 of each removable support 9 abuts the primary support surface 49 of a respective cutout 39*a* of the first frame portion 5*a* and the primary support surface 55 of a respective flange 41 of the first frame portion 5*a* when the chair 1 is in the assembled state. The primary supported surface 61 also abuts the primary support surface 49 of a respective cutout 39*b* of the second frame portion 5*b* and the primary support surface 55 of a respective flange 41 of the second frame portion 5*b* when the chair 1 is in the assembled state. For example, the primary supported surface 61 of the seat rest 17 abuts the primary support surface 49 of a lower one of the cutouts 39*a* of the first frame portion 5*a*, the primary support surface 55 of a lower one of the flanges 41*a* of the first frame portion 5*a*, the primary support surface 49 of a lower one of the cutouts 39*b* of the second frame portion 5*b*, (iv) the primary support surface 55 of a lower one of the flanges 41*b* of the second frame portion 5*b*, when the chair 1 is in the assembled state.

Each of the removable supports 9 includes a pair of secondary supported surfaces 63. Each of the pair of the secondary supported surfaces 63 face in opposite directions, each of the opposite directions being perpendicular to the direction in which the support surface 53 faces and to the directions in which the laterally supported surfaces 59 of the respective removable support 9 face. A first one of the pair of secondary supported surfaces 63 of each removable support 9 abuts a respective secondary support surface 51 of a respective cutout 39*a* of the first frame portion 5*a*, a secondary support surface 57 of a respective flange 41*a* of the first frame portion 5*a*, a respective secondary support surface 51 of a respective cutout 39*b* of the second frame portion 5*b*, and a secondary support surface 57 of a respective flange 41*b* of the second frame portion 5*b*, when the chair 1 is in the assembled state. A second one of the pair of secondary supported surfaces 63 of each removable support 9 abuts a respective secondary support surface 51 of the respective cutout 39*a* of the first frame portion 5*a*, a secondary support surface 57 of the respective flange 41*a* of the first frame portion 5*a*, a respective secondary support surface 51 of the respective cutout 39*b* of the second frame portion 5*b*, and a secondary support surface 57 of the respective flange 41*b* of the second frame portion 5*b*, when the chair 1 is in the assembled state.

In the exemplary embodiment, each of the removable supports 9 has a rectangular cuboid shape defined, respectively, by the support surface 53, the laterally supported surfaces 59, the primary supported surface 61, and the secondary supported surfaces 63. This shape is complementary to the shapes of the respective cutouts 39 and the respective flanges 41 of the frame portions 5 when the chair 1 is in the assembled state. This complementary arrangement of the surfaces of the removable supports 9 and the frame portions 5 provides for a stable interface between the removable supports 9 and the frame portions 5 when the chair 1 is in the assembled state. In addition, the complementary arrangement of the surfaces of the removable supports 9 and the frame portions 5 helps guide the user to position the removable supports 9 during assembly of the chair 1. Thus, the removable supports 9 can alternatively have different shapes, for example a circular disc shape or a hexagonal prism shape, so long as the shape of the removable supports 9 is complementary to surfaces of the cutouts 39 and flanges 41 of the frame portions 5, provides for a stable interface between the removable supports 9 and the frame portions 5 when the chair 1 is in the assembled state, and helps the user locate the positions of the removable supports 9 during assembly of the chair 1.

As shown in FIGS. 1A-1C, the chair 1 includes several different types of coupling mechanisms 7 which include the ball and detent couplings 11, the latches 13, and adjustable straps 65. The coupling mechanisms 7 couple the slats 3 to the first frame portion 5*a* and to the second frame portion 5*b*. The coupling mechanisms 7 also couple the removable supports 9 to the first frame portion 5*a* and to the second frame portion 5*b*. The chair 1 need not include all three of the above types of coupling mechanisms 7, and only requires at least one type of the coupling mechanisms 7 to be present. Examples of the coupling mechanisms 7 are described below.

The ball and detent couplings 11 are an example of a first type of the coupling mechanisms 7. As shown in FIGS. 2A-2C, each of the ball and detent couplings 11 includes a ball portion 11*a* and a detent portion 11*b*. The ball portion 11*a* can be made of any combination of a broad array of appropriate materials such as plastic, metal, and wood. In the exemplary embodiment, the ball portion 11*a* is made of metal. FIG. 2B is a cross-sectional view of a disengaged state of a ball and detent coupling 11 taken along line B-B in FIG. 2A. As shown in FIG. 2B, each ball portion 11*a* is disposed in a respective slat 3, and includes a first ball 11*c*, a second ball 11*d*, a first spring 11*e*, a second spring 11*f*, a first retainer cup 11*g*, and a second retainer cup 11*h*. The first ball 11*c* and the second ball 11*d* are examples of restrictors.

The first ball 11*c* is disposed inside of the first retainer cup 11*g*, and is biased in a first biasing direction perpendicular to the longitudinal direction of the respective slat 3 by the first spring 11*e*. The first retainer cup 11*g* includes a first spring surface 11*i* and a first circumferential retaining surface 11*j*. The first spring surface 11*i* faces in the first biasing direction, and abuts a first end of the first spring 11*e*. A second end of the first spring 11*e* abuts the first ball 11*c*, and biases the first ball 11*c* in the first biasing direction, towards the first circumferential retaining surface 11*j*. The first circumferential retaining surface 11*j* defines a through hole having a diameter that is smaller than a diameter of the first ball 11*c*. At rest, the first ball 11*c* protrudes through the through hole defined by the first circumferential retaining surface 11*j*, and protrudes farther in the first biasing direction than a first face of the respective slat 3 that faces in the first biasing direction. The first circumferential retaining surface 11*j* also limits a distance in which the first ball 11*c* can be biased in the first biasing direction by the first spring 11*e*.

The second ball 11*d* is disposed inside of the second retainer cup 11*h* and is biased in a second biasing direction perpendicular to the longitudinal direction of the respective slat 3 by the second spring 11*f*. In the exemplary embodiment, the second biasing direction is a direction opposite and parallel to the first biasing direction. The second retainer cup 11*h* includes a second spring surface 11*k*, and a second circumferential retaining surface 11*l*. The second spring surface 11*k* faces in the second biasing direction, and abuts a first end of the second spring 11*f*. A second end of the second spring 11*f* abuts the second ball 11*d*, and biases the second ball 11*d* in the second biasing direction, towards the second circumferential retaining surface 11*l*. The second circumferential retaining surface 11*l* defines a through hole having a diameter that is smaller than a diameter of the second ball 11*d*. At rest, the second ball 11*d* protrudes through the through hole defined by the second circumferential retaining surface 11*l*, and protrudes farther in the second biasing direction than a second face of the respective slat 3 that faces in the second biasing direction. The second circumferential retaining surface 11*l* also limits a distance in which the second ball 11*d* can be biased in the second biasing direction by the second spring 11*f*.

As shown in FIG. 2B, the detent portion 11*b* includes a first detent 11*m* and a second detent 11*n*. The first detent 11*m* is formed in a first recess wall 29*a* of a respective frame portion 5. The first recess wall 29*a* of the respective frame portion 5 faces the insertion portion 23 of a respective slat 3, and abuts the insertion portion 23 of the respective slat 3, when the chair 1 is in an assembled state. The first detent 11*m* includes a first outer wall 11*o* and a first capture wall 11*p*. The first outer wall 11*o* is disposed farther than the first recess wall 29*a* in the first biasing direction from the insertion portion 23 of the respective slat 3 when the chair 1 is in the assembled state. The second detent 11*n* includes a second outer wall 11*q* and a second capture wall 11*r*. The second outer wall 11*q* is disposed farther than the second recess wall 29*b* in the second biasing direction from the insertion portion 23 of the respective slat 3 when the chair 1 is in the assembled state.

As shown in FIGS. 2B and 2C, the insertion portion 23 of the respective slat 3 is inserted into the recess 29 of the respective frame portion 5 during assembly of the chair 1. While the insertion portion 23 of the respective slat 3 is being pushed into the recess 29 by the user, the first ball 11*c* and the second ball 11*d* retract upon contacting the inner surface 31*b* and the first and second recess walls 29*a* and 29*b*, compressing the first spring 11*e* and the second spring 11*f*, so that the insertion portion 23 of the respective slat 3 fits into the recess 29 of the respective frame portion 5. FIG. 2C is a cross-sectional view of an engaged state of the ball and detent coupling 11 taken along line B-B in FIG. 2A after engagement. Once the respective slat 3 is fully inserted into the recess 29 of the respective frame portion 5, as shown in FIG. 2C, the first ball 11*c* fits into and is disposed inside of the first detent 11*m* so as to abut the first capture wall 11*p*, and the second ball 11*d* fits into and is disposed inside of the second detent 11*n* so as to abut the second capture wall 11*r*. This arrangement of the ball and detent couplings 11 removably couples each respective slat 3 to each respective frame portion 5 and restricts movement of the slat 3 in the longitudinal direction of the slat 3 with respect to the respective frame portion 5. In other words, the ball and detent couplings 11 are configured to couple parts of the chair 1 such that the respective slats 3 can be easily coupled to the respective frame portions 5 by the user without using any tools, and such that the respective slats 3 can be easily released from the respective frame portions 5 by the user without using any tools.

The ball and detent couplings 11 can be provided for each insertion portion 23 of each slat 3, can be replaced by a different one of the types of the coupling mechanisms 7 described herein, and can be used in a combination with any combination of the other types of coupling mechanisms 7 described herein. Also, in an alternative configuration of the ball and detent couplings 11, the ball portions 11*a* can be disposed in the recesses 29 of the frame portions 5, and the detent portions 11*b* can be disposed in the insertion portions 23 of the slats 3. Further, the ball portions 11*a* and the detent portions 11*b* are fixed to and formed in the slats 3 and the frame portions 5 of the chair 1, respectively, before provision of the slats 3 and the frame portions 5 of the chair 1 to the user.

Figure 3A:
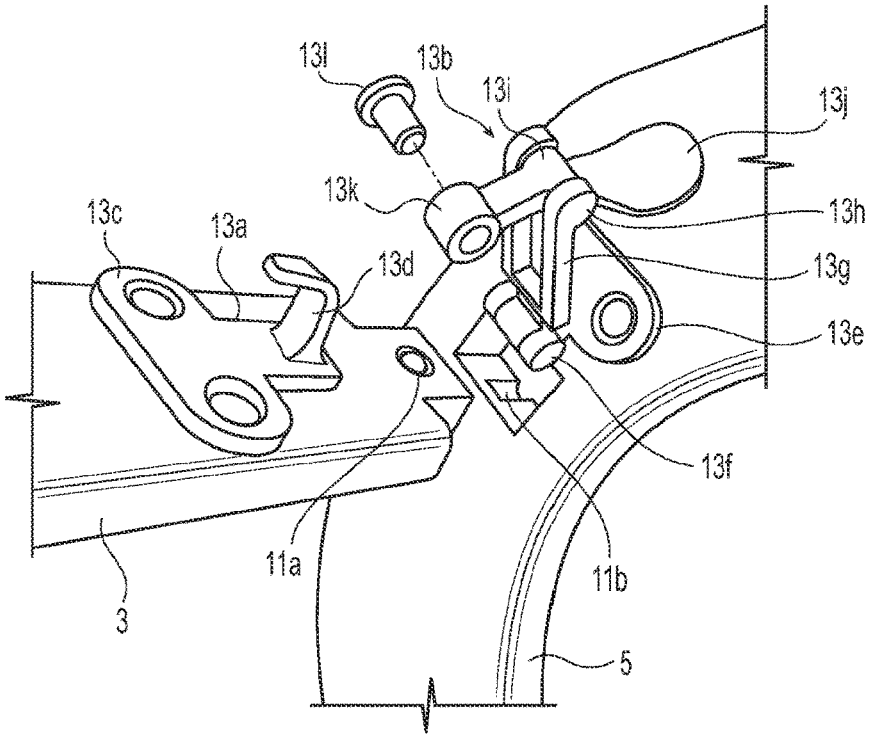
FIG. 3A is view of a disengaged state of a second type of the coupling mechanism.
Figure 3B:
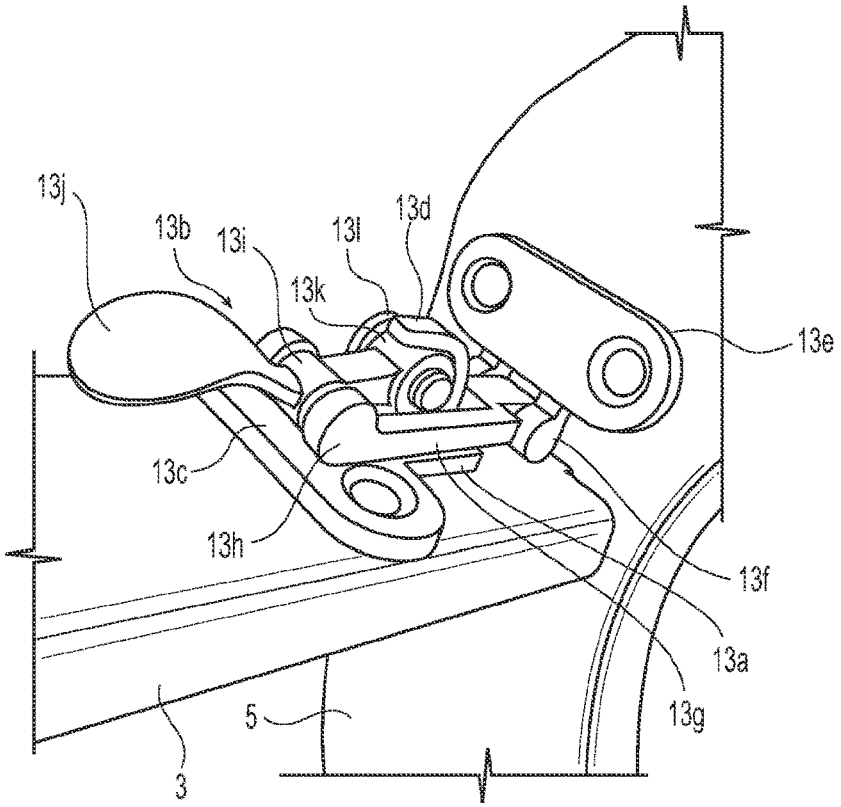
FIG. 3B is a view of an engaged state of the second type of the coupling mechanism.

The latches 13 are an example of a second type of the coupling mechanisms 7. The latches 13 can be made of any combination of a broad array of materials appropriate for latches such as plastic, metal, and wood. In the exemplary embodiment, the latches 13 are made of metal. As shown in FIGS. 3A and 3B, each of the latches 13 includes an anchor portion 13*a* and a locking portion 13*b*. Each anchor portion 13*a* is fixed to a longitudinal surface of a respective slat 3. The anchor portion 13*a* includes a base 13*c* and a hook 13*d*. Each base 13*c* abuts the longitudinal surface of the respective slat 3, and is fixed to the longitudinal surface of the respective slat 3. Each base 13*c* can be fixed to the longitudinal surface by, for example, fasteners (e.g., screws, nails, clips, staples, etc.) or adhesives. The hook 13*d* is integrally formed with the base 13*c*, and protrudes from the base 13*c*.

As shown in FIGS. 3A and 3B, each locking portion 13*b* includes a base 13*e*, a first hinge 13*f*, a swing arm 13*g*, a second hinge 13*h*, and a locking arm 13*i*. Each base 13*e* is fixed to the inner surface 31 of a respective frame portion 5. Each base 13*e* can be fixed to the inner surface 31 of the respective frame portion 5 by fasteners (e.g., screws, nails, clips, staples, etc.) or by adhesives. Each first hinge 13*f* couples a respective base 13*e* to a respective swing arm 13*g*, and allows the respective swing arm 13*g* to rotate about a rotational axis of the respective first hinge 13*f* Each second hinge 13*h* couples a respective swing arm 13*g* to a respective locking arm 13*i*, and allows the respective locking arm to pivot about a rotational axis of the respective second hinge 13*h*. Each locking arm 13*i* includes a lever 13*j* and cam 13*k*. Each lever 13*j* is disposed on an opposite side of the respective locking arm 13*i* from the cam 13*k*, with the respective second hinge 13*h* interposing between each lever 13*j* and respective locking arm 13*i*.

As shown in FIGS. 3A and 3B, once the respective slat 3 has been inserted into the recess 29 of the respective frame portion 5 of the chair 1, the user manipulates the lever 13*j* of the locking portion 13*b* during assembly of the chair 1. For example, the user manipulates the lever 13*j* to rotate the locking arm 13*i* in a first rotational direction such that the respective cam 13*k* pulls the anchor portion 13*a* towards the locking portion 13*b*, and is ultimately disposed between the hook 13*d* and the base 13*c* of the anchor portion 13*a*. FIG. 3B shows the latch 13 in a closed state, in which the cam 13*k* is disposed between the hook 13*d* and the base 13*c* of the respective anchor portion 13*a*. In the closed state, the latch 13 couples the slat 3 to the frame portion 5 and generates tension between the anchor portion 13*a* and the locking portion 13*b* to thereby couple the slat 3 to the frame portion 5. The user manipulates the lever 13*j* in a second rotational direction to release the slat 3 from the frame portion 5. Thus, the latches 13 are configured to easily couple the slats 3 to respective frame portions 5 without using any tools, and to easily release the slats 3 from the respective frame portions 5 without using any tools.

The latches 13 can be provided for each insertion portion 23 of each slat 3, can be provided for a subset of the plurality of the slats 3, can be replaced by a different one of the types of the coupling mechanisms 7 described herein, and can be used in a combination with any combination of the other types of coupling mechanisms 7 described herein. For example, as shown in FIGS. 1C and 3A, one or more of the slats 3 is provided with both the latch 13 and the ball and detent coupling 11. When the latches 13 are provided for the subset of the plurality of the slats 3, the latches 13 can be provided for slats 3 that are nearest to the corners of the frame portions 5, and/or for a side of the frame portions 5 that is longer than another side of the frame portions 5. In addition, the latches 13 can be provided to couple the removable supports 9 to the flanges 41 of respective frame portions 5, as shown in FIGS. 1B and 1C. Also, in an alternative configuration of the latches 13, the anchor portions 13*a* can be fixed to the frame portions 5, and the locking portions 13*b* can be fixed to the slats 3. In another alternative configuration of the latches 13, the anchor portions 13*a* can be fixed to the frame portions 5, and the locking portions 13*b* can be fixed to the removable supports 9. Optionally, the latches 13 can further include a lock pin 13*l* that, when inserted into a through hole defined in a respective cam 13*k* while the latch 13 is in the closed state, prevents rotation of the locking arm 13*i* in the second rotational direction and thereby locks the respective latch 13. Furthermore, the anchor portions 13*a* and the locking portions 13*b* are fixed to the slats 3, the removable supports 9, and the frame portions 5 of the chair 1 before provision of the slats 3, the removable supports 9, and the frame portions 5 of the chair 1 to the user.

Figure 4A:
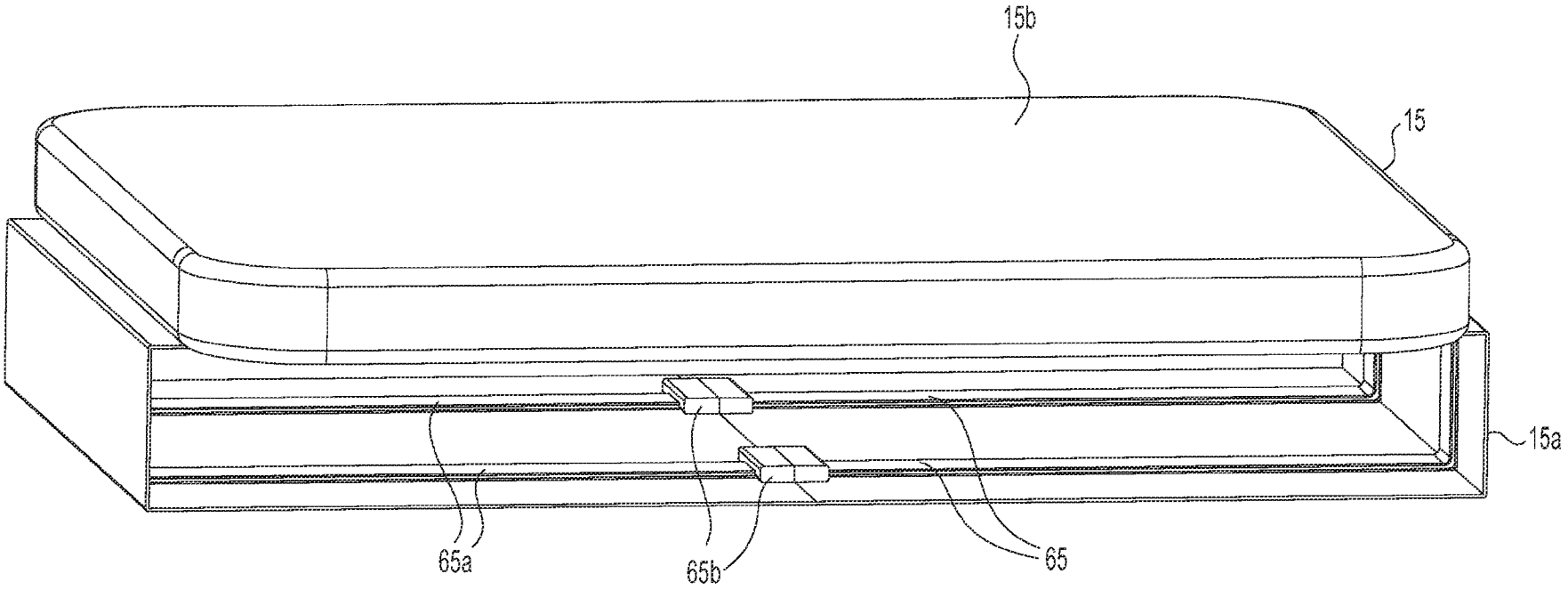
FIG. 4A is a view of a portion of the first exemplary configuration including a third type of the coupling mechanism.
Figure 4B:
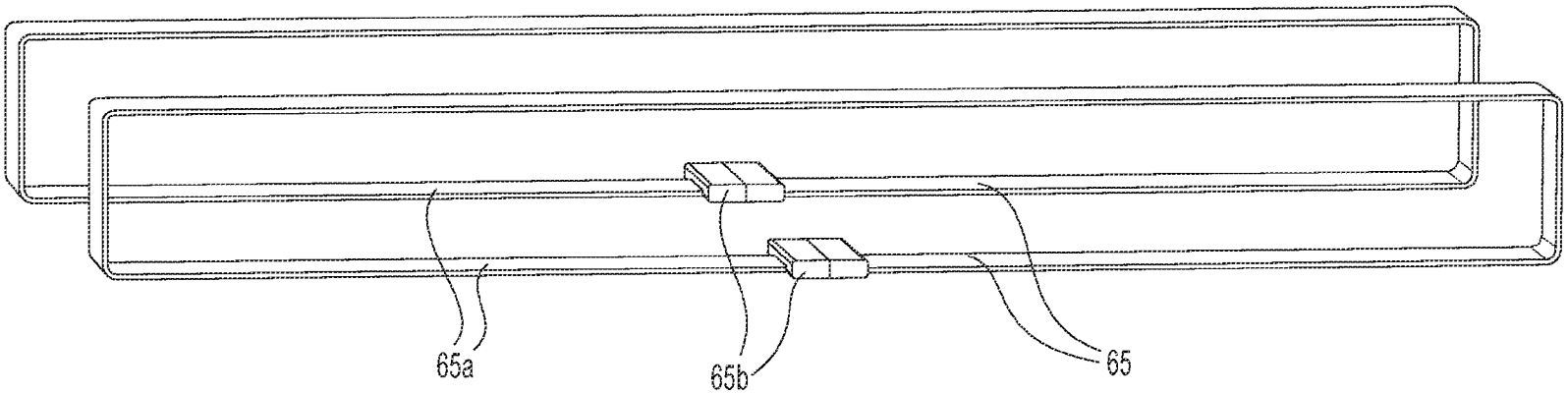
FIG. 4B is a second view of the third type of the coupling mechanism.

The adjustable straps 65 are an example of a third type of the coupling mechanisms 7. As shown in FIGS. 1B, 4A, and 4B, each of the adjustable straps 65 includes webbing 65*a* and a buckle 65*b*. The webbing 65*a* can be made of any combination of a broad array of appropriate materials for straps, such as nylon, plastic, and cotton. In the exemplary embodiment, the webbing 65*a* is made of flat nylon webbing. The buckle 65*b* of each adjustable strap 65 can be made of any combination of a broad array of appropriate materials for buckles, such as plastic, metal, and wood. In the exemplary embodiment, the buckle 65*b* is made of metal. As shown in FIG. 1B, the webbing 65*a* of each adjustable strap 65 encircles a section of the chair 1 such that the webbing abuts the inner circumferential face 35*a*, the outer surface 33*a*, the outer circumferential face 37*a*, the outer circumferential face 37*b*, the outer surface 33*b*, and the inner circumferential face 35*b*, when the chair 1 is in the assembled state.

The buckle 65*b* of each adjustable strap 65 is configured to adjust a longitudinal length of a portion of the webbing 65*a* encircling the section of the chair 1. By shortening the longitudinal length of the webbing 65*a* encircling the section of the chair 1 when the chair 1 is in the assembled state, the user can impart a compressive force that couples the slats 3 to both of the first frame portion 5*a* and the second frame portion 5*b*. The buckle 65*b* is also configured to both attach and detach a first portion of the length of the webbing 65*a* encircling the section of the chair 1 to a second portion of the length of the webbing 65*a* encircling the section of the chair 1, without the use of any tools. For example, when the buckles 65*b* of the adjustable straps 65 are in an open state (not shown), the user can wrap the adjustable straps 65 around surfaces of the chair 1 such that the webbing 65*a* of respective ones of the adjustable straps 65 abuts each of the inner circumferential face 35*a*, the outer surface 33*a*, the outer circumferential face 37*a*, the support surface 53 of a respective removable support 9, the outer circumferential face 37*b*, the outer surface 33*b*, and the inner circumferential face 35*b*. The user can then close the respective buckles 65*b* of respective ones of the adjustable straps 65, and tension the webbing 65*a* of respective ones of the adjustable straps 65 to achieve a closed state, as shown in FIG. 4B.

As shown in FIGS. 1B, 4A, and 4B, according to the exemplary embodiment, the adjustable straps 65 can be integrated into an inner circumferential surface of the removable covers 15. Each of the removable covers 15 includes a holding portion 15*a*, and can optionally include a cushion 15*b*. For example, a pair of the adjustable straps 65 can be attached to a holding portion 15*a* of each of the removable covers 15 via any combination of thread, fasteners, and adhesive. Each cushion 15*b* is configured to cover the support surface 53 of a respective removable support 9. For example, as shown in FIG. 1A, a first one of the removable covers 15 can be arranged such that the cushion 15*b* of the first one of the removable covers 15 covers the support surface 53 of the seat rest 17.

In the exemplary embodiment, two adjustable straps 65 are integrated into each of two removable covers 15. The adjustable straps 65 can be replaced by a different one of the types of the coupling mechanisms 7 described herein, and can be used in a combination with any combination of the other types of coupling mechanisms 7 described herein. Also, in an alternative configuration of the adjustable straps 65, each of the adjustable straps can be configured to be independent of any other of the adjustable straps 65 and to be independent of the any of the removable covers 15.

Figure 5A:
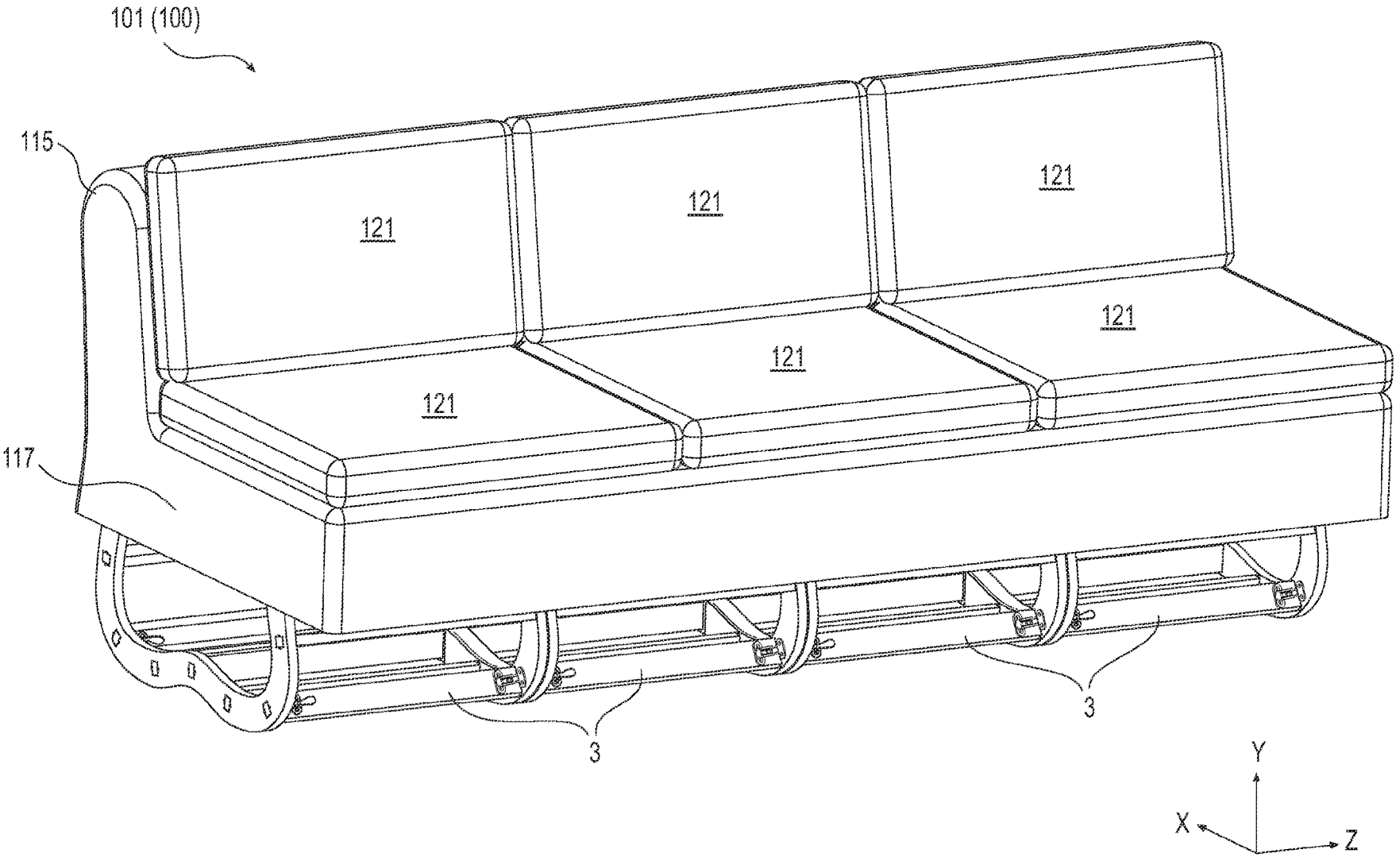
FIG. 5A is a view of a first modification of the first exemplary configuration.

The chair 1 can be easily assembled according to the following simple assembly process, without using any tools, as follows. First, the user can insert the first distal end 21*a* of each of the slats 3 into respective recesses 29 of the first frame portion 5*a* such that respective ball and detent couplings 11 are in a fully engaged state, as shown in FIG. 2C. Second, the user can then insert the second distal end 21*b* of each of the slats 3 into respective recesses 29 of the second frame portion 5*b* such that respective ball and detent couplings 11 are in the fully engaged state. Third, the user can place each of the removable supports 9 into respective cutouts 39. Fourth, the user can manipulate the lever 13*j* of each of the latches 13 such that each of the latches 13 are in a closed state (as shown in FIG. 3B), and optionally insert the lock pins 13*l* into the cams 13*k*. Fifth, the user can place the removable covers 15 on respective removable supports 9, close the buckles 65*b*, and tighten the adjustable straps 65 such that the chair 1 is in the assembled state, as shown in FIGS. 1A and 1B. The chair 1 can be dissembled in the opposite order. A modification to the first configuration of the modular furniture system 100 will be described with reference to FIGS. 5A-6C. A sofa 101, as shown in FIG. 5A, is an example of the modification to the first configuration of the modular furniture system 100 as described above with respect to the chair 1 and shown in FIGS. 1A-4. The sofa 101 includes a plurality of the chairs 1. Descriptions of the slats 3, the frame portions 5, the coupling mechanisms 7, and the removable supports 9 of the chair 1 described above apply to each of the plurality of chairs 1 of the sofa 101, and only the differences in these elements that apply to the modification will be described below. The sofa 101 can optionally further include a removable sofa cover 115.

Figure 5B:
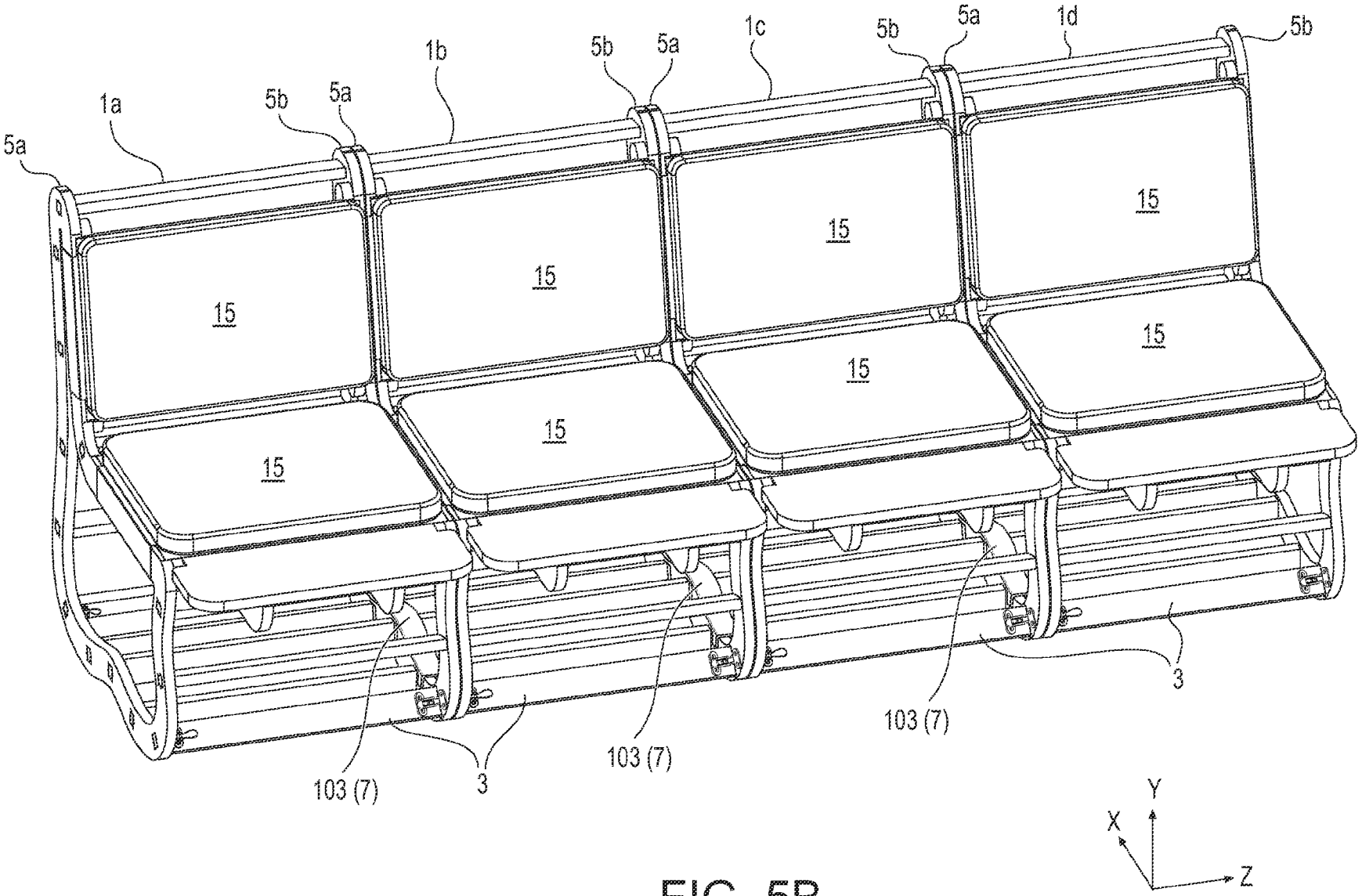
FIG. 5B is another view of the first modification of the first exemplary configuration.

As shown in FIGS. 5A and 5B, the exemplary embodiment of the sofa 101 includes four chairs 1: chair 1*a*, chair 1*b*, chair 1*c*, and chair 1*d*. As noted above, each of the chairs 1*a*-1*d* are configured as described above with respect to the chair 1. As shown in FIG. 5B, the chairs 1*a*-1*d* are arranged in-line and side-by-side such that the longitudinal directions of all of the slats 3 of the chairs 1*a*-1*d* are parallel. The removable sofa cover 115 is attached to the sofa 101 in FIG. 5A but is removed in FIG. 5B. For example, as shown in FIG. 5B, the entirety of the outer surface 33*b* of the chair 1*a* that is not covered by the removable cover 15 faces the entirety of the outer surface 33*a* of the chair 1*b* that is not covered by the removable cover 15, the entirety of the outer surface 33*b* of the chair 1*b* that is not covered by the removable cover 15 faces the entirety of the outer surface 33*a* of the chair 1*c* that is not covered by the removable cover 15, and the entirety of the outer surface 33*b* of the chair 1*c* that is not covered by the removable cover 15 faces the entirety of the outer surface 33*a* of the chair 1*d* that is not covered by the removable cover 15.

In addition, as shown in FIGS. 5A and 5B, the sofa 101 further includes connectors 103. The connectors 103 are an example of a fourth type of the coupling mechanisms 7. The connectors can be made of any combination of a broad array of materials such as plastic, metal, and wood. In the exemplary embodiment, the connectors 103 are made of plastic.

The connectors 103 couple pairs of the frame portions 5 of the chairs 1 forming the sofa 101. For example, as shown in FIG. 5B a first one of the connectors 103 couples the second frame portion 5*b* of the chair 1*a* (i.e., a second frame portion 5 of the sofa 101) to the first frame portion 5*a* of the chair 1*b* (i.e., a third frame portion 5 of the sofa 101), a second one of the connectors 103 couples the second frame portion 5*b* of the chair 1*b* (i.e., a fourth frame portion 5 of the sofa 101) to the first frame portion 5*a* of the chair 1*c* (i.e., a fifth frame portion 5 of the sofa 101), and a third one of the connectors 103 couples the second frame portion 5*b* of the chair 1*c* (i.e., a sixth frame portion 5 of the sofa 101) to the first frame portion 5*a* of the chair 1*d* (i.e., a seventh frame portion 5 of the sofa 101).

Figure 5D:
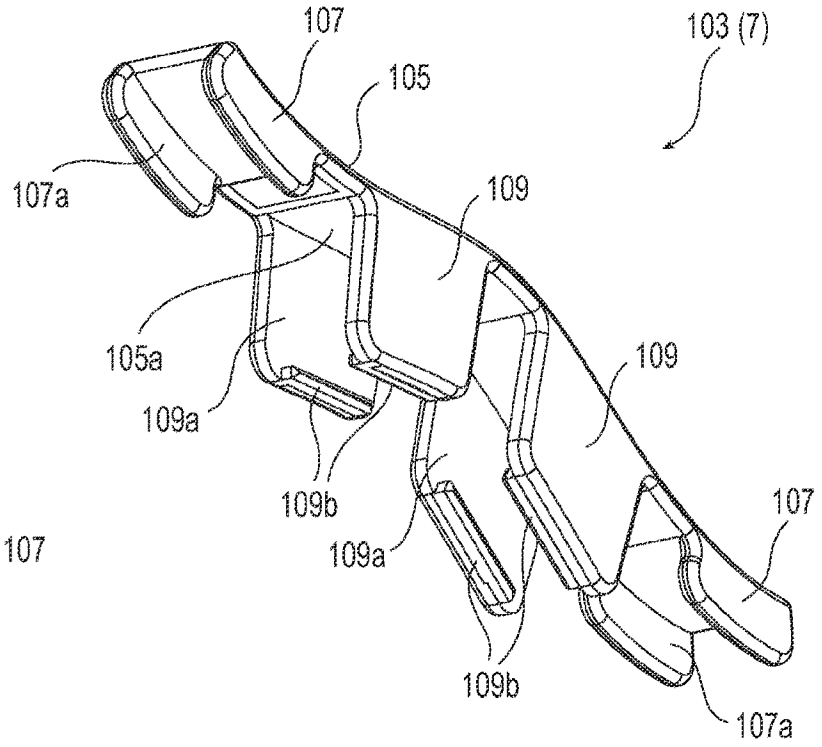
FIG. 5D is another view of the fourth type of the coupling mechanism.
Figure 5C:
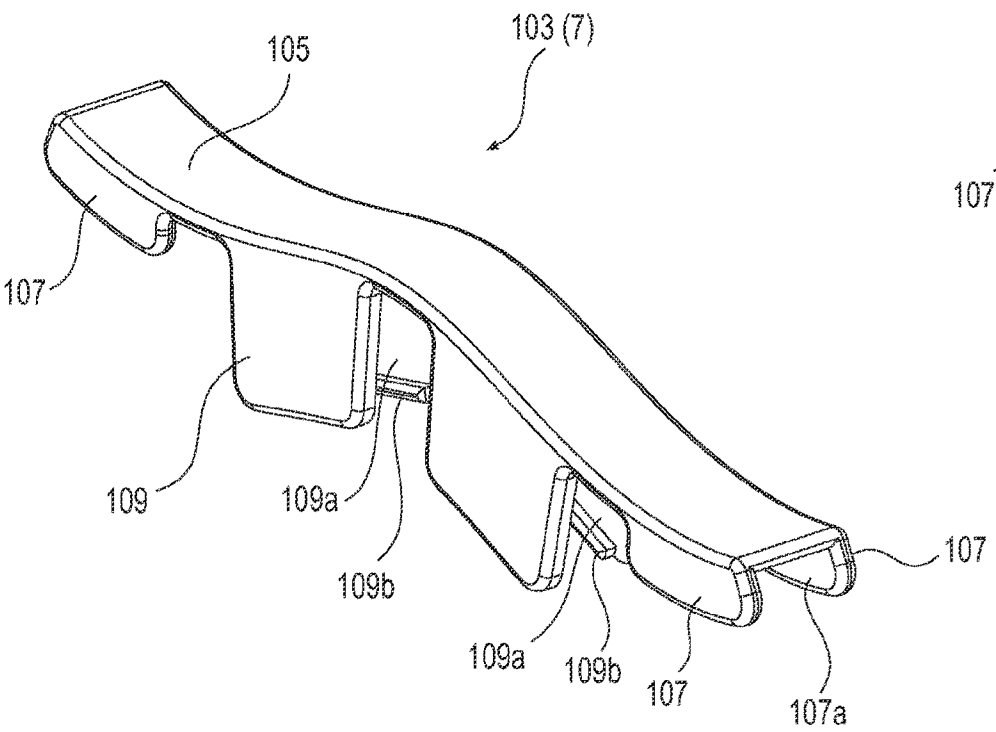
FIG. 5C is a view of a fourth type of the coupling mechanism.

As shown in FIGS. 5C and 5D, each of the connectors 103 includes a spine 105, end tabs 107, and holding tabs 109. The spine 105 of each connector 103 longitudinally extends in a direction parallel to a circumferential direction of the through holes of the frame portions 5 when the sofa 101 is in an assembled state. The spine 105 is disposed inside of the through holes of the frame portions 5 that are coupled by the corresponding connector 103 when the sofa 101 is in the assembled state. As shown in FIGS. 5A and 5B, the spine 105 of each connector 103 covers a portion of each of the inner circumferential face 35*b* of the chair 1*a* and the inner circumferential face 35*a* of the chair 1*b*. An interior surface 105*a* of each spine 105 is configured to continuously contact the inner circumferential faces 35 of the frame portions 5 that are coupled by the corresponding connector 103 when the sofa 101 is in the assembled state. For example, the spine 105 of the first one of the connectors 103 is disposed in the through holes defined by the inner circumferential face 35*b* of the chair 1*a* and the inner circumferential face 35*a* of the chair 1*b*, and the interior surface 105*a* continuously contacts the inner circumferential face 35*b* of the chair 1*a* and the inner circumferential face 35*a* of the chair 1*b*.

As shown in FIGS. 5C and 5D, each of the connectors 103 includes end tabs 107 that protrude from the longitudinal sides of the spine 105 at longitudinal ends of the connectors 103. Each of the end tabs 107 protrudes from the spine of a respective connector 103 in a direction perpendicular to the longitudinal direction of the respective connector 103. Each of the end tabs 107 includes a clamping surface 107*a* that abuts a respective inner surface 31 of the frame portions 5 that are coupled by the corresponding connector 103 when the sofa 101 is in the assembled state. Thus, the end tabs 107 generate a clamping force to couple the frame portions 5 that are coupled by the corresponding connector 103 when the sofa 101 is in the assembled state. For example, the first one of the connectors 103 includes (i) a first end tab 107 that protrudes from a first longitudinal side at a first end of the first one of the connectors 103, and that includes a clamping surface 107*a* that abuts the inner surface 31*b* of the chair 1*a* when the sofa 101 is in the assembled state, (ii) a second end tab 107 that protrudes from the first longitudinal side at a second end of the first one of the connectors 103, and that includes a clamping surface 107*a* that abuts the inner surface 31*b* of the chair 1*a* when the sofa 101 is in the assembled state, (iii) a third end tab 107 that protrudes from a second longitudinal side at the first end of the first one of the connectors 103, and that includes a clamping surface 107*a* that abuts the inner surface 31*a* of the chair 1*b* when the sofa 101 is in the assembled state, and (iv) a fourth end tab 107 that protrudes from the second longitudinal side at the second end of the first one of the connectors 103, and that includes a clamping surface 107*a* that abuts the inner surface 31*a* of the chair 1*b* when the sofa 101 is in the assembled state.

As shown in FIGS. 5C and 5D, each of the connectors 103 includes holding tabs 109 that protrude from the longitudinal sides of the spine 105 at locations between respective end tabs 107. Each of the holding tabs 109 protrude from the spine of a respective connector 103 in a direction parallel to extending directions of each of the end tabs 107 of a respective connector 103. Each of the holding tabs 109 includes a holding surface 109*a* and a protrusion 109*b*. Each of the holding surfaces 109*a* abuts a respective inner surface 31 of the frame portions 5 that are coupled by the corresponding connector 103 when the sofa 101 is in the assembled state. Each of the protrusions 109*b* abuts a respective outer circumferential face 37 of the frame portions 5 that are coupled by the corresponding connector 103 when the sofa 101 is in the assembled state. Thus, the holding tabs 109 generate a clamping force to couple the frame portions 5 that are coupled by the corresponding connector 103 when the sofa 101 is in the assembled state, and hold connectors 103 to the sofa 101 when the sofa 101 is in the assembled state. For example, the first one of the connectors 103 includes (i) a first holding tab 109 that protrudes from the first longitudinal side at a position between the first and second end tabs 107, that includes a clamping surface 109*a* that abuts the inner surface 31*b* of the chair 1*a* when the sofa 101 is in the assembled state, and that includes a protrusion 109*b* that abuts the outer circumferential face 37*b* of the chair 1*a* when the sofa 101 is in the assembled state (ii) a second holding tab 109 that protrudes from the first longitudinal side at a position between the first holding tab 109 and the second end tab 107, that includes a clamping surface 109*a* that abuts the inner surface 31*b* of the chair 1*a* when the sofa 101 is in the assembled state, and that includes a protrusion 109*b* that abuts the outer circumferential face 37*b* of the chair 1*a* when the sofa 101 is in the assembled state, (iii) a third holding tab 109 that protrudes from the second longitudinal side at a position between the third and fourth end tabs 107, that includes a clamping surface 109*a* that abuts the inner surface 31*a* of the chair 1*b* when the sofa 101 is in the assembled state, and that includes a protrusion 109*b* that abuts the outer circumferential face 37*a* of the chair 1*b* when the sofa 101 is in the assembled state, and (iv) a fourth holding tab 109 that protrudes from the second longitudinal side of the first one of the connectors 103 at a position between the third holding tab 109 and the fourth end tab 107, that includes a clamping surface 109*a* that abuts the inner surface 31*a* of the chair 1*b* when the sofa 101 is in the assembled state, and that includes a protrusion 109*b* that abuts the outer circumferential face 37*b* of the chair 1*b* when the sofa 101 is in the assembled state.

As shown in FIG. 5A, the sofa 101 can further include a removable sofa cover 115. The removable sofa cover 115 is flexible and covers an upper portion of the sofa 101 when the sofa 101 is in the assembled state. The removable sofa cover 115 includes a fabric shell 117, a strap system 119, and cushions 121. The strap system 119 and the cushions 121 can be fixed to the fabric shell 117, for example by thread or adhesive.

Figure 6A:
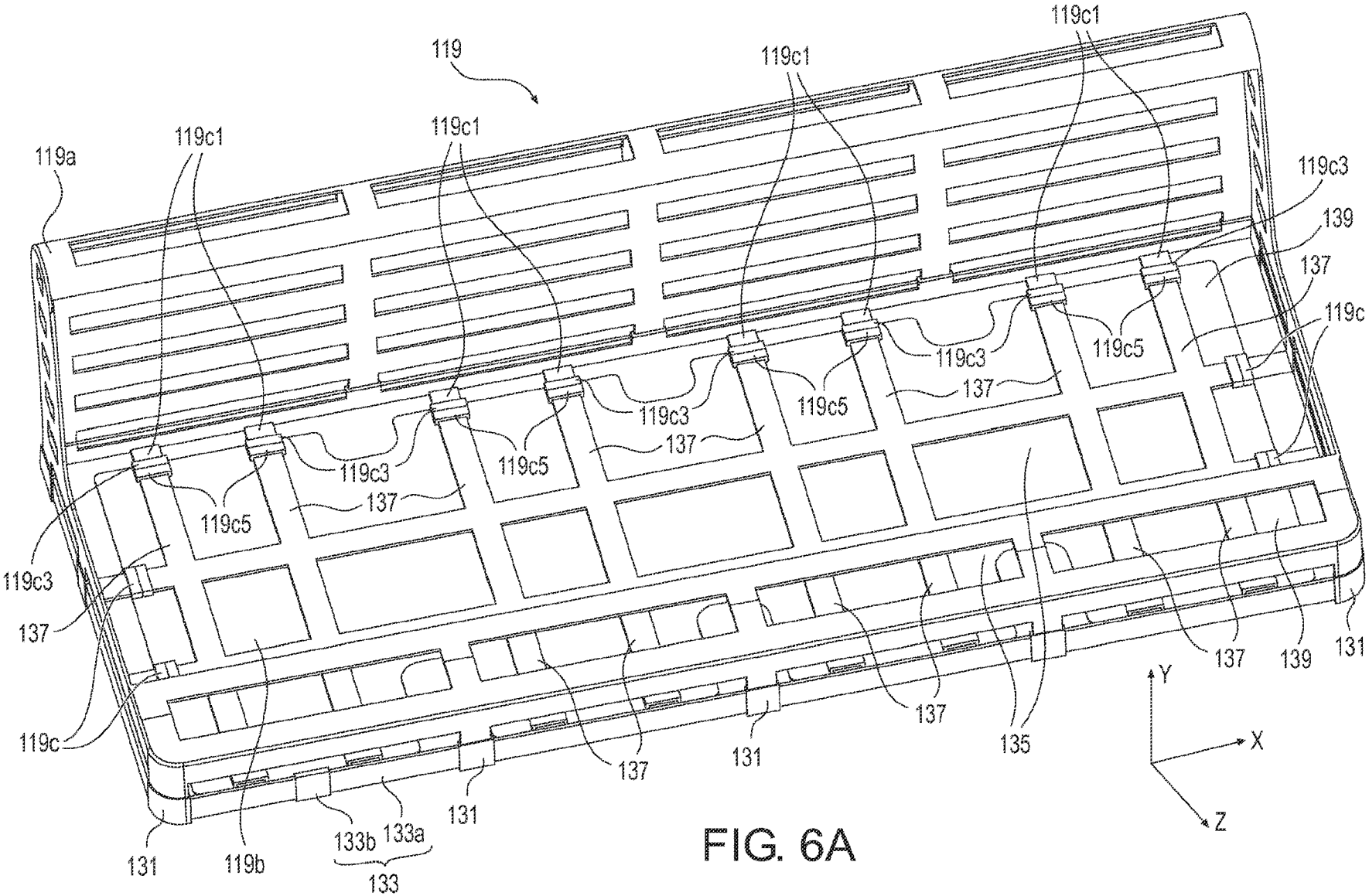
FIG. 6A is a view of a fifth type of the coupling mechanism.
Figure 6B:
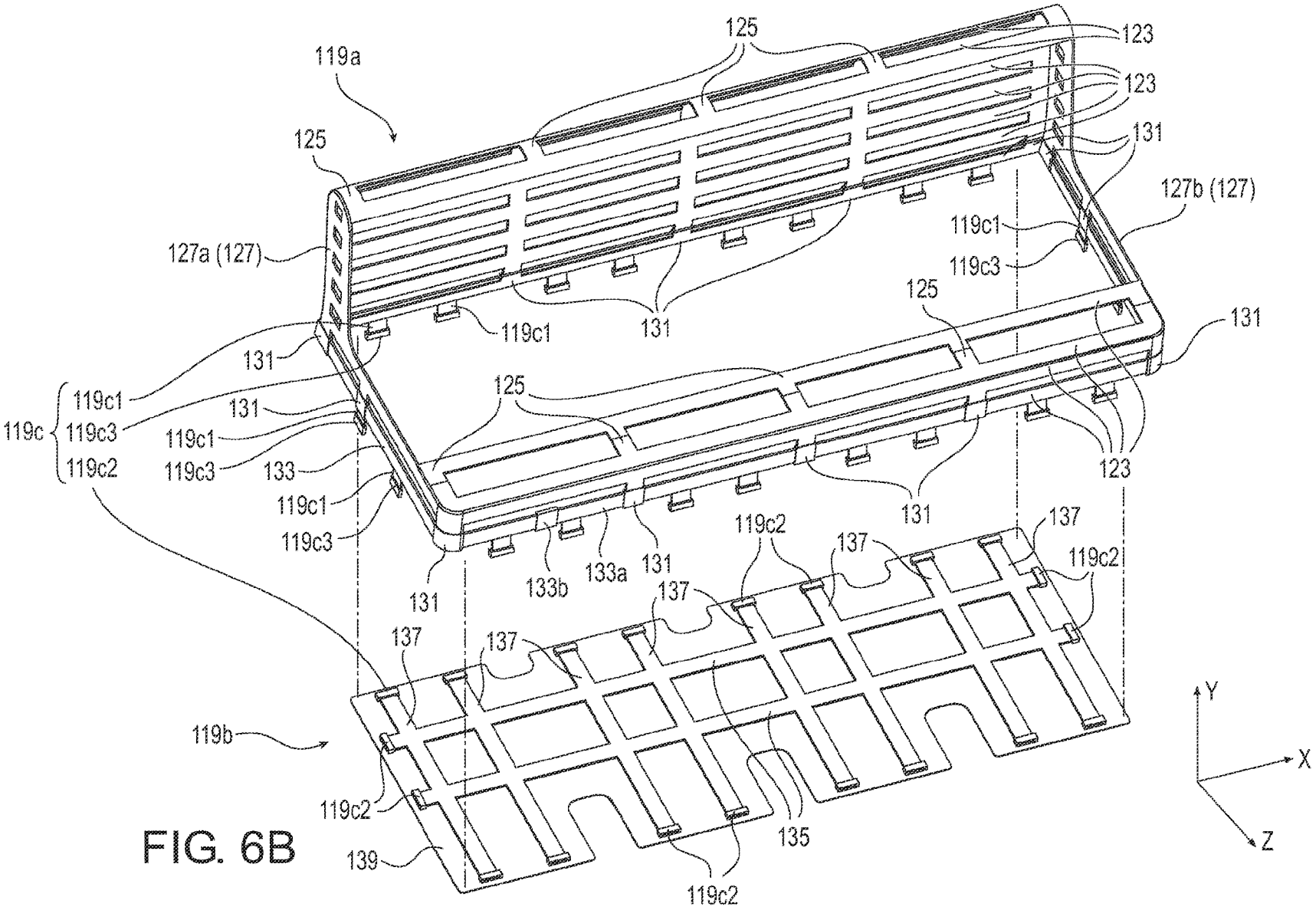
FIG. 6B is an exploded view of the fifth type of the coupling mechanism.
Figure 6C:
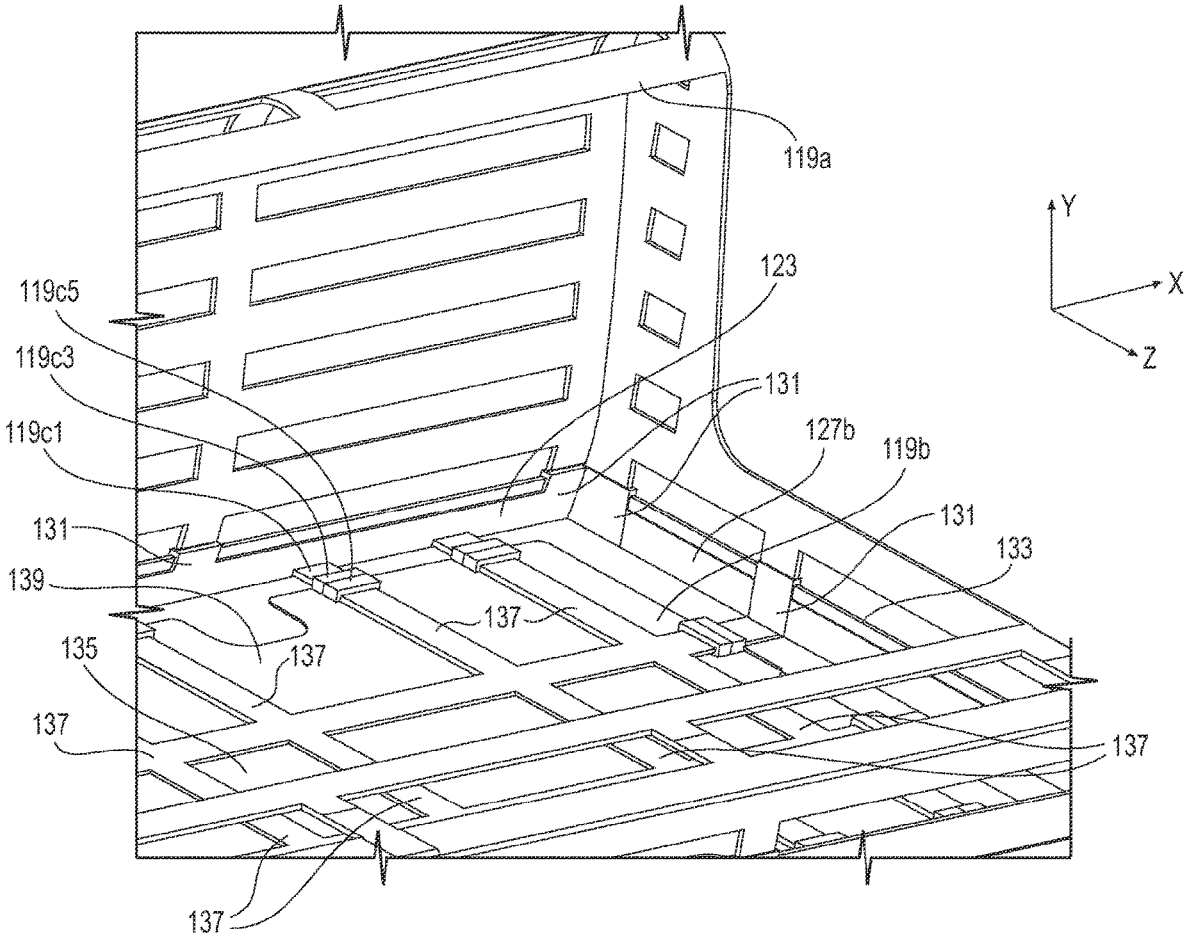
FIG. 6C is a partial view of the fifth type of the coupling mechanism.

The strap system 119 is an example of a fifth type of the coupling mechanisms 7. The strap system 119 is attached to the fabric shell 117, such as by one or more of a thread, a fastener, and adhesive. The strap system 119 applies compressive forces to the chair 1*a*, the chair 1*b*, the chair 1*c*, and the chair 1*d* using a plurality of different types of straps when the sofa 101 is in the assembled state. As shown in FIGS. 6A-6C, the strap system 119 includes an upper webbing portion 119*a*, a lower webbing portion 119*b*, and buckles 119*c*. The upper webbing portion 119*a* includes longitudinal webbing 123, transverse webbing 125, side webbing 127, webbing loops 131, and an adjustable circumferential strap 133. The longitudinal webbing 123, the transverse webbing 125, the side webbing 127, and the webbing loops 131 can be made of any combination of a broad array of appropriate materials for straps, such as nylon, plastic, and cotton. In the exemplary embodiment, the longitudinal webbing 123, the transverse webbing 125, the side webbing 127, and the webbing loops 131 are made of flat nylon webbing, like the webbing of the adjustable straps 65.

A longitudinal direction of each portion of the longitudinal webbing 123 (i.e., along the x-axis shown in FIGS. 6A-6C) is parallel to a longitudinal direction of the sofa 101 when the sofa 101 is in the assembled state. Each portion of the longitudinal webbing 123 extends from a first side webbing portion 127*a* of the side webbing 127 to a second side webbing portion 127*b* of the side webbing 127. Each portion of the longitudinal webbing 123 can be a discrete portion of webbing fixed to the first side webbing portion 127*a* and to the second side webbing portion 127*b*, such as by any combination of a thread, a fastener, and adhesive. Alternatively, each portion of the longitudinal webbing 123 can be integrally formed with the first side webbing portion 127*a* and the second side webbing portion 127*b*. The portions of the longitudinal webbing 123 can be disposed to cover any portion of the outer circumferential faces 37 of the frame portions 5 of the chairs 1*a*, 1*b*, 1*c*, and 1*d* that are not covered by the covers 15 of the chairs 1*a*, 1*b*, 1*c*, and 1*d* when the sofa 101 is in the assembled state.

For example, in the exemplary embodiment shown in FIGS. 6A-6C, the upper webbing portion 119*a* includes eleven portions of longitudinal webbing 123 extending from the first side webbing portion 127*a* and the second side webbing portion 127*b*. Two portions of the longitudinal webbing 123 are disposed so as to cover a top portion of the chairs 1*a*-1*d* when the sofa 101 is in the assembled state. Five portions of the longitudinal webbing 123 are disposed so as to cover a rear portion of the chairs 1*a*-1*d* when the sofa 101 is in the assembled state. Four portions of the longitudinal webbing 123 are disposed so as to cover a front portion of the chairs 1*a*-1*d* when the sofa 101 is in the assembled state.

A longitudinal direction of each portion of the transverse webbing 125 is perpendicular to the longitudinal direction of the sofa 101 when the sofa 101 is in the assembled state. First portions of the transverse webbing 125 connect the portions of the longitudinal webbing 123 covering the top portion the chairs 1*a*-1*d* and the portions of the longitudinal webbing 123 covering the rear portion of the chairs 1*a*-1*d* when the sofa 101 is in the assembled state. In other words, each of the first portions of the transverse webbing 125 can be a discrete portion of webbing fixed to each of the portions of the longitudinal webbing 123 covering the top portion the chairs 1*a*-1*d* and to each of the portions of the longitudinal webbing 123 covering the rear portion of the chairs 1*a-d*, when the sofa 101 is in the assembled state, such as by any combination of a thread, a fastener, and adhesive. Alternatively, each of the first portions of the transverse webbing 125 can be can be integrally formed with each of the portions of the longitudinal webbing 123 covering the top portion the chairs 1*a*-1*d* and to each of the portions of the longitudinal webbing 123 covering the rear portion of the chairs 1*a-d*.

The portions of the transverse webbing 125 can be disposed to cover any portion of the outer circumferential faces 37 of the frame portions 5 of the chairs 1*a*, 1*b*, 1*c*, and 1*d* that are not covered by the covers 15 of the chairs 1*a*, 1*b*, 1*c*, and 1*d* when the sofa 101 is in the assembled state. In the exemplary embodiment shown in FIGS. 6A and 6B, the upper webbing portion 119*a* includes five first portions of the transverse webbing 125. A first one of the first portions of the transverse webbing 125 covers a portion of the outer circumferential face 37*a* of the first frame portion 5 of the chair 1*a* (i.e., the first frame portion 5 of the sofa 101) when the sofa 101 is in the assembled state, and is fixed to the first side webbing portion 127*a*. The first one of the first portions of the transverse webbing 125 can be fixed to the first side webbing portion 127*a* by any combination of a thread, a fastener, and adhesive. Alternatively, the first one of the first portions of the transverse webbing 125 can be integrally formed with the first side webbing portion 127*a*. A second one of the first portions of the transverse webbing 125 covers a portion of the outer circumferential face 37*b* of the chair 1*a* and the outer circumferential face 37*a* of the chair 1*b* when the sofa 101 is in the assembled state. A third one of the first portions of the transverse webbing 125 covers a portion of the outer circumferential face 37*b* of the chair 1*b* and the outer circumferential face 37*a* of the chair 1*c* when the sofa 101 is in the assembled state. A fourth one of the first portions of the transverse webbing 125 covers a portion of the outer circumferential face 37*b* of the chair 1*c* and the outer circumferential face 37*a* of the chair 1*d* when the sofa 101 is in the assembled state. A fifth one of the first portions of the transverse webbing 125 covers a portion of the outer circumferential face 37*b* of the second frame portion 5*b* of the chair 1*d* (i.e., the eighth frame portion 5 of the sofa 101) when the sofa 101 is in the assembled state, and is fixed to the second side webbing portion 127*b*. The fifth one of the first portions of the transverse webbing 125 can be fixed to the second side webbing portion 127*b* by any combination of a thread, a fastener, and adhesive. Alternatively, the fifth one of the first portions of the transverse webbing 125 can be integrally formed with the second side webbing portion 127*b*. In addition, each of the first portions of the transverse webbing 125 includes respective ones of the webbing loops 131 at a position at which each of the first portions of the transverse webbing 125 intersects a bottommost one of the portions of longitudinal webbing 123 that covers the rear portion of the sofa 101 when the sofa 101 is in the assembled state.

Second portions of the transverse webbing 125 connect the portions of the longitudinal webbing 123 covering the front portion the chairs 1*a*-1*d* when the sofa 101 is in the assembled state. Each of the second portions of the transverse webbing 125 can be a discrete portion of webbing fixed to each of the portions of the longitudinal webbing 123 covering the front portion the chairs 1*a*-1*d* when the sofa 101 is in the assembled state, such as by any combination of a thread, a fastener, and adhesive. Alternatively, each of the second portions of the transverse webbing 125 can be can be integrally formed with each of the portions of the longitudinal webbing 123 covering the front portion the chairs 1*a*-1*d* when the sofa 101 is in the assembled state. The portions of the transverse webbing 125 can be disposed to cover any portion of the outer circumferential faces 37 of the frame portions 5 of the chairs 1*a*, 1*b*, 1*c*, and 1*d* that are not covered by the covers 15 when the sofa 101 is in the assembled state.

In the exemplary embodiment shown in FIGS. 6A and 6B, the upper webbing portion 119*a* includes five second portions of the transverse webbing 125. A first one of the second portions of the transverse webbing 125 covers a portion of the outer circumferential face 37*a* of the first frame portion 5 of the chair 1*a* when the sofa 101 is in the assembled state, and is fixed to the first side webbing portion 127*a*. The first one of the second portions of the transverse webbing 125 can be fixed to the first side webbing portion 127*a* by any combination of a thread, a fastener, and adhesive. Alternatively, the first one of the second portions of the transverse webbing 125 can be integrally formed with the first side webbing portion 127*a*. A second one of the second portions of the transverse webbing 125 covers a portion of the second outer circumferential face 37*b* of the chair 1*a* and the outer circumferential face 37*a* of the chair 1*b* when the sofa 101 is in the assembled state. A third one of the second portions of the transverse webbing 125 covers a portion of the second outer circumferential face 37*b* of the chair 1*b* and the outer circumferential face 37*a* of the chair 1*c* when the sofa 101 is in the assembled state. A fourth one of the second portions of the transverse webbing 125 covers a portion of the second outer circumferential face 37*b* of the chair 1*c* and the outer circumferential face 37*a* of the chair 1*d* when the sofa 101 is in the assembled state. A fifth one of the second portions of the transverse webbing 125 covers a portion of the outer circumferential face 37*b* of the second frame portion 5*b* of the chair 1*d* when the sofa 101 is in the assembled state, and is fixed to the second side webbing portion 127*b*. The fifth one of the second portions of the transverse webbing 125 can be fixed to the second side webbing portion 127*b* by any combination of a thread, a fastener, and adhesive. Alternatively, the fifth one of the second portions of the transverse webbing 125 can be integrally formed with the second side webbing portion 127*b*. In addition, each of the second portions of the transverse webbing 125 includes respective ones of the webbing loops 131, the respective ones of the webbing loops 131 being disposed at a position at which each of the second portions of the transverse webbing 125 intersect a bottommost one of the portions of longitudinal webbing 123 that covers the front portion of the chairs 1*a*-1*d* when the sofa 101 is in the assembled state.

The first side webbing portion 127*a* of the upper webbing portion 119*a* is configured to cover the outer surface 33*a* of the chair 1*a* when the sofa 101 is in the assembled state. The first side webbing portion 127*a* is directly connected to a first longitudinal end of each of the portions of the longitudinal webbing 123, to the first one of the first portions of the transverse webbing 125, and to the first one of the second portions of the transverse webbing 125. The first side webbing portion 127*a* also includes at least one of the webbing loops 131 disposed along a bottommost edge of the first side webbing portion 127*a*. For example, the first side webbing portion 127*a* includes two of the webbing loops 131 as shown in FIGS. 6A and 6B.

The second side webbing portion 127*b* of the upper webbing portion 119*a* is configured to cover the outer surface 33*b* of the chair 1*d* when the sofa 101 is in the assembled state. The first side webbing portion 127*a* is directly connected to a second longitudinal end of each of the portions of the longitudinal webbing 123, to the fifth one of the first portions of the transverse webbing 125, and to the fifth one of the second portions of the transverse webbing 125. The second side webbing portion 127*b* also includes at least one of the webbing loops 131 disposed along a bottommost edge of the second side webbing portion 127*b*. For example, the second side webbing portion 127*bs* includes two of the webbing loops 131 as shown in FIGS. 6A and 6B.

As shown in FIGS. 6A-6C, the adjustable circumferential strap 133 extends around a bottommost portion of the upper webbing portion 119*a* (e.g., in the y-axis as shown in FIGS. 6A and 6B), and through a hole defined by every one of the webbing loops 131. The bottommost portion of the upper webbing portion 119*a* is defined by a combination of (i) the bottommost one of the portions of longitudinal webbing 123 that covers the rear portion of the sofa 101 when the sofa 101 is in the assembled state, (ii) a bottom portion of the first side webbing portion 127*a* extending from the bottommost one of the portions of longitudinal webbing 123 that covers the rear portion of the sofa 101 when the sofa 101 is in the assembled state to the bottommost one of the portions of longitudinal webbing 123 that covers the front portion of the chairs 1*a*-1*d* when the sofa 101 is in the assembled state. (iii) a bottom portion of the second side webbing portion 127*b* extending from the bottommost one of the portions of longitudinal webbing 123 that covers the rear portion of the sofa 101 when the sofa 101 is in the assembled state to the bottommost one of the portions of longitudinal webbing 123 that covers the front portion of the chairs 1*a*-1*d* when the sofa 101 is in the assembled state, and (iv) the bottommost one of the portions of longitudinal webbing 123 that covers the front portion of the chairs 1*a*-1*d* when the sofa 101 is in the assembled state.

The adjustable circumferential strap 133 includes webbing 133*a* and an adjustment buckle 133*b*. The webbing 133*a* can be made of any combination of a broad array of appropriate materials for straps, such as nylon, plastic, and cotton. In the exemplary embodiment, the webbing 133*a* is made of flat nylon webbing. The adjustment buckle 133*b* can be made of any combination of a broad array of appropriate materials for buckles, such as plastic, metal, and wood. In the exemplary embodiment, the adjustment buckle 133*b* is made of metal. As shown in FIGS. 6A and 6B, the webbing 133*a* of the adjustable circumferential strap 133 encircles a section of the sofa 101 such that the webbing 133*a* covers the outer circumferential face 37*a* of the chair 1*a*, the outer circumferential face 37*b* of the chair 1*a*, the outer circumferential face 37*a* of the chair 1*b*, the outer circumferential face 37*b* of the chair 1*b*, the outer circumferential face 37*a* of the chair 1*c*, the outer circumferential face 37*b* of the chair 1*c*, the outer circumferential face 37*a* of the chair 1*d*, the outer circumferential face 37*b* of the chair 1*d*, the outer surface 33*b* of the chair 1*d*, and the outer surface 33*a* of the chair 1*a*, when the sofa 101 is in the assembled state.

The adjustment buckle 133*b* of the adjustable circumferential strap 133 is configured to adjust a longitudinal length of a portion of the webbing 133*a* that encircles the chairs 1*a*, 1*b*, 1*c*, and 1*d*, when the sofa 101 is in the assembled state. By shortening the longitudinal length of the webbing 133*a* that encircles the chairs 1*a*, 1*b*, 1*c*, and 1*d*, when the sofa 101 is in the assembled state, the user can impart a compression force that couples each of the chairs 1*a*, 1*b*, 1*c*, and 1*d* together, without the use of any tools.

As shown in FIGS. 6A-6C, the lower webbing portion 119*b* includes longitudinal webbing 135 and transverse webbing 137. The lower webbing portion 119*b* optionally can further include a backing portion 139. The longitudinal webbing 135 and the transverse webbing 137 can be made of any combination of a broad array of appropriate materials for straps, such as nylon, plastic, and cotton. In the exemplary embodiment, the longitudinal webbing 135 and the transverse webbing 137 are made of flat nylon webbing.

A longitudinal direction of each portion of the longitudinal webbing 135 (e.g., along the x-axis shown in FIGS. 6A-6C) is parallel to the longitudinal direction of the sofa 101 when the sofa 101 is in the assembled state. Each portion of the longitudinal webbing 135 can be a discrete portion of webbing fixed to each portion of the transverse webbing 137, such as by any combination of a thread, a fastener, and adhesive. Alternatively, each portion of the longitudinal webbing 135 can be integrally formed with the portions of the transverse webbing 137. The portions of the longitudinal webbing 135 can be disposed to cover any portion of the inner circumferential faces 35 of the frame portions 5 of the chairs 1*a*, 1*b*, 1*c*, and 1*d*, such as those that are covered by the covers 15 of the chairs 1*a*, 1*b*, 1*c*, and 1*d* when the sofa 101 is in the assembled state.

For example, in the exemplary embodiment shown in FIGS. 6A-6C, the lower webbing portion 119*b* includes two portions of longitudinal webbing 135. The two portions of longitudinal webbing 135 are separated in a depth direction (i.e., in a direction parallel to the z-axis shown in FIGS. 6A-6C) when the sofa 101 is in the assembled state. Further, each of the two portions of longitudinal webbing 135 cover the inner circumferential face 35*b* of the chair 1*a*, the inner circumferential faces 35*a* and 35*b* of the chair 1*b*, the inner circumferential faces 35*a* and 35*b* of the chair 1*c*, and the inner circumferential face 35*a* of the chair 1*d*, when the sofa 101 is in the assembled state.

A longitudinal direction of each portion of the transverse webbing 137 is perpendicular to the longitudinal direction of the sofa 101 (i.e., in a direction parallel to the z-axis shown in FIGS. 6A-6C) when the sofa 101 is in the assembled state. The portions of the transverse webbing 137 can cover surfaces of the slats 3 facing away from the support surface 53 of the seat rest 17 of the chairs 1*a*, 1*b*, 1*c*, and 1*d* when the sofa 101 is in the assembled state.

In the exemplary embodiment shown in FIGS. 6A and 6B, the lower webbing portion 119*b* includes four pairs of portions of the transverse webbing 137, each of the pairs passing in the z-axis direction in a space between the frame portions 5*a* and 5*b* of each of the chairs 1*a*-1*d* of the sofa 101 when the sofa 101 is in the assembled state. The portions of the transverse webbing 137 of each pair of the portions of the transverse webbing are separated from each other in the longitudinal direction (i.e., a direction parallel to the x-axis shown in FIGS. 6A-6C) of the sofa 101 when the sofa 101 is in the assembled state.

For example, in the exemplary embodiment shown in FIGS. 6A and 6B, a first one of the pairs of portions of the transverse webbing 137 covers a portion of a face of a first slat 3 facing away from the support surface 53 of the lower one of the removable supports 9 of the chair 1*a*, and covers a portion of a face of a second slat 3 facing away from the support surface 53 of the lower one of the removable supports 9 of the chair 1*a*, when the sofa 101 is in the assembled state. A second one of the pairs of portions of the transverse webbing 137 of the transverse webbing 137 covers a portion of a face of a first slat 3 facing away from the support surface 53 of the lower one of the removable supports 9 of the chair 1*b*, and covers a portion of a face of a second slat 3 facing away from the support surface 53 of the lower one of the removable supports 9 of the chair 1*b*, when the sofa 101 is in the assembled state. A third one of the pairs of portions of the transverse webbing 137 of the transverse webbing 137 covers a portion of a face of a first slat 3 facing away from the support surface 53 of the lower one of the removable supports 9 of the chair 1*c*, and covers a portion of a face of a second slat 3 facing away from the support surface 53 of the lower one of the removable supports 9 of the chair 1*c*, when the sofa 101 is in the assembled state. A fourth one of the pairs of portions of the transverse webbing 137 of the transverse webbing 137 covers a portion of a face of a first slat 3 facing away from the support surface 53 of the lower one of the removable supports 9 of the chair 1*d*, and covers a portion of a face of a second slat 3 facing away from the support surface 53 of the lower one of the removable supports 9 of the chair 1*d*, when the sofa 101 is in the assembled state. Each of the portions of the transverse webbing 137 can be fixed to the portions of longitudinal webbing 135 by any combination of a thread, a fastener, and adhesive. Alternatively, each of the portions of the transverse webbing 137 can be integrally formed with the portions of longitudinal webbing 135.

As shown in FIGS. 6A-6C, the lower webbing portion 119*b* can optionally include the backing portion 139. The backing portion 139 can be made of one or more of plastic and fabric. In the exemplary embodiment, the backing portion 139 is made of fabric. The backing portion 139 can be fixed to the portions of longitudinal webbing 135 and the transverse webbing 137 by at least one of a thread, a fastener, and adhesive. The backing portion 139 prevents dust, and other pollutants, from entering inside of a space underneath the seat rests 17, and provides for an aesthetically pleasing look to the sofa 101 when in the sofa 101 is in the assembled state.

As shown in FIGS. 6A-6C, the strap system 119 includes the buckles 119*c*. Each of the buckles 119*c* includes a webbing portion 119*c*1, a first buckle portion 119*c*3, and a second buckle portion 119*c*5. A first end of the webbing portion 119*c*1 of each of the buckles 119*c* is fixed to the bottommost portion of the upper webbing portion 119*a* by any combination of a thread, a fastener, and adhesive. Alternatively, the first end of the webbing portion 119*c*1 of each of the buckles can be integrally formed with the bottommost portion of the upper webbing portion 119*a*. The webbing portions 119*c*1 can be made of any combination of a broad array of appropriate materials for straps, such as nylon, plastic, and cotton. In the exemplary embodiment, the webbing portions 119*c*1 are made of flat nylon webbing.

The first buckle portions 119*c*3 can be made of any combination of a broad array of appropriate materials for buckles, such as plastic, metal, and wood. In the exemplary embodiment, the first buckle portions 119*c*3 are made of metal. As shown in FIGS. 6A-6C, a second end of each of the webbing portions 119*c*1 is attached to respective ones of the first buckle portions 119*c*3. The first buckle portions 119*c*3 are configured to adjust a length of respective webbing portions 119*c*1. By shortening the length of the webbing portions 119*c*1, the user can impart a compression force that stabilizes the chairs 1*a*, 1*b*, 1*c*, and 1*d*, and couples the chairs 1*a*, 1*b*, 1*c*, and 1*d* together, without the use of any tools, when the sofa 101 is in the assembled state. The first buckle portions 119*c*3 are also configured to both attach to and detach from respective ones of the second buckle portions 119*c*5, without the use of any tools.

The second buckle portions 119*c*5 can be made of any combination of a broad array of appropriate materials for buckles, such as plastic, metal, and wood. In the exemplary embodiment, the second buckle portions 119*c*5 are made of metal. As shown in FIGS. 6A-6C, the second buckle portions 119*c*5 are attached to respective ones of the distal ends of the portions of the longitudinal webbing 135 and respective ones of the distal ends of the portions of the transverse webbing 137. The second buckle portions 119*c*5 are configured to adjust a length of respective webbing portions 119*c*1. By shortening the length of the webbing portions 119*c*1, the user can impart a compression force that stabilizes the chairs 1*a*, 1*b*, 1*c*, and 1*d*, and couples the chairs 1*a*, 1*b*, 1*c*, and 1*d* together, without the use of any tools, when the sofa 101 is in the assembled state. The second buckle portions 119*c*5 are also configured to both attach to and detach from respective ones of the first buckle portions 119*c*3, without the use of any tools.

The sofa 101 can be easily assembled according to the following simple assembly process, without using any tools, as follows. First, the user can assemble each of the chairs 1*a*, 1*b*, 1*c*, and 1*d* as described above with respect to the chair 1. Second, the user can place the connectors 103 to couple the chairs 1*a*, 1*b*, 1*c*, and 1*d*, as shown in FIG. 5B. Third, the user can position the removable sofa cover 115 over the upper portion of the coupled chairs 1*a*, 1*b*, 1*c*, and 1*d*. Fourth, the user can position the lower webbing portion 119*b* through the inner circumferential faces 35 of the chairs 1*a*, 1*b*, 1*c*, 1*d*, and connect the first buckle portions 119*c*3 to respective second buckle portions 119*c*5 of the buckles 119*c*. Finally, the user can adjust the length of the webbing portions 119*c*1 to tension the strap system 119 to compress and stabilize the structure of the sofa 101 when the sofa 101 is in the assembled state. The sofa 101 can be dissembled in the opposite order.

Figure 7A:
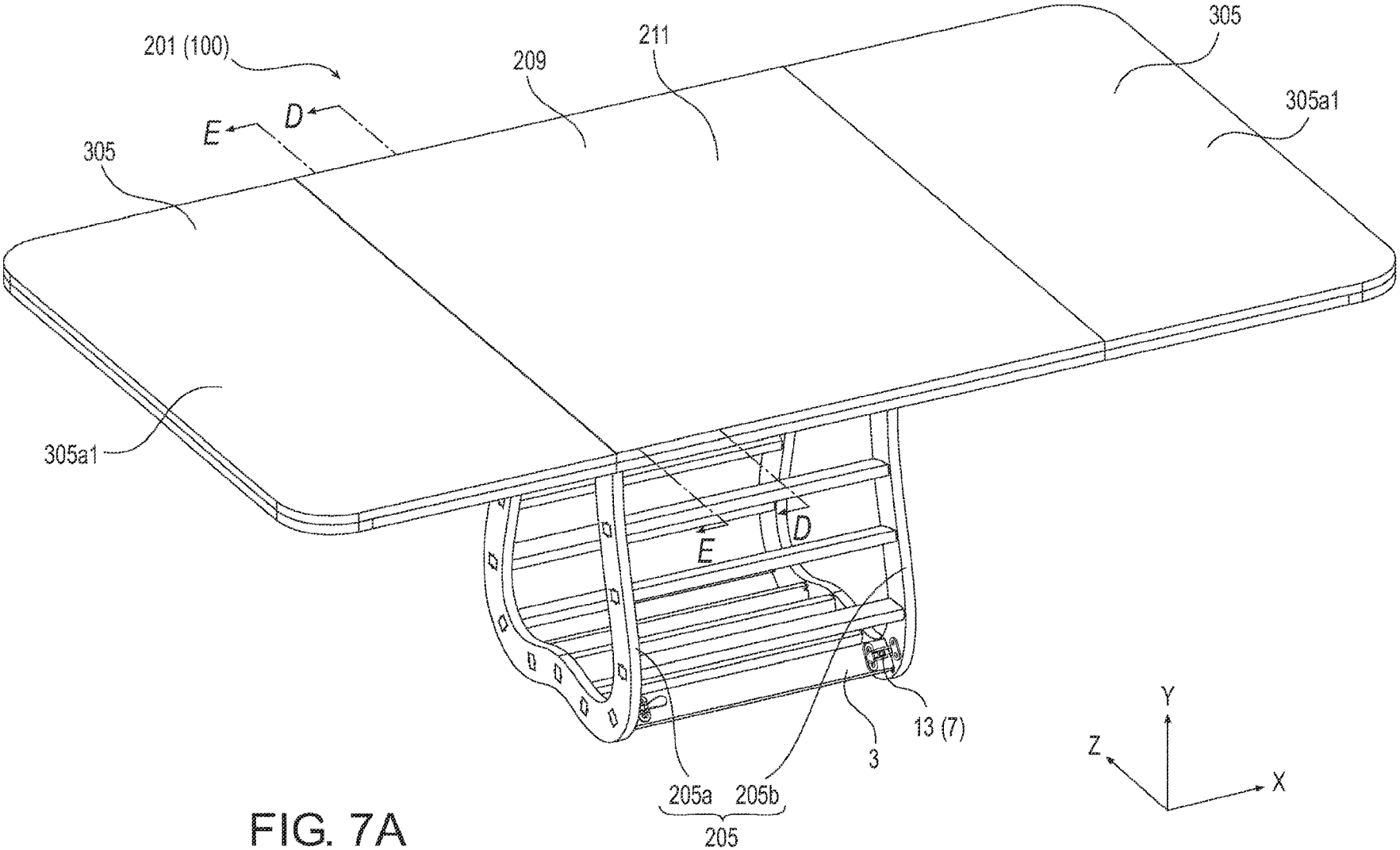
FIG. 7A is a top view of a second exemplary configuration.

A second configuration of the modular furniture system 100 will be described with reference to FIGS. 7A-7D. A table 201, as shown in FIG. 7A, is an example of the second configuration of the modular furniture system 100. The table 201 includes a plurality of the slats 3, the frame portions 5 (205), the coupling mechanisms 7, and a tabletop 209. Descriptions of the slats 3, the frame portions 205, and the coupling mechanisms 7, and the removable supports 9 as described above with respect to the chair 1 that are the same for the table 201 will not be repeated. Differences that can apply to these elements will be described below.

Figure 7B:
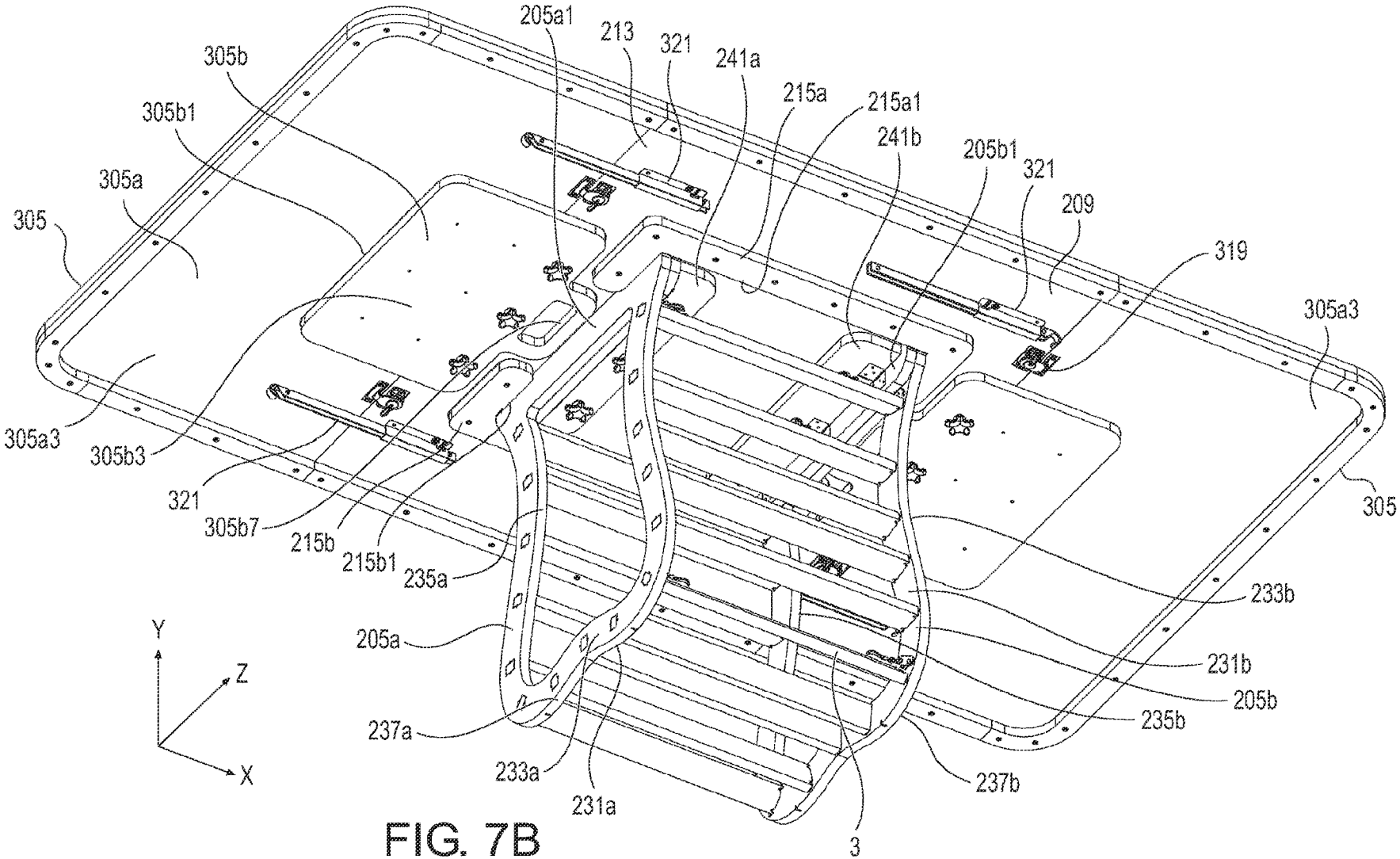
FIG. 7B is a bottom view of the second exemplary configuration.
Figure 7C:
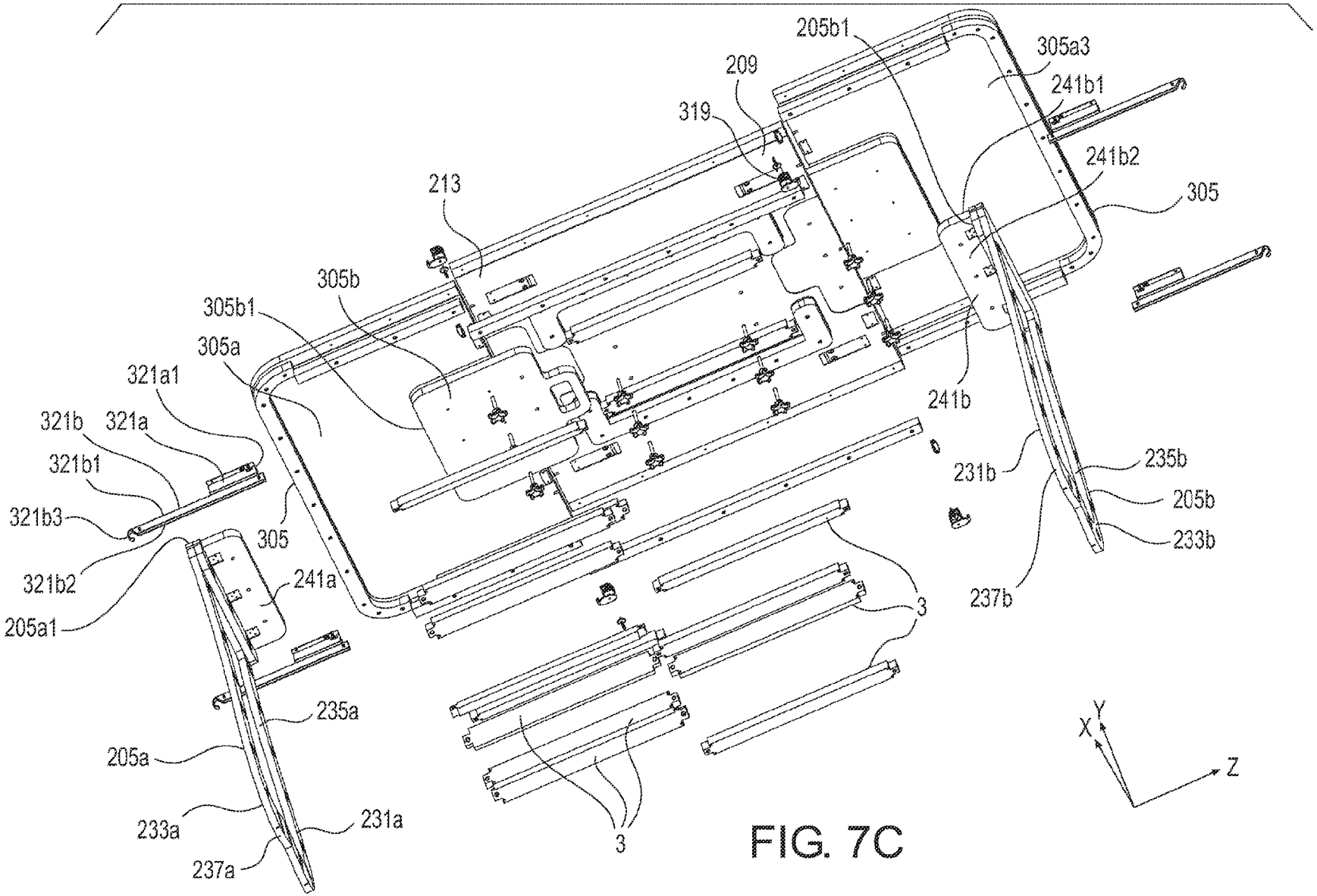
FIG. 7C is an exploded view of the second exemplary configuration.

As shown in FIGS. 7A-7C, the frame portions 205 include a first frame portion 205*a* and a second frame portion 205*b*. The first frame portion 205*a* is similar to the first frame portion 5*a* described above, and the second frame portion 205*b* is similar to the second frame portion 5*b* described above, except for the differences described below.

As shown in FIG. 7B, a shape of a profile of the first frame portion 205*a* defined by an inner circumferential face 235*a* and an outer circumferential face 237*a* is different from a shape of a profile of the first frame portion 5*a* defined by the inner circumferential face 35*a* and the outer circumferential face 37*a*. Similarly, a shape of a profile of the second frame portion 205*b* defined by an inner circumferential face 235*b* and an outer circumferential face 237*b* is different from a shape of a profile of the second frame portion 5*b* defined by the inner circumferential face 35*b* and the outer circumferential face 37*b*. More specifically, the shape of the profile of the first frame portion 205*a* includes a flat top portion 205*a*1, and the shape of the second frame portion 205*b* includes a flat top portion 205*b*1.

Figure 7D:
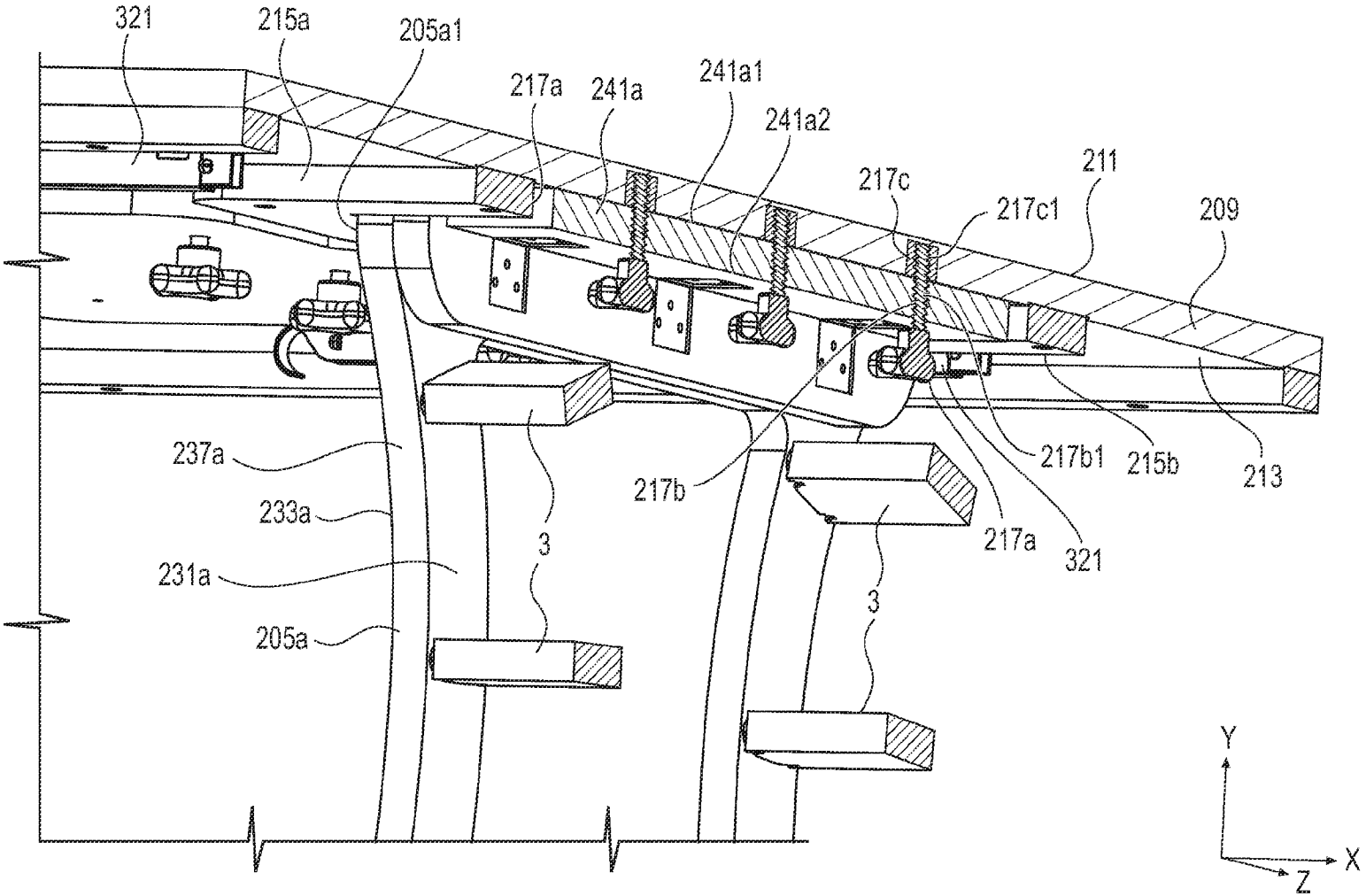
FIG. 7D is a cross-sectional view of the second exemplary configuration, taken along line D-D in FIG. 7A, with an example of a sixth type of coupling mechanism.

As shown in FIGS. 7B-7D, the flat top portion 205*a*1 of the first frame portion 205*a* includes a first flange 241*a*. The first flange 241*a* can be made of any combination of a broad array of materials appropriate for furniture such as plastic, metal, and wood. In the exemplary embodiment, the first flange 241*a* is made of wood. Preferably, the first flange 241*a* is made of Baltic birch. The first flange 241*a* can also be made of other types of wood such as bamboo, oak, walnut, or plywood. The first flange 241*a* is fixed to the flat top portion 205*a*1 of the first frame portion 205*a*. In the exemplary embodiment, the first flange 241*a* is fixed to the first frame portion 205*a* before provision of the first frame portion 205*a* to the user. The first flange 241*a* can be fixed to the inner surface 231*a* of the first frame portion 205*a* by fasteners (e.g., screws, nails, clips, staples, etc.) or by adhesives. Alternatively, the first flange 241*a* can be formed integrally with the first frame portion 205*a*.

FIG. 7D is across-sectional view of the table 201, taken along line D-D in FIG. 7A, with an example of a sixth type of coupling mechanism. As shown in FIG. 7D, the first flange 241*a* includes a tabletop contact surface 241*a*1 and a knob contact surface 241*a*2. The tabletop contact surface 241*a*1 is configured to abut the tabletop 209 when the table 201 is in an assembled state, as shown in FIGS. 7A, 7B, and 7D. The first flange 241*a* also includes a plurality of through holes extending from the tabletop contact surface 241*a*1 to the knob contact surface 241*a*2. The knob contact surface 241*a*2 faces in a direction that is opposite to a direction in which the tabletop contact surface 241*a*1 faces.

As shown in FIGS. 7B-7D, the flat top portion 205*b*1 of the second frame portion 205*b* includes a second flange 241*b*. The second flange 241*b* can be made of any combination of a broad array of materials appropriate for furniture such as plastic, metal, and wood. In the exemplary embodiment, the second flange 241*b* is made of wood. Preferably, the second flange 241*b* is made of Baltic birch. The second flange 241*b* can also be made of other types of wood such as bamboo, oak, walnut, or plywood. The second flange 241*b* is fixed to the flat top portion 205*b*1 of the second frame portion 205*b*. In the exemplary embodiment, the second flange 241*b* is fixed to the second frame portion 205*b* before provision of the second frame portion 205*b* to the user. The second flange 241*b* can be fixed to the inner surface 231*b* of the second frame portion 205*b* by fasteners (e.g., screws, nails, clips, staples, etc.) or by adhesives. Alternatively, the second flange 241*b* can be formed integrally with the second frame portion 205*b*.

As shown in FIGS. 7A-7C, the second flange 241*b* includes a tabletop contact surface 241*b*1 and a knob contact surface 241*b*2. The tabletop contact surface 241*b*1 is configured to abut the tabletop 209 when the table 201 is in an assembled state, as shown in FIGS. 7A, 7B, and 7D. The second flange 241*b* also includes a plurality of through holes extending from the tabletop contact surface 241*b*1 to the knob contact surface 241*b*2. The knob contact surface 241*b*2 faces in a direction that is opposite to a direction in which the tabletop contact surface 241*b*1 faces.

The tabletop 209 can be made of any combination of a broad array of materials appropriate for furniture such as plastic, metal, stone, and wood. In the exemplary embodiment, the tabletop 209 is made of wood. Preferably, the tabletop 209 is made of Baltic birch. The tabletop 209 can also be made of other types of wood such as bamboo, oak, walnut, or plywood. The tabletop 209 is an example of a removable support 9.

As shown in FIGS. 7A-7D, the tabletop 209 includes a top surface 211, a bottom surface 213, a first bracket 215*a*, and a second bracket 215*b*. The top surface 211 faces in a direction that is opposite to a direction in which the bottom surface 213 faces. The bottom surface 213 abuts a portion of the outer circumferential face 237*a*, the tabletop contact surface 241*a*1, a portion of the outer circumferential face 237*b*, and the tabletop contact surface 241*b*1 when the table 201 is in the assembled state.

The first bracket 215*a* can be made of any combination of a broad array of materials appropriate for furniture such as plastic, metal, stone, and wood. In the exemplary embodiment, the first bracket 215*a* is made of wood. Preferably, the first bracket 215*a* is made of Baltic birch. The first bracket 215*a* can also be made of other types of wood such as bamboo, oak, walnut, or plywood. The first bracket 215*a* is fixed to the bottom surface 213 of the tabletop 209. In the exemplary embodiment, the first bracket 215*a* is fixed to the bottom surface 213 before provision of the tabletop 209 to the user. The first bracket 215*a* can be fixed to the bottom surface 213 of the tabletop 209 by fasteners (e.g., screws, nails, clips, staples, etc.) or by adhesives. Alternatively, the first bracket 215*a* can be formed integrally with the tabletop 209.

As shown in FIGS. 7A, 7B, and 7D, the first bracket 215*a* includes an interior surface 215*a*1 that abuts the outer surface 233*a* of the first frame portion 205*a*, the outer circumferential face 237*a* of the first frame portion 205*a*, the first flange 241*a*, the second flange 241*b*, the outer circumferential face 237*b* of the second frame portion 205*b*, and the outer surface 233*b* of the second frame portion 205*b*.

The second bracket 215*b* can be made of any combination of a broad array of materials appropriate for furniture such as plastic, metal, stone, and wood. In the exemplary embodiment, the second bracket 215*b* is made of wood. Preferably, the second bracket 215*b* is made of Baltic birch. The second bracket 215*b* can also be made of other types of wood such as bamboo, oak, walnut, or plywood. The second bracket 215*b* is fixed to the bottom surface 213 of the tabletop 209. In the exemplary embodiment, the second bracket 215*b* is fixed to the bottom surface 213 before provision of the tabletop 209 to the user. The second bracket 215*b* can be fixed to the bottom surface 213 of the tabletop 209 by fasteners (e.g., screws, nails, clips, staples, etc.) or by adhesives. Alternatively, the second bracket 215*b* can be formed integrally with the tabletop 209.

As shown in FIGS. 7A and 7B, the second bracket 215*b* includes an interior surface 215*b*1 that abuts the outer surface 233*a* of the first frame portion 205*a*, the outer circumferential face 237*a* of the first frame portion 205*a*, the first flange 241*a*, the second flange 241*b*, the outer circumferential face 237*b* of the second frame portion 205*b*, and the outer surface 233*b* of the second frame portion 205*b*.

In combination, the first bracket 215*a* and the second bracket 215*b* allow a user to easily position the tabletop 209 during assembly of the table 201. In addition, the combination of the first bracket 215*a* and the second bracket 215*b* stabilize the tabletop 209, and prevent the tabletop 209 from shifting while the table 201 is in the assembled state.

In addition, as shown in FIGS. 7A-7D, the table 201 includes clamping mechanisms 217. Each of the clamping mechanisms 217 includes a knob 217*a*, a shaft 217*b*, and a fixed nut 217*c*. The knobs 217*a* can be made of any combination of a broad array of appropriate materials such as plastic, metal, and wood. In the exemplary embodiment, the knobs 217*a* are made of plastic.

The knobs 217*a* of the clamping mechanisms 217 are fixed to respective ones of the threaded shafts 217*b*, such as by one or both of a fastener and adhesive. Alternatively, each of the knobs 217*a* can be integrally formed with respective ones of the threaded shafts 217*b*. The threaded shafts 217*b* can be made of any combination of a broad array of appropriate materials such as plastic, metal, and wood. In the exemplary embodiment, the threaded shafts 217*b* are made of metal. The threaded shafts 217*b* include a threaded outer surface 217*b*1. First axial ends of the threaded shafts 217*b* are fixed to the corresponding ones of the knobs 217*a*. Second axial ends of the threaded shafts 217*b* are configured to be screwed into corresponding ones of the fixed nuts 217*c* when the table 201 is in the assembled state.

As shown in FIGS. 7A-7D, the fixed nuts 217*c* of the clamping mechanisms 217 are fixed inside of recesses formed in the bottom surface 213 of the tabletop 209, such as by one or both of a fastener and adhesive. The fixed nuts 217*c* can be made of any combination of a broad array of appropriate materials such as plastic, metal, and wood. In the exemplary embodiment, the fixed nuts 217*c* are made of metal. The fixed nuts 217*c* include a threaded inner surface 217*c*1. The second axial ends of the threaded shafts 217*b* are configured to be screwed into the threaded inner surface 217*c*1 of the corresponding ones of the fixed nuts 217*c* when the table 201 is in the assembled state. Alternatively, each of the threaded inner surfaces 217*c*1 of the fixed nuts 217*c* can be integrally formed in the recesses formed in the bottom surface 213.

As shown in FIG. 7D, each of the clamping mechanisms 217 generates a clamping force when the user turns the knob 217*a* to screw a respective shaft 217*b* into a respective fixed nut 217*c*. More specifically, when the table 201 is in the assembled state, the clamping mechanisms 217 clamp the flanges 241*a* and 241*b* between respective knobs 217*a* and the bottom surface 213 of the tabletop 209. Similarly, the user can release the clamping force by turning the knob 217*a* in a different direction. Thus, the user can easily couple the tabletop 209 to the flat top portions 205*a*1 and 205*b*1, and easily release the tabletop 209 from the flat top portions 205*a*1 and 205*b*1, without using any tools.

The table 201 can be easily assembled according to the following simple assembly process, without using any tools, as follows. First, the user can insert the first distal end 21*a* of each of the slats 3 into respective recesses 29 of the first frame portion 205*a* such that respective ball and detent couplings 11 are in a fully engaged state, as shown in FIG. 2C. Second, the user can then insert the second distal end 21*b* of each of the slats 3 into respective recesses 29 of the second frame portion 205*b* such that respective ball and detent couplings 11 are in the fully engaged state. Third, the user can manipulate the lever 13*j* of each of the latches 13 such that each of the latches 13 are in a closed state (as shown in FIG. 3B), and optionally insert the lock pins 13*l* into the cams 13*k*. Fourth, the user can place the tabletop 209 on top of the flat top portions 205*a*1 and 205*b*1 such that: the first bracket 215*a* of the tabletop 209 abuts the outer surface 233*a* of the first frame portion 205*a*, the outer circumferential face 237*a* of the first frame portion 205*a*, the first flange 241*a*, the second flange 241*b*, the outer circumferential face 237*b* of the second frame portion 205*b*; and the second bracket 215*b* of the tabletop 209 abuts the outer surface 233*a* of the first frame portion 205*a*, the outer circumferential face 237*a* of the first frame portion 205*a*, the first flange 241*a*, the second flange 241*b*, the outer circumferential face 237*b* of the second frame portion 205*b*, and the outer surface 233*b* of the second frame portion 205*b* the outer surface 233*b* of the second frame portion 205*b*, as shown in FIG. 7B. Fifth, the user can manipulate the knobs 217*a* such that: respective ones of the threaded shafts 217*b* pass through respective ones of the through holes of the flanges 241*a* and 241*b*, and the clamping mechanisms 217 clamp the tabletop 209 to the flanges 241*a* and 241*b*. The table 201 can be dissembled in the opposite order.

In addition, each of the above described configurations of the modular furniture system 100 can be easily modified, without requiring the user to use any tools. For example, the chair 1 can optionally further include a seat extender 301, the sofa 101 can optionally further include arm rests 303, and the table 201 can optionally include one or more table extensions 305. The seat extender 301, the arm rests 303, and the table extensions 305 are described below.

The seat extender 301 can be made of any combination of a broad array of materials appropriate for furniture such as plastic, metal, and wood. In the exemplary embodiment, the seat extender 301 is made of wood. Preferably, the seat extender 301 is made of Baltic birch. The seat extender 301 can also be made of other types of wood such as bamboo, oak, walnut, or plywood. As shown in FIGS. 1A and 1C the seat extender 301 includes an extending portion 301*a*, a handle portion 301*b*, and cantilevered arms 301*c*.

As shown in FIG. 1C, the extending portion 301*a* includes an extension surface 301*a*1, frame contacting surfaces 301*a*3, and a bottom surface 301*a*5. The extension surface 301*a*1 is configured to face in a direction parallel to the support surface 53 of the seat rest 17 of the chair 1 (i.e., in a direction parallel to the y-axis direction shown in FIGS. 1A-IC), and is continuous with the support surface 53 of the seat rest 17, when the chair 1 is in a modified assembled state including the seat extender 301. In other words, the extension surface 301*a*1 is coplanar to the support surface 53 of the seat rest 17, and is continuous with the support surface 53 of the seat rest 17, when the chair 1 is in the modified assembled state.

In the exemplary embodiment shown in FIGS. 1A-1C, the extending portion 301*a* includes two frame contacting surfaces 301*a*3. A first one of the frame contacting surfaces 301*a*3 is configured to abut the outer circumferential face 37*a* and the inner surface 31*a* when the chair 1 is in the modified assembled state. A second one of the frame contacting surfaces 301*a*3 is configured to abut the outer circumferential face 37*b* and the inner surface 31*b*. The frame contacting surfaces 301*a*3 help guide the user during modification of the chair 1, and stabilize the seat extender 301 when the chair 1 is in the modified assembled state.

In the exemplary embodiment shown in FIGS. 1A and 1C, the handle portion 301*b* is fixed to a side of the extending portion 301*a* on a side that is opposite to the frame contacting surface 301*a*3. The handle portion 301*b* can be fixed to the extending portion 301*a* by fasteners (e.g., screws, nails, clips, staples, etc.) or by adhesives. Alternatively, the handle portion 301*b* can be formed integrally with the extending portion 301*a*. The handle portion includes a through hole 301*b*1 having an axial direction parallel to a depth direction of the chair 1 in the modified assembled state (i.e., in a direction parallel to the z-axis shown in FIGS. 1A-IC). By gripping the seat extender 301 through the through hole 301*b*1, the user can easily transport and manipulate the seat extender 301.

In the exemplary embodiment shown in FIGS. 1A and 1C, the seat extender 301 includes two of the cantilevered arms 301*c*. The cantilevered arms 301*c* can be fixed to the bottom surface 301*a*5 of the extending portion 301*a* by fasteners (e.g., screws, nails, clips, staples, etc.) or by adhesives. Alternatively, the cantilevered arms 301*c* can be formed integrally with the extending portion 301*a*.

As shown in FIG. 1C, each of the cantilevered arms 301*c* includes a top surface 301*c*1 and a bottom surface 301*c*3. A first longitudinal portion of the top surface 301*c*1 of each of the cantilevered arms 301*c* is fixed to the bottom surface 301*a*5. A second longitudinal portion of the top surface 301*c*1 of each of the cantilevered arms is configured to abut the primary supported surface 61 of the seat rest 17 when the chair 1 is in the modified assembled state.

The bottom surface 301*c*3 of each of the cantilevered arms 301*c* is configured to abut a nearest one of the slats 3 of the chair 1 when the chair 1 is in the modified assembled state. The bottom surface 301*c*3 abuts the nearest one of the slats 3 of the chair 1 at a position between respective distal longitudinal ends of the cantilevered arms 301*c*. The nearest one of the slats 3 is the slat 3 that is nearest to the seat extender 301 when the chair 1 is in the modified assembled state.

In addition, as shown in FIGS. 1B and 1C, the chair 1 can further include a magnetic coupling mechanism 307, which is an example of the sixth type of the coupling mechanisms 7. The magnetic coupling mechanism 307 is arranged to generate a magnetic coupling force that couples the seat extender 301 to the seat rest 17 and thereby to the frame portions 5*a* and 5*b* when the chair 1 is in the modified assembled state. The magnetic coupling mechanism 307 includes a magnet 307*a* and a bracket 307*b*. As shown in FIGS. 1B and 1C, the magnet 307*a* is fixed to the primary supported surface 61 of the seat rest 17, such as by any combination of a fastener and an adhesive. The magnet 307*a* is attached to a position on the primary supported surface 61 such that the magnet 307*a* abuts the bracket 307*b* when the chair 1 is in the modified assembled state.

The bracket 307*b* is made of, for example, a ferromagnetic metal. As shown in FIGS. 1B and 1C, the bracket 307*b* is fixed to the bottom surface 301*a*5 of the extending portion 301*a*, such as by one or both of a fastener and an adhesive. The bracket 307*b* is fixed to a position on the bottom surface 301*a*5 such that the bracket 307*b* will abut the magnet 307*a* when the chair 1 is in the modified assembled state.

In the exemplary embodiment, the magnet 307*a* is fixed to the primary supported surface 61 of the seat rest 17, and the bracket 307*b* is fixed to the bottom surface 301*a*5 of the extending portion 301*a*, before provision of the seat rest 17 and the seat extender 301 to the user.

The chair 1 can be easily modified such that the seat extender 301 is coupled to the chair 1 without the use of any tools, and released from the chair 1 without the use of any tools, as follows. First, the user can manipulate the positioning of the seat extender 301 such that the cantilevered arms 301*c* are inserted between an uppermost front slat 3 (the nearest slat 3 discussed above) and the seat rest 17. Second, the user can slide the seat extender 301 to a position such that the frame contacting surfaces 301*a*3 abut respective ones of the outer circumferential face 37*a* and the outer circumferential face 37*b*. When the frame contacting surfaces 301*a*3 abut respective ones of the outer circumferential face 37*a* and the outer circumferential face 37*b*, the magnetic coupling mechanism 307 generates a magnetic coupling force that couples the seat extender 301 to the seat rest 17 and to the frame portions 5*a* and 5*b*. The seat extender 301 can be released from the chair 1 in the opposite order.

Figure 9A:
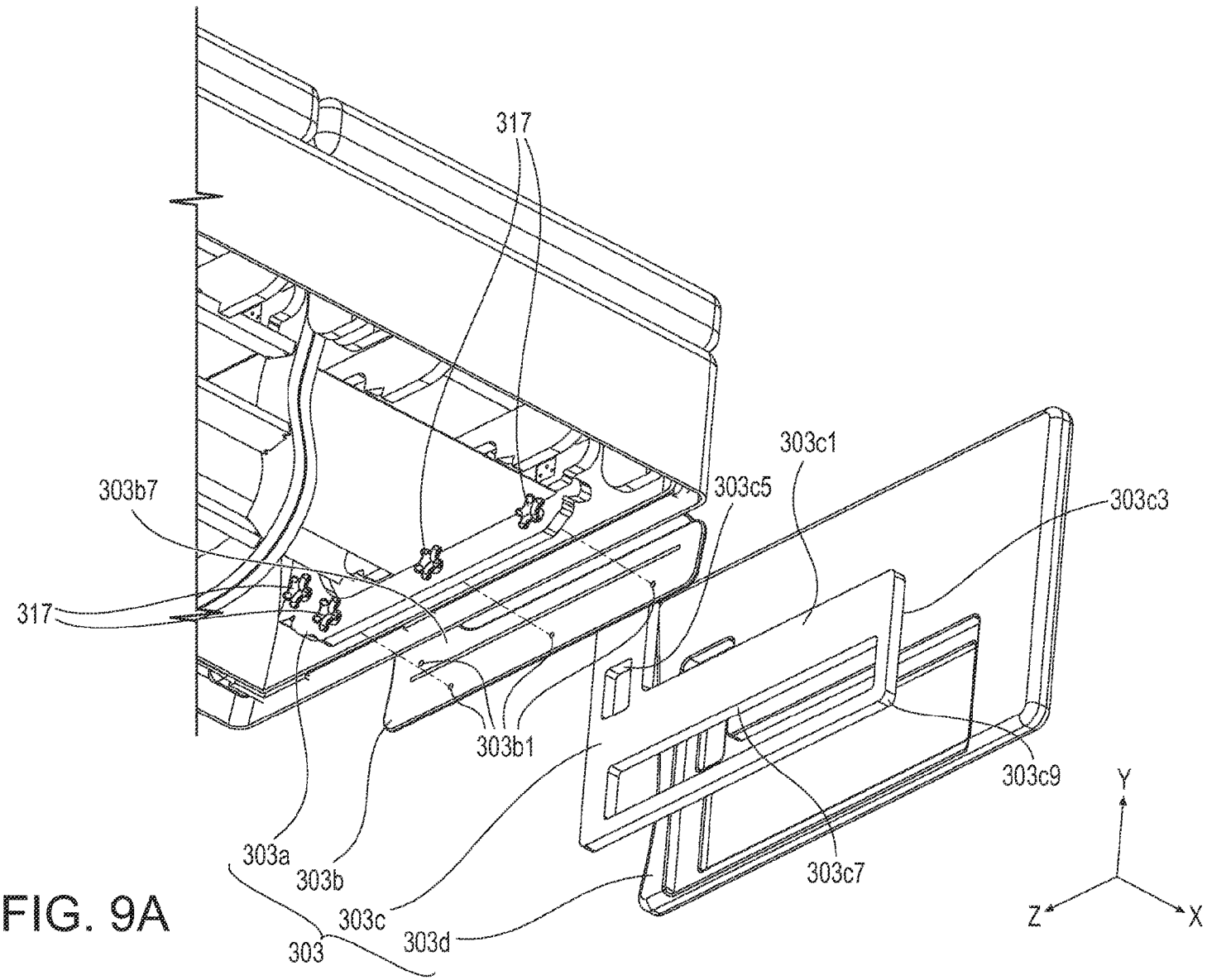
FIG. 9A is an exploded view of another modification to the first configuration.
Figure 9B:
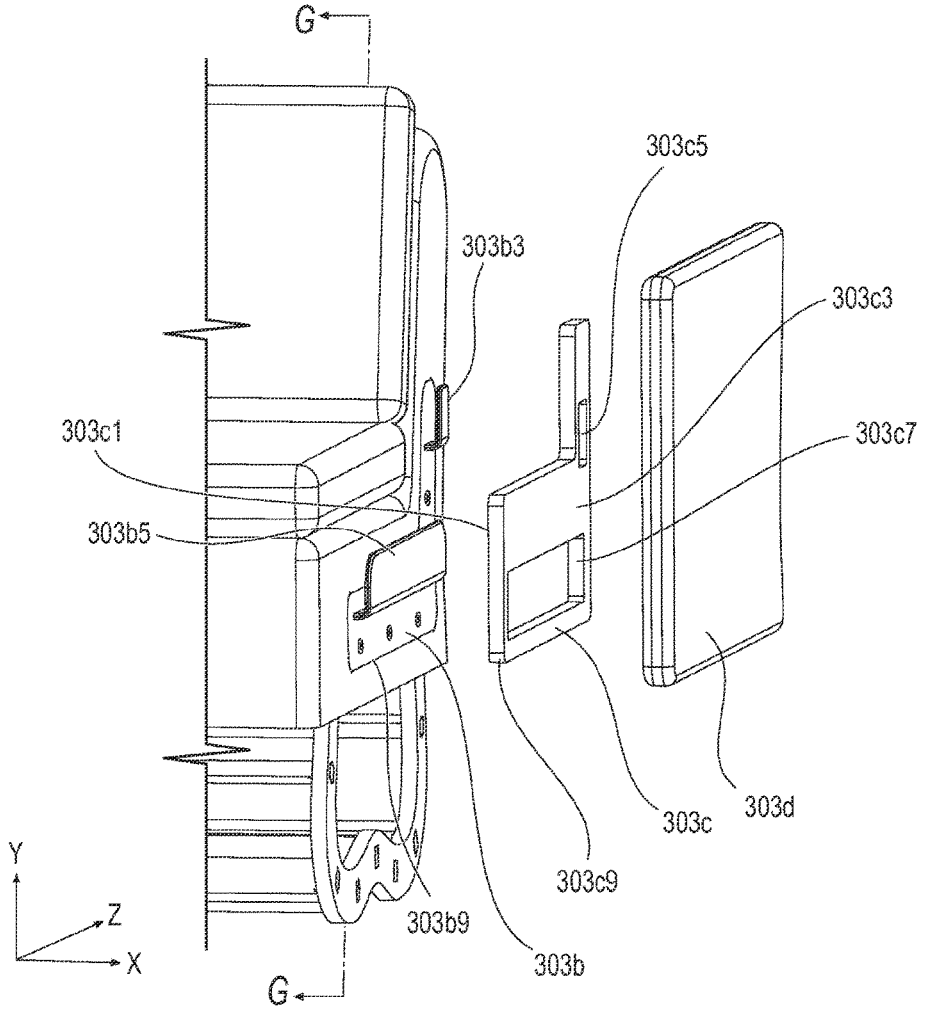
FIG. 9B is another exploded view of the other modification to the first configuration.
Figure 9C:
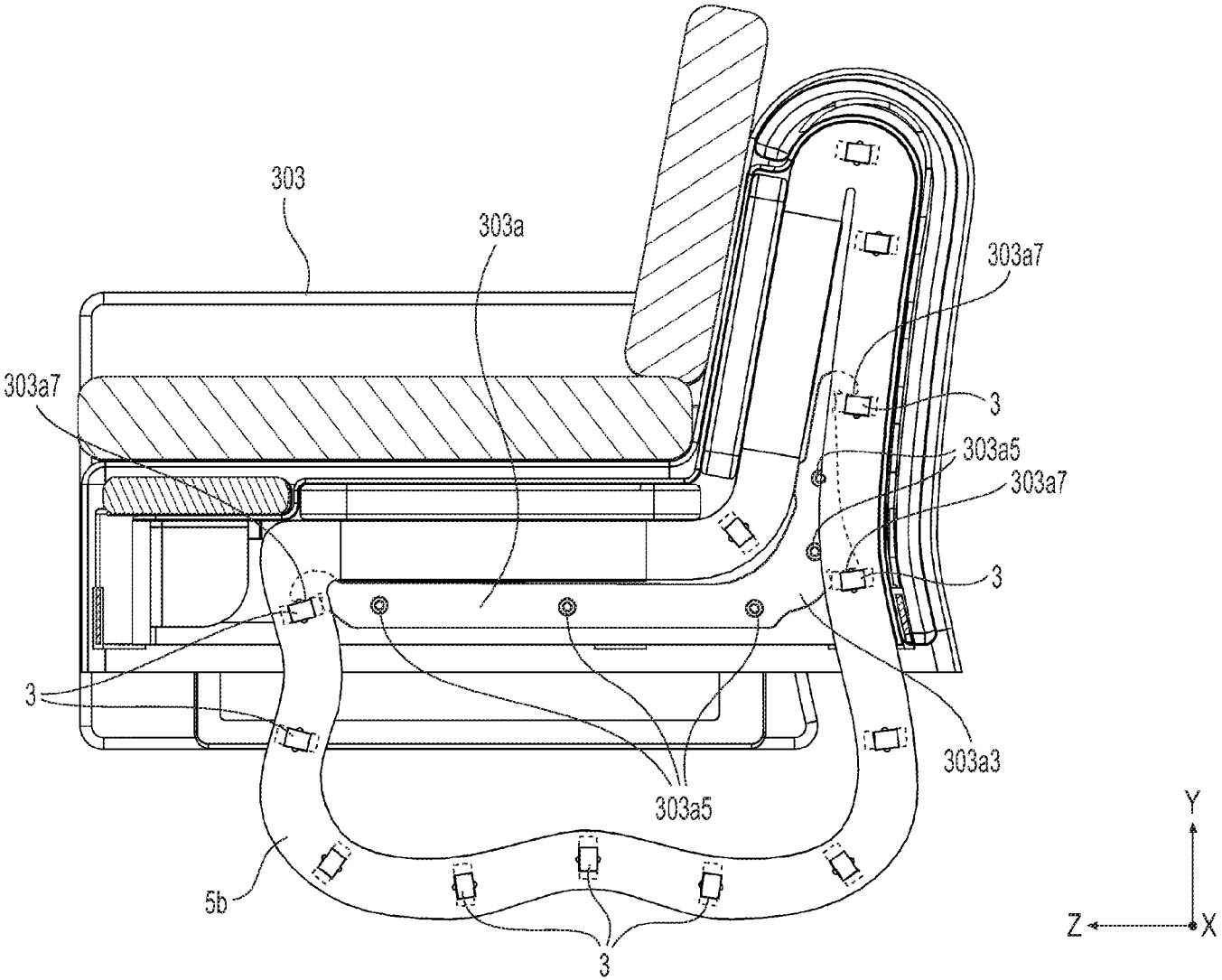
FIG. 9C is a cross sectional view taken along line G-G in FIG. 9B.

FIG. 9A is an exploded view of another modification to the first configuration, FIG. 9B is another exploded view of the other modification to the first configuration, and FIG. 9C is a cross sectional view taken along line G-G in FIG. 9B. As shown in FIGS. 9A-9C, the sofa 101 can be modified to further include arm rests 303. For example, as shown in FIG. 9A, each of the arm rests 303 includes an inner bracket 303*a*, an outer bracket 303*b*, a hanging frame portion 303*c*, and a rest portion 303*d*. The inner bracket 303*a* can be made of any combination of a broad array of materials appropriate for furniture such as plastic, metal, and wood. In the exemplary embodiment, the inner bracket 303*a* is made of wood. Preferably, the inner bracket 303*a* is made of Baltic birch. The inner bracket 303*a* can also be made of other types of wood such as bamboo, oak, walnut, or plywood.

As shown in FIGS. 9A-9C, a first one of the arm rests 303 will be described below. The inner bracket 303*a* includes a knob contact surface 303*a*1, a frame contact surface 303*a*3, through holes 303*a*5, and slat contact surfaces 303*a*7. The knob contact surface 303*a*1 is disposed on an opposite side of the inner bracket from the frame contact surface 303*a*3. The inner bracket 303*a* of the first one of the arm rests 303 is fixed to the inner surface 31*b* of the second frame portion 5*b* of the chair 1*d* of the sofa 101, such as by fasteners (e.g., screws, nails, clips, staples, etc.) or by adhesives. The inner bracket 303*a* of the first one of the arm rests 303 is fixed to the second frame portion 5*b* of the chair 1*d* before provision of the inner bracket 303*a* and the second frame portion 5*b* to the user. The frame contact surface 303*a*3 abuts the inner surface 31*b* of the second frame portion 5*a* of the chair 1*d* when the sofa 101 is modified to include the arm rests 303 in a modified assembled state. Each of the through holes 303*a*5 extend in an axial direction (i.e., in a direction parallel to the x-axis shown in FIG. 9A) from the knob contact surface 303*a*1 to the frame contact surface 303*a*3.

As shown in FIG. 9C, each of the slat contact surfaces 303*a*7 abuts respective ones of the slats 3 when the sofa 101 is in the modified assembled state, as shown in FIG. 9C. For example, a first one of the slat contact surfaces 303*a*7 abuts a top surface and an interior surface of a top front slat 3 of the chair 1*d*. A second one of the slat contact surfaces 303*a*7 abuts a top surface and an interior surface of a first rear slat 3 of the chair 1*d*. A third one of the slat contact surfaces 303*a*7 abuts a top surface and an interior surface of a second rear slat 3 disposed above the second one of the slats of the chair 1*d*. Thus, when the slat contact surfaces 303*a*7 abut the respective ones of the slats 3, the inner bracket 303*a* is supported by the respective ones of the slats 3.

The outer bracket 303*b* can be made of any combination of a broad array of materials appropriate for furniture such as plastic, metal, and wood. In the exemplary embodiment, the outer bracket 303*b* is made of metal. As shown in FIGS. 9A and 9B, the outer bracket 303*b* includes through holes 303*b*1, an upper hook 303*b*3, a lower hook 303*b*5, a frame contact surface 303*b*7, and a hanger surface 303*b*9. The outer bracket 303*b* of the first one of the arm rests 303 covers a portion of the outer surface 33*b* of the chair 1*d* of the sofa 101 when the sofa 101 is in a modified assembled state. Each of the through holes 303*b*1 corresponds to respective ones of the through holes 303*a*5 of the inner bracket 303*a* of the first one of the arm rests 303. The hanger surface 303*b*9 faces in an opposite direction from a direction in which the frame contact surface 303*b*7 faces. The upper hook 303*b*3 and the lower hook 303*b*5 protrude from the hanger surface 303*b*9. Each of the upper hook 303*b*3 and the lower hook 303*b*5 includes an interior support surface that curves and has a portion facing upwards (i.e., in a direction parallel to the y-axis shown in FIGS. 9A-9B) and a portion facing towards the outer surface 33*b* of the chair 1*d* of the sofa 101 when the sofa 101 is in a modified assembled state.

The hanging frame portion 303*c* can be made of any combination of a broad array of materials appropriate for furniture such as plastic, metal, and wood. In the exemplary embodiment, the hanging frame portion 303*c* is made of wood. Preferably, the hanging frame portion 303*c* is made of Baltic birch. The hanging frame portion 303*c* can also be made of other types of wood such as bamboo, oak, walnut, or plywood. As shown in FIGS. 9A and 9B, the hanging frame portion 303*c* includes an interior surface 303*c*1, an exterior surface 303*c*3, an upper inner circumferential surface 303*c*5, a lower inner circumferential surface 303*c*7, and a circumferentially outer face 303*c*9. The interior surface 303*c*1 is configured to cover and to abut the hanger surface 303*b*9 of the outer bracket 303*b* when the modified sofa 101 is in the assembled state. The upper inner circumferential surface 303*c*5 defines a through hole axially extending from the interior surface 303*c*1 to the exterior surface 303*c*3. The exterior surface 303*c*3 faces in a direction that is opposite to a direction in which the interior surface 303*c*1 faces. In addition, a portion of the upper inner circumferential surface 303*c*5 is configured to abut the interior support surface of the upper hook 303*b*3 of the outer bracket 303*b* when the modified sofa 101 is in the assembled state. The lower inner circumferential surface 303*c*7 defines a through hole axially extending from the interior surface 303*c*1 to the exterior surface 303*c*3. In addition, a portion of the lower inner circumferential surface 303*c*7 is configured to abut the interior support surface of the lower hook 303*b*5 of the outer bracket 303*b* when the modified sofa 101 is in the assembled state. Moreover, a first portion of the exterior surface 303*c*3 is configured to abut the interior support surface of the upper hook 303*b*3, and a second portion of the exterior surface 303*c*3 is configured to abut the interior support surface of the lower hook 303*b*5 when the modified sofa 101 is in the assembled state. Also, a third portion of the exterior surface 303*c*3, and a portion of the circumferentially outer face 303*c*9, abuts the rest portion 303*d* when the modified sofa 101 is in the assembled state.

The rest portion 303*d* of the exemplary embodiment is made of, for example, wood for structural purposes. The wood is wrapped in at least one of batting, felt, and/or sponge material for cushioning purposes. The at least one of batting, felt, and/or sponge material is finally encased in fabric. A portion of the rest portion 303*d* is fixed to the hanging frame portion 303*c*, such as by one or both of fasteners or adhesive. Thus, the user can manipulate the rest portion 303*d* such that the upper hook 303*b*3 passes through a through hole defined by the 303*c*5, and the lower hook 303*b*5 passes through a through hole defined by the 303*c*7. Then the user can lower the rest portion 303*d* such that the upper hook 303*b*3 and the lower hook 303*b*5 slide between the hanging frame portion 303*c* and the rest portion 303*d* until the hanging frame portion 303*c* hangs from the upper hook 303*b*3 and the lower hook 303*b*5.

Furthermore, the arm rests 303 are coupled to the sofa 101 via modified clamping mechanisms 317. The modified clamping mechanisms are the same as the clamping mechanisms 217 described above, except for the differences provided below. The modified clamping mechanisms 317 include a knob, a threaded shaft, and a fixed nut. Each knob of the modified clamping mechanisms 317 is the structurally same as the knobs 217*a*. Each of the threaded shafts of the modified clamping mechanisms 317 is structurally the same as the threaded shafts 217*b*. Each of the fixed nuts of the modified clamping mechanisms 317 is structurally the same as the fixed nuts 217*c*, except that each of the fixed nuts 317*c* are fixed to the hanger surface 303*b*9 of the outer bracket 303*b*, such as by welding material or by an adhesive. Alternatively, the fixed nuts 317*c* can be integrally formed with the outer bracket 303*b*.

Each of the clamping mechanisms 317 generate a clamping force when the user screws a respective threaded shaft of the modified clamping mechanisms 317 into a respective nut 317*c* using the knob of the modified clamping mechanisms 317. More specifically, when the modified sofa 101 is in the assembled state, the clamping mechanisms 317 clamp the outer bracket 303*b* to the inner bracket 303*a* with the clamping force generated by each of the clamping mechanisms 217. Thus, the user can easily couple the outer bracket 303*b* of the first one of the arm rests 303 to the second frame portion 5*b* of the chair 1*d*, and easily release the outer bracket 303*b* of the first one of the arm rests 303 from the second frame portion 5*b* of the chair 1*d*, without using any tools.

The sofa 101 can be easily modified such that the arm rest 303 is coupled to the sofa 101 without the use of any tools, and released from the sofa 101 without the use of any tools, as follows. First, before the user positions the removable sofa cover 115 over the upper portion of the coupled chairs 1*a*, 1*b*, 1*c*, and 1*d*, the user can place the inner bracket 303*a* such that the slat contact surfaces 303*a*7 abut respective ones of the slats 3 of the chair 1*d*, and the inner bracket is 303*a* is supported by the respective ones of the slats 3. Second, before the user positions the removable sofa cover 115 over the upper portion of the coupled chairs 1*a*, 1*b*, 1*c*, and 1*d*, the user can manipulate the knobs of the clamping mechanisms 317 such that respective ones of the threaded shafts of the modified clamping mechanisms 317 are inserted into respective ones of the through holes 303*a*5. Third, before the user positions the removable sofa cover 115 over the upper portion of the coupled chairs 1*a*, 1*b*, 1*c*, and 1*d*, the user can position outer bracket 303*b* such that the user can screw the threaded shafts of the modified clamping mechanisms 317 are screwed into respective ones of the fixed nuts 317*c*. By screwing the threaded shafts of the modified clamping mechanisms 317 into the fixed nuts 317*c* of the modified clamping mechanisms 317, the clamping mechanisms 317 generate a clamping force clamping the outer bracket 303*b* to the sofa 101. Fourth, after the user positions the removable sofa cover 115 over the upper portion of the coupled chairs 1*a*, 1*b*, 1*c*, and 1*d* such that the upper hook 303*b*3 and the lower hook 303*b*5 protrude through respective slits in the removable sofa cover 115, the user can hang the rest portion 303*d* by positioning the hanging frame portion 303*c* onto the hooks 303*b*3 and 303*b*5 of the outer bracket 303*b*. The arm rest 303 can be released from the sofa 101 in the opposite order.

A second one of the arm rests 303 can be provided structurally the same as the first one of the arm rests 303 described above, except for being mirrored such that the second one of the arm rests 303 is mirrored with respect to the first one of the arm rests 303, and is thus configured to be coupled to the first frame portion 5*a* of the chair 1*a* of the sofa 101.

As shown in FIGS. 7A and 7B, the table 201 can optionally be modified to further include at least one table extension 305. Each table extension 305 can be made of any combination of a broad array of materials appropriate for furniture such as plastic, metal, stone, and wood. In the exemplary embodiment, each table extension 305 is made of wood. Preferably, the table extensions 305 are made of Baltic Birch. The table extensions 305 can also be made of other types of wood such as bamboo, oak, walnut, or plywood.

As shown in FIGS. 7B and 7C, each of the table extensions 305 includes an extending portion 305*a* and a flange 305*b*. Each of the extending portions 305*a* includes an extension surface 305*a*1 and a bottom surface 305*a*3. Each of the extension surfaces 305*a*1 is configured to face in a direction parallel to a direction in which the top surface 211 of the tabletop 209 faces (i.e., in a direction parallel to the y-axis direction shown in FIGS. 7A-7D), and abut the tabletop 209 when the table 201 is in a modified assembled state that includes the table extensions 305. In other words, each of the extension surfaces 305*a*1 of each of the table extensions 305 is coplanar with the top surface 211 of the tabletop 209, and is continuous with the top surface 211 of the tabletop 209, when the modified table 201 is in the assembled state. Each of the bottom surfaces 305*a*3 is fixed to the flange 305*b*.

Figure 8A:
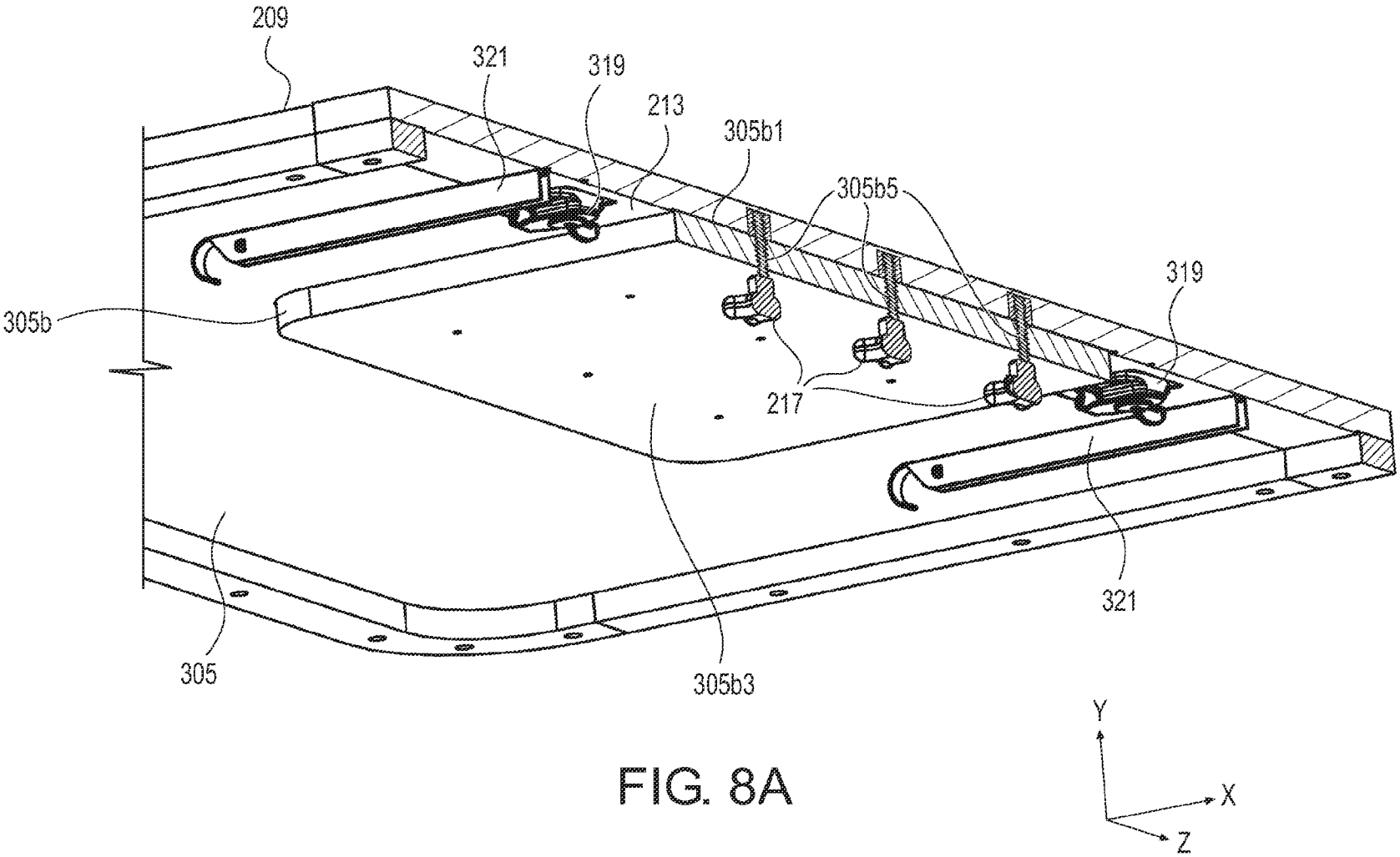
FIG. 8A is a cross-sectional view of a first modification of the second exemplary configuration, taken along line E-E in FIG. 7A.

FIG. 8A is a cross-sectional view taken along line E-E in FIG. 7A. As shown in FIGS. 7B and 8A, each of the flanges 305*b* includes a top contact surface 305*b*1, a knob contact surface 305*b*3, through holes 305*b*5, and a handle 305*b*7. A first portion of each of the top contact surfaces 305*b*1 abuts respective ones of the bottom surfaces 305*a*3, and is fixed to the respective ones of the bottom surfaces 305*a*3. A second portion of each of the top contact surfaces 305*b*1 abuts the bottom surface 213 of the tabletop 209. The handle 305*b*7 is formed in an end of the flange 305*b* nearest among portions of the flange 305*b* to a center of the tabletop 209 when the modified table 201 is in the assembled state.

Further, the table extensions 305 can be coupled to the tabletop 209 by at least one of several different types of coupling mechanisms 7. For example, as shown in FIG. 8A, the table extensions 305 can be coupled to the tabletop 209 by additional clamping mechanisms 217 provided at positions corresponding to respective ones of the through holes 305*b*5. In this arrangement, each of the additional clamping mechanisms 217 generates a clamping force when the user screws a respective shaft 217*b* into a respective fixed nut 217*c* using the knob 217*a*. More specifically, when the modified table 201 is in the assembled state, the additional clamping mechanisms 217 clamp respective ones of the flanges 305*b* between respective knobs 217*a* and the bottom surface 213 of the tabletop 209 with the clamping force generated by each of the additional clamping mechanisms 217. Thus, the user can easily couple the table extension 305 to the tabletop 209, and easily release the table extension 305 from the tabletop 209, without using any tools.

Figure 8B:
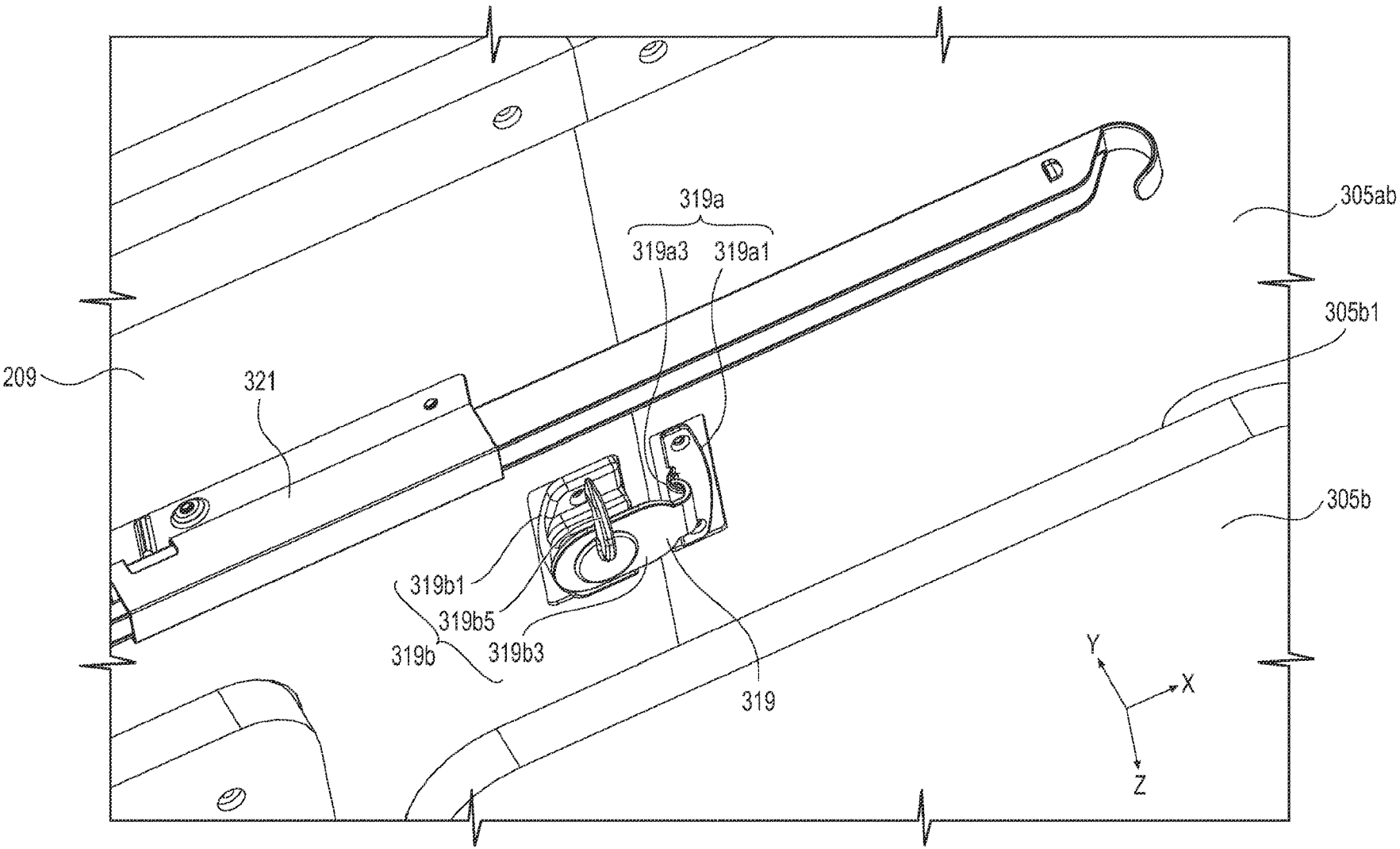
FIG. 8B is a view of a seventh type of coupling mechanism and an eighth type of coupling mechanism.

In addition, as shown in FIGS. 8A and 8B, the table extensions 305 can be coupled to the tabletop 209 by rotating latches 319. The rotating latches 319 are an example of a seventh type of coupling mechanism 7.

The rotating latches 319 can be made of any combination of a broad array of materials appropriate for latches such as plastic, metal, and wood. In the exemplary embodiment, the rotating latches 319 are made of metal. As shown in FIG. 8B, each of the rotating latches 319 includes an anchor portion 319*a* and a locking portion 319*b*. Each anchor portion 319*a* is fixed to the bottom surface 305*a*3 of the table extension 305. The anchor portion 319*a* includes a base 319*a*1 and a hook 319*a*3. Each base 319*a*1 abuts the bottom surface 305*a*3 of respective ones of the table extensions 305, and is fixed to the bottom surface 305*a*3 of the respective ones of the table extensions 305. Each base 319*a*1 can be fixed to respective ones of the bottom surfaces 305*a*3 by fasteners (e.g., screws, nails, clips, staples, etc.) or by adhesives. The hook 319*a*3 is integrally formed with the base 319*a*1, and protrudes from the base 319*a*1.

As shown in FIGS. 8A and 8B, each locking portion 319*b* includes a base 319*b*1, a hook 319*b*3, and a lever 319*b*5. Each base 319*b*1 is fixed to the bottom surface 213 of the tabletop 209. Each base 319*b*1 can be fixed to the bottom surface 213 by fasteners (e.g., screws, nails, clips, staples, etc.) or by adhesives. Each of the hooks 319*b*3 is disposed between respective ones of the bases 319*b*1 and respective ones of the levers 319*b*5, and is configured to abut respective ones of the hooks 319*a*3, and be separated from the respective ones of the hooks 319*a*3, based on rotation of the respective ones of the levers 319*b*5 by the user when the modified table 201 is in the assembled state. The lever 319*b*5 is configured to rotate in a rotational direction parallel to the bottom surface 213 of the tabletop 209. Thus, the rotating latches 319 are configured to easily couple the table extensions 305 to the tabletop 209 without using any tools, and to easily release the table extensions 305 from the tabletop 209, without using any tools.

Furthermore, as shown in FIGS. 8A and 8B, the table extensions 305 can be coupled to the tabletop 209 by leaf extenders 321. The leaf extenders 321 are an example of an eighth type of coupling mechanism 7.

The leaf extenders 321 can be made of any combination of a broad array of materials appropriate for latches such as plastic, metal, and wood. In the exemplary embodiment, the leaf extenders 321 are made of metal. As shown in FIG. 8B, each of the leaf extenders 321 includes an anchor portion 321*a* and a rod portion 321*b*. Each anchor portion 321*a* is fixed to the bottom surface 213 of the tabletop 209. The anchor portions 321*a* each include a rod support surface 321*a*1 that abuts and supports respective ones of the rod portions 321*b*.

The rod portions 321*b* are disposed between respective ones of the rod support surfaces 321*a*1 and the bottom surface 213 of the tabletop 209. The rod portions 321*b* each include an extension support surface 321*b*1, a sliding surface 321*b*2, and a hook 321*b*3. As shown in FIG. 7B, an entirety of each of the extension support surfaces 321*b*1 abuts the bottom surface 213 when respective ones of the rod portions 321*b* are in a retracted state (see the leaf extender 321 on the right side in FIG. 7B). As also shown in FIG. 7B, a first portion of the extension support surfaces 321*b*1 abuts the bottom surface 305*a*3 of the table extension 305, and a second portion of the extension support surfaces 321*b*1 abuts the bottom surface 213 of the tabletop 209, when respective ones of the rod portions 321*b* are in an extended state while the modified table 201 is in the assembled state (see the leaf extender 321 on the left side in FIG. 7B). The sliding surfaces 321*b*2 of respective ones of the rod portions 321*b* are configured to slide against corresponding ones of the rod support surfaces 321*a*1 when the user manipulates positions of respective ones of the rod portions 321*b* by pulling and pushing the hook 321*b*3.

In other words, when the first portion of the extension support surfaces 321*b*1 abuts the bottom surface 305*a*3 of the table extension 305, and the second portion of the extension support surfaces 321*b*1 abuts the bottom surface 213 of the tabletop 209, the respective leaf extender 321 supports the respective table extension 305 such that it remains in place with respect to the tabletop 209. Thus, the leaf extenders 321 are configured to easily couple the table extensions 305 to the tabletop 209 without using any tools, and to easily release the table extensions 305 from the tabletop 209, without using any tools.

The table 201 can be easily modified such that the table extensions 305 are coupled to the table 201 without the use of any tools, and released from the table 201 without the use of any tools, as follows. First, the user can manipulate the hooks 321*b*3 of the leaf extenders 321 such that the rod portions 321*b* are in the extended state, as shown in FIG. 7B. Second, the user can position the table extension 305 such that the flanges 305*b* abut the bottom surface 213 of the tabletop 209, the extension surfaces 305*a*1 abut the top surface 211 of the tabletop 209, and the anchor portions 319*a* of the rotating latches 319 are aligned with respective ones of the locking portion 319*b*. Third, the user can manipulate the levers 319*b*5 to cause the hooks 319*b*3 of the rotating latches 319 to abut respective ones of the hooks 319*a*3, and thereby impart a tensioning force to couple the table extensions 305 to the table 201. Fourth, the user can manipulate the knobs 217*a* of the clamping mechanisms 217 such that respective ones of the threaded shafts 217*b* are inserted into respective ones of the through holes 305*b*5, and screwed into respective ones of the fixed nuts 217*c*. By screwing the threaded shafts 217*b* into the fixed nuts 217*c*, the clamping mechanisms 217 generate a clamping force clamping the respective flanges 305*b* to the tabletop 209 such that the table 201 is in the assembled state shown in FIGS. 7A and 7B.

As noted above, the modular furniture system 100 can be configured using all disclosed coupling mechanisms 7, only a portion of the disclosed coupling mechanisms 7, or only one of the disclosed coupling mechanisms 7. As such, one or more of the above steps may be eliminated.

Figure 10:
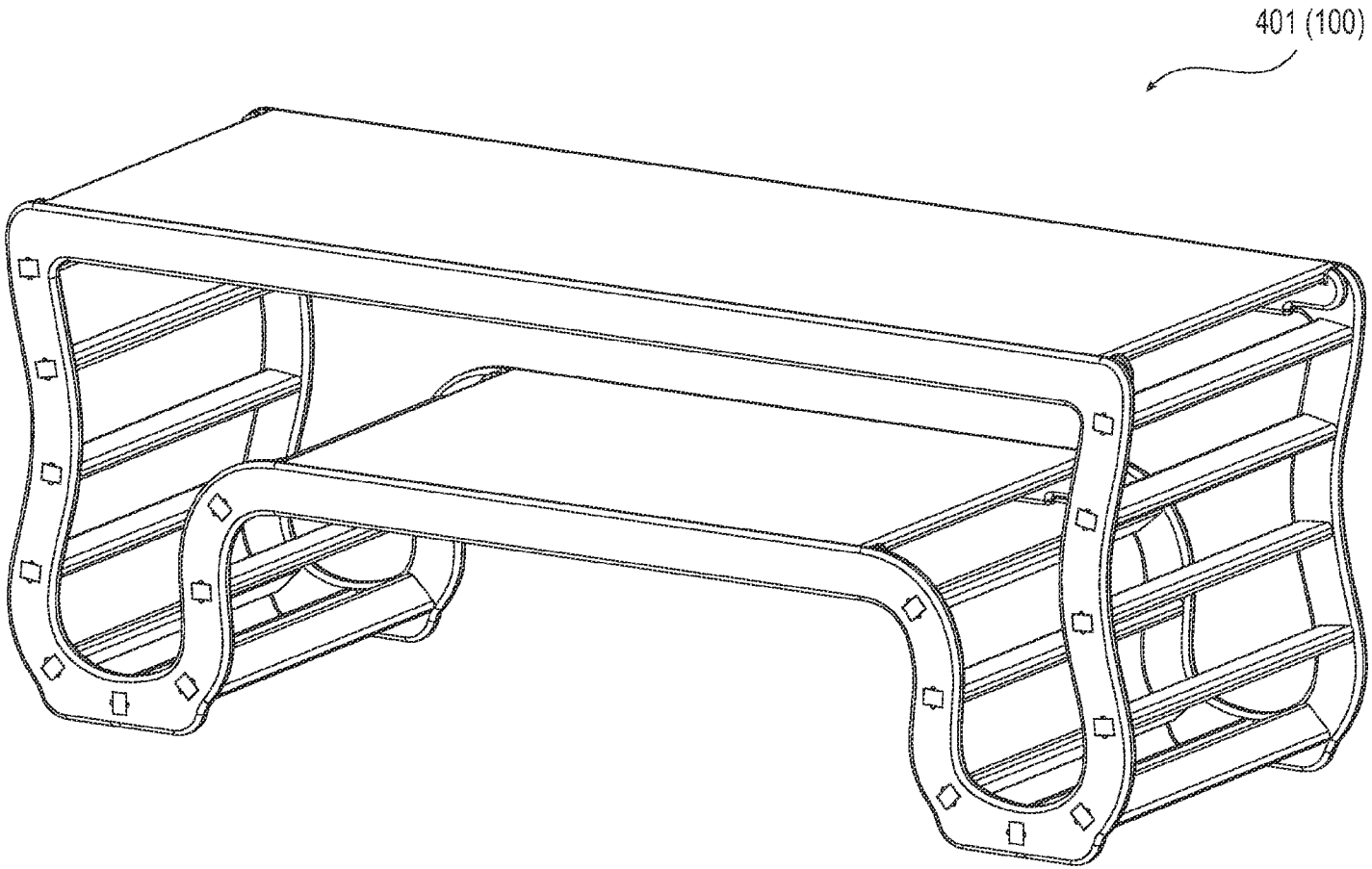
FIG. 10 is a view of a third exemplary configuration.
Figure 11:
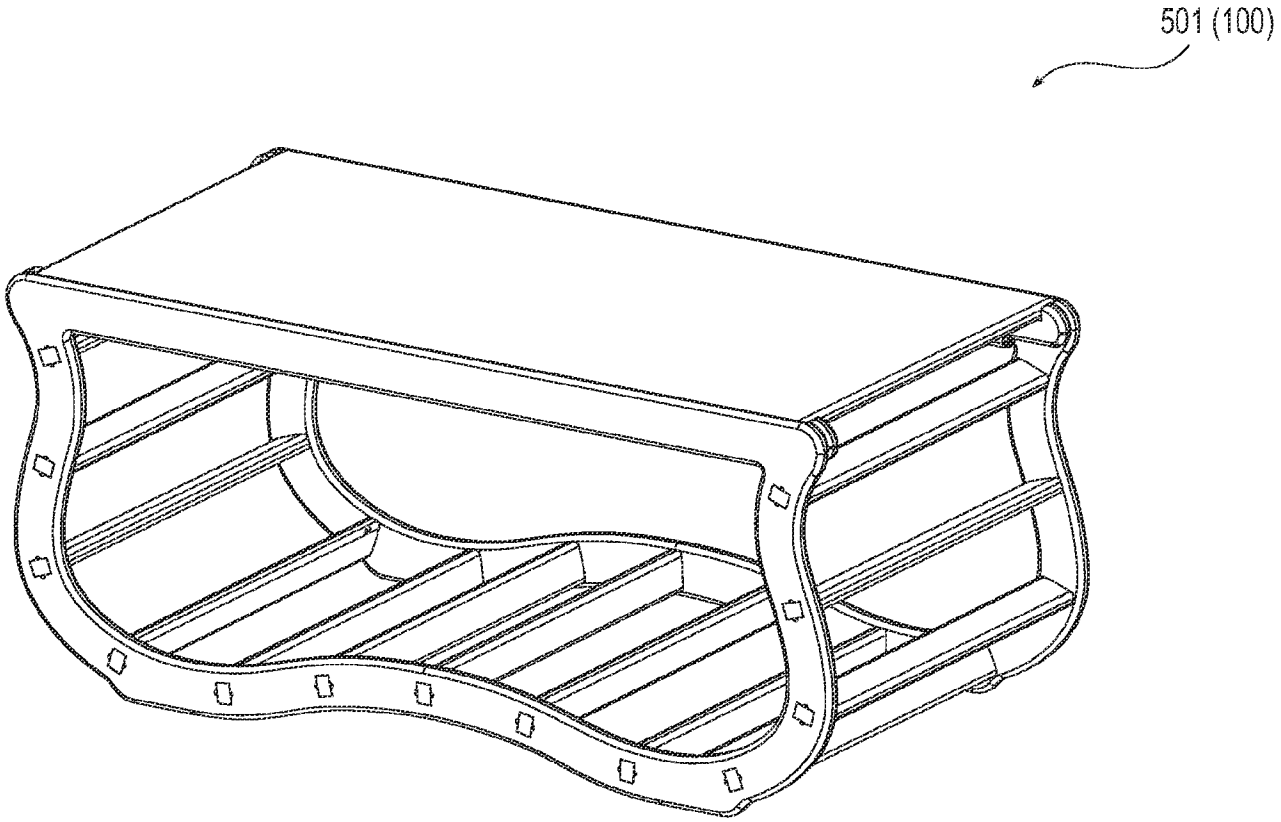
FIG. 11 is a view of a fourth exemplary configuration.
Figure 12:
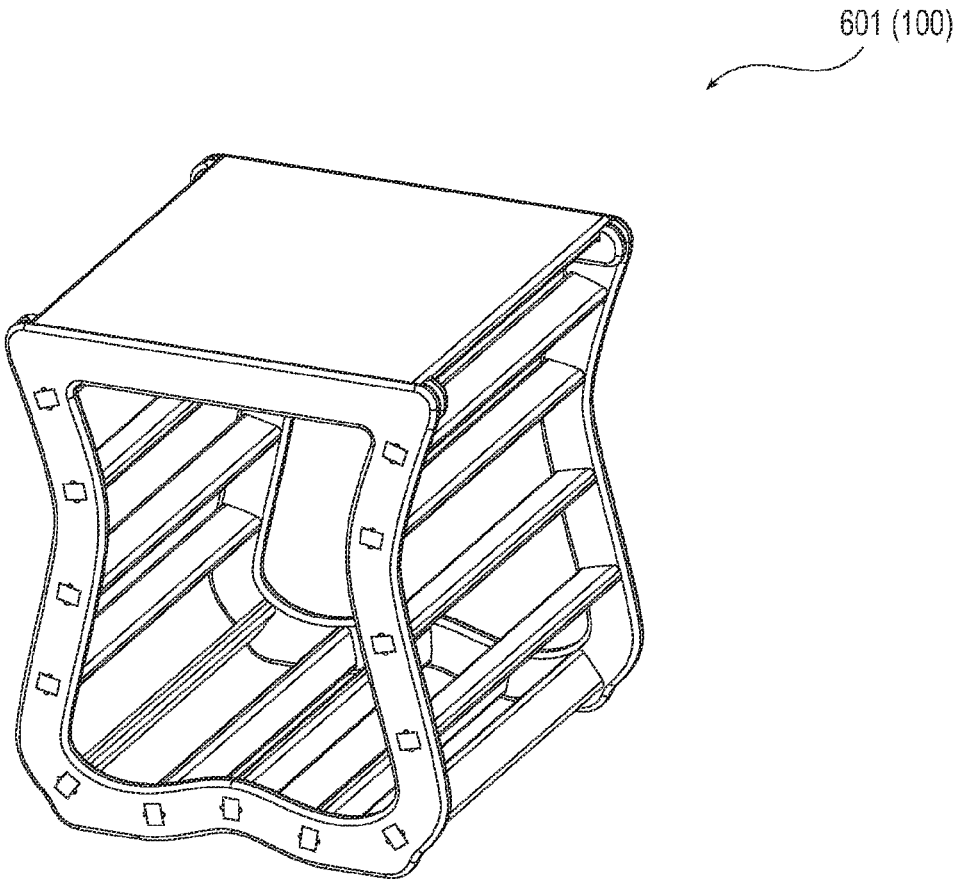
FIG. 12 is a view of a fifth exemplary configuration.

As would be understood in light of the foregoing disclosure, the modular furniture system 100 can be arranged in other configurations, such as a television stand 401 shown in FIG. 10, a coffee table 501 shown in FIG. 11, and a side table 601 shown in FIG. 12. Such other configurations are based on combinations of components of the modular furniture system 100 as described above.

What is claimed is:

1. A modular furniture system comprising:

a plurality of frame portions including a first frame portion and a second frame portion, each of the frame portions including a first recess;

a plurality of slats including a first slat, the first slat including a first frame contact surface, a second frame contact surface, a first distal end surface, and a second distal end surface, the first frame contact surface being configured to abut an inner surface of the first frame portion, the second frame contact surface being configured to abut an inner surface of the second frame portion, the inner surface of the first frame portion facing the inner surface of the second frame portion, the first distal end surface being configured to fit through the first recess of the first frame portion, and the second distal end surface being configured to fit through the first recess of the second frame portion;

a first removable support configured to abut the first frame portion and the second frame portion; and a first coupling mechanism disposed in or fixed to a combination of the first slat and the first frame portion, the first coupling mechanism being disposed in or fixed to the first slat and the first frame portion before provision of the first slat and the first frame portion to a user, the first coupling mechanism being configured to, without using any tool, couple the first slat to the first frame portion, and release the first slat from the first frame portion.

2. The modular furniture system of claim 1, wherein the first coupling mechanism includes a first restrictor, a second restrictor, a first spring, a second spring, a first detent, and a second detent, the first restrictor is configured to protrude from a first surface of the first slat, is biased in a first direction by the first spring, and is configured to fit into the first detent, the second restrictor is configured to protrude from a second surface of the first slat opposite to the first surface of the first slat, is biased in a second direction opposite to the first direction by the second spring, and is configured to fit into the second detent, the first detent is formed in the first recess of the first frame portion, and the second detent is formed in the first recess of the first frame portion.

3. The modular furniture system of claim 2, further comprising:

a second coupling mechanism configured to, without using any tool, couple the first slat to the second frame portion, and release the first slat from the second frame portion, wherein the second coupling mechanism includes a third restrictor, a fourth restrictor, a third spring, a fourth spring, a third detent, and a fourth detent, the third restrictor is configured to protrude from the first surface of the first slat, is biased in the first direction by the third spring, and is configured to fit into the third detent, the fourth restrictor is configured to protrude from the second surface of the first slat, is biased in the second direction by the fourth spring, and is configured to fit into the fourth detent, the third detent is formed in the first recess of the second frame portion, and the fourth detent is formed in the first recess of the second frame portion.

4. The modular furniture system of claim 1, wherein the first coupling mechanism includes a first locking portion and a first anchor, the first anchor is fixed to one of the first slat and the first frame portion, the first locking portion is fixed to the other of the first slat and the first frame portion, and the first locking portion is configured to pull the first anchor towards the first locking portion for coupling and to release the first anchor from the first locking portion for releasing.

5. The modular furniture system of claim 4, further comprising:

a second coupling mechanism configured to, without using any tool, couple the first slat to the second frame portion, and release the first slat from the second frame portion, wherein the second coupling mechanism includes a second locking portion and a second anchor, the second anchor is fixed to one of the first slat and the second frame portion, the second locking portion is fixed to the other of the first slat and the second frame portion, and the second locking portion is configured to pull the second anchor towards the second locking portion for coupling and to release the second anchor from the second locking portion for releasing.

6. The modular furniture system of claim 1, wherein the first coupling mechanism is further configured to, without using any tool, couple the first slat to the second frame portion, and release the first slat from the second frame portion.

7. The modular furniture system of claim 6, wherein the first coupling mechanism is an adjustable strap configured to cover an outer surface of the first frame portion that is opposite to the inner surface of the first frame portion, and cover an outer surface of the second frame portion that is opposite to the inner surface of the second frame portion.

8. The modular furniture system of claim 1, further comprising:

a second coupling mechanism configured to, without using any tool, couple the first slat to the first frame portion, and release the first slat from the first frame portion, wherein a type of the second coupling mechanism is different from a type of the first coupling mechanism.

9. The modular furniture system of claim 1, further comprising:

a second coupling mechanism configured to, without using any tool, couple the first slat to the first frame portion, and release the first slat from the first frame portion;

and a third coupling mechanism configured to, without using any tool, couple the first slat to the first frame portion, and release first slat from the first frame portion, wherein the first coupling mechanism includes a first restrictor, a second restrictor, a first spring, a second spring, a first detent, and a second detent, the first restrictor is configured to protrude from a first surface of the first slat, is biased in a first direction by the first spring, and is configured to fit into the first detent, the second restrictor is configured to protrude from a second surface of the first slat opposite to the first surface of the first slat, is biased in a second direction opposite to the first direction by the second spring, and is configured to fit into the second detent, the first detent is formed in the first recess of the first frame portion, the second detent is formed the first recess of the first frame portion, the second coupling mechanism includes a locking portion and an anchor, the anchor is fixed to one of the first slat and the first frame portion, the locking portion is fixed to the other of the first slat and the first frame portion, and the locking portion is configured to pull the anchor towards the locking portion for coupling and to release the anchor from the locking portion for releasing, and the third coupling mechanism is an adjustable strap configured to cover an outer surface of the first frame portion that is opposite to the inner surface of the first frame portion, and cover an outer surface of the second frame portion that is opposite to the inner surface of the second frame portion.

10. The modular furniture system of claim 1, further comprising:

a second coupling mechanism configured to, without using any tool, couple the first slat to the first frame portion, and release the first slat from the first frame portion;

and a third coupling mechanism, wherein each of the plurality of the frame portions further includes a second recess, the plurality of the slats includes a second slat, the second slat includes a third frame contact surface, a fourth frame contact surface, a third distal end surface, and a fourth distal end surface, the third frame contact surface is configured to abut the inner surface of the first frame portion, the fourth frame contact surface is configured to abut the inner surface of the second frame portion, the third distal end surface being configured to fit through the second recess of the first frame portion, the fourth distal end surface being configured to fit through the second recess of the second frame portion, the third coupling mechanism is configured to, without using any tool, couple the second slat to the first frame portion, and release the second slat from the first frame portion, and a number of the coupling mechanisms configured to couple the second slat to the first frame portion is less than a number of the coupling mechanisms configured to couple the first slat to the first frame portion.

11. The modular furniture system of claim 1, further comprising:

a second coupling mechanism; and a third coupling mechanism, wherein the plurality of frame portions further includes a third frame portion and a fourth frame portion, an outer surface of the third frame portion is configured to abut an outer surface of the second frame portion, the plurality of slats further includes a second slat, the second slat including a third frame contact surface, a fourth frame contact surface, a third distal end surface, and a fourth distal end surface, the third frame contact surface being configured to abut an inner surface of the third frame portion, the fourth frame contact surface being configured to abut an inner surface of the fourth frame portion, the inner surface of the third frame portion facing the inner surface of the fourth frame portion, the third distal end surface of the second slat being configured to fit through the first recess of the third frame portion, the fourth distal end surface of the second slat being configured to fit through the first recess of the fourth frame portion, the second coupling mechanism is configured to, without using any tool, couple the second slat to the third frame portion, and release the second slat from the third frame portion, and the third coupling mechanism is configured to, without using any tool, couple the third frame portion to the second frame portion, and release the third frame portion from the second frame portion.

12. The modular furniture system of claim 11, wherein the third coupling mechanism is one of:

an adjustable strap configured to abut an outer surface of the first frame portion that is opposite to the inner surface of the first frame portion, and a connector configured to abut the inner surface of the second frame portion and the inner surface of the third frame portion.

13. The modular furniture system of claim 1, further comprising:

a second coupling mechanism configured to, without using any tool, couple the first removable support to the first frame portion, and release the first removable support from the first frame portion.

14. The modular furniture system of claim 1, further comprising:

a removable extension; and a second coupling mechanism configured to, without using any tool, couple the removable extension to the first removable support such that a top surface of the removable extension and a top surface of the first removable support are continuous and coplanar, and release the removable extension from the first removable support.

15. The modular furniture system of claim 14, wherein the second coupling mechanism includes at least one of:

a knob including a shaft configured to be inserted into the removable support, an extendible shaft fixed to the first removable support, and a magnet configured to attach to a bracket fixed to one of the removable extension and the first removable support.

16. The modular furniture system of claim 1, further comprising:

an arm rest; and a second coupling mechanism configured to, without using any tool, couple the arm rest to the first frame portion, and release the aim rest from the first frame portion.

17. A method of assembling a modular furniture system, the method comprising:

coupling, without using any tool, a first frame contact surface of each of a plurality of slats to a first frame portion such that a first distal end surface of each of the slats passes through a respective one of a plurality of recesses of the first frame portion, the coupling of each of the plurality of slats to the first frame portion being performed by a respective coupling mechanism disposed in or fixed to a combination of the respective slat and the first frame portion, the respective coupling mechanism being disposed in or fixed to the respective slat and the first frame portion before provision of the plurality of slats and the first frame portion to a user;

coupling, without using any tool, a second frame contact surface of each of the plurality of slats to a second frame portion such that a second distal end surface of each of the 13 slats passes through a respective one of a plurality of recesses of the second frame portion; and coupling, without using any tool, a removable support to each of the first frame portion and the second frame portion, the coupling of the removable support being performed by a coupling mechanism fixed to the removable support and to each of the first frame portion and the second frame portion before provision of the removable support, the first frame portion, and the second frame portion to the user.

* * * * *